US011712784B2

(12) United States Patent
Jayaram et al.

(10) Patent No.: US 11,712,784 B2
(45) Date of Patent: Aug. 1, 2023

(54) ABRASIVE ARTICLE AND METHOD FOR FORMING SAME

(71) Applicants: SAINT-GOBAIN ABRASIVES, INC., Worcester, MA (US); SAINT-GOBAIN ABRASIFS, Conflans-Sainte-Honorine (FR)

(72) Inventors: Robin Chandras Jayaram, Thiruvananthapuram (IN); Arunvel Thangamani, Chennai (IN); Gurulingamurthy M. Haralur, Chennai (IN)

(73) Assignees: SAINT-GOBAIN ABRASIVES, INC., Worcester, MA (US); SAINT-GOBAIN ABRASIFS, Conflans-Sainte-Honorine (FR)

( * ) Notice: Subject to any disclaimer, the term of this patent is extended or adjusted under 35 U.S.C. 154(b) by 1337 days.

(21) Appl. No.: 16/152,386

(22) Filed: Oct. 4, 2018

(65) Prior Publication Data

US 2019/0099859 A1 Apr. 4, 2019

(30) Foreign Application Priority Data

Oct. 4, 2017 (IN) ..... 201741035158

(51) Int. Cl.

| | |
|---|---|
| ***B24D 11/00*** | (2006.01) |
| ***B24D 99/00*** | (2010.01) |
| ***B24D 18/00*** | (2006.01) |

(52) U.S. Cl.

CPC ..... *B24D 11/001* (2013.01); *B24D 18/0072* (2013.01); *B24D 99/00* (2013.01)

(58) Field of Classification Search

CPC ... B24D 11/001; B24D 18/0072; B24D 99/00
USPC ..... 451/533
See application file for complete search history.

(56) References Cited

U.S. PATENT DOCUMENTS

| | | | | |
|---|---|---|---|---|
| 5,125,188 | A | 6/1992 | Ogawa et al. | |
| 5,201,916 | A * | 4/1993 | Berg | C04B 35/1115 51/293 |
| 5,560,753 | A * | 10/1996 | Schnabel | B24D 11/02 428/141 |

(Continued)

FOREIGN PATENT DOCUMENTS

| | | | |
|---|---|---|---|
| CN | 206182955 | U | 5/2017 |
| DE | 1997122121 | A1 | 12/1998 |

(Continued)

OTHER PUBLICATIONS http://d-scholarship.pitt.edu/23716/7/liangrj_etdPitt2014.pdf (Year: 2014).*

(Continued)

*Primary Examiner* — Don M Anderson
*Assistant Examiner* — Jason Khalil Hawkins
(74) *Attorney, Agent, or Firm* — Abel Schillinger, LLP; Arpan Ghosh

(57) ABSTRACT

An abrasive article includes an abrasive body having a bond material, abrasive particles contained within the bond material, and an electronic assembly coupled to the abrasive body, wherein the electronic assembly comprises at least one electronic device. In an embodiment, the electronic assembly is coupled to the abrasive body in a tamper-proof manner.

20 Claims, 13 Drawing Sheets

(56) References Cited

U.S. PATENT DOCUMENTS 5,620,489 A * 4/1997 Tselesin ..... B24D 18/0009 51/299
5,725,413 A * 3/1998 Malshe ..... B24B 37/04 451/7
5,733,178 A 3/1998 Ohishi
6,123,612 A * 9/2000 Goers ..... B24D 3/08 451/540
6,322,422 B1 * 11/2001 Satou ..... B24B 37/005 451/283
6,325,696 B1 * 12/2001 Boggs ..... B24B 49/16 451/6
6,330,971 B1 * 12/2001 Mabry ..... H01L 21/67294 235/383
6,421,013 B1 * 7/2002 Chung ..... H01L 21/56 235/441
6,458,014 B1 10/2002 Ihsikawa et al.
6,520,834 B1 * 2/2003 Marshall ..... B24B 37/11 451/550
6,558,229 B2 * 5/2003 Kimura ..... B24B 37/013 451/8
6,739,945 B2 5/2004 Halley et al.
6,764,381 B2 * 7/2004 Kimura ..... B24B 49/04 451/8
6,984,164 B2 * 1/2006 Kimura ..... B24B 49/10 451/8
6,985,791 B2 1/2006 Malkin et al.
7,078,894 B2 * 7/2006 Tada ..... B24B 49/105 451/8
7,259,678 B2 * 8/2007 Brown ..... G08B 13/2437 340/572.8
7,561,052 B2 * 7/2009 Arai ..... G06K 19/07722 235/487
7,728,734 B2 * 6/2010 Arai ..... G08B 13/2437 235/492
7,740,425 B2 6/2010 Zeiler et al.
7,800,285 B2 9/2010 Andie et al.
7,840,305 B2 * 11/2010 Behr ..... B24B 37/04 700/173
7,963,823 B2 6/2011 Fischer
8,421,600 B2 4/2013 Erickson et al.
8,496,511 B2 * 7/2013 Laraia ..... B24B 53/001 451/72
8,622,787 B2 * 1/2014 Sung ..... B24B 53/017 451/443
8,801,497 B2 * 8/2014 Schwappach ..... B24D 11/00 451/340
8,808,064 B2 * 8/2014 Schwappach ..... B24D 11/00 451/529
8,840,447 B2 * 9/2014 Schwappach ..... B24D 11/00 451/529
9,272,386 B2 * 3/2016 Suen ..... B24B 37/20
9,669,508 B2 6/2017 Layton, Jr. et al.
9,987,720 B2 * 6/2018 Suen ..... B24B 37/20
10,471,567 B2 * 11/2019 Doering ..... B24D 7/08
11,229,987 B2 * 1/2022 Eckel ..... G06K 19/045
2003/0022598 A1 1/2003 Muilenburg et al.
2004/0048557 A1 * 3/2004 Nabeya ..... B24B 53/017 451/56
2004/0162010 A1 * 8/2004 Ohno ..... B24D 3/28 451/41
2007/0235133 A1 10/2007 Benassi
2008/0004743 A1 1/2008 Goers et al.
2008/0216414 A1 9/2008 Braunschweig et al.
2008/0227367 A1 * 9/2008 Birang ..... B24B 37/013 451/6
2008/0304929 A1 12/2008 Fischer
2010/0156723 A1 * 6/2010 Luch ..... H01Q 1/2225 343/700 MS
2010/0279586 A1 * 11/2010 Schwappach ..... B24D 11/00 451/340
2011/0035186 A1 2/2011 Liu et al.
2013/0059506 A1 3/2013 Qian et al.
2014/0120724 A1 * 5/2014 Sung ..... B24D 18/0072 438/692
2014/0308883 A1 * 10/2014 Sung ..... B24B 53/017 451/443
2015/0111477 A1 * 4/2015 Suen ..... B24B 37/30 451/60
2015/0291867 A1 10/2015 Breder et al.
2017/0057051 A1 * 3/2017 Nakamura ..... B24B 49/105
2017/0113321 A1 * 4/2017 Chou ..... B24B 53/017

FOREIGN PATENT DOCUMENTS

DE 10344602 A1 5/2005
DE 102007011880 A1 9/2008
DE 102007031299 A1 1/2009
EP 0921906 A1 6/1999
EP 901881 B1 10/2003
JP 2000-079565 A 3/2000
JP 2003-192769 A 7/2003
JP 2005-291999 A 10/2005
JP 2005-316580 A 11/2005
JP 2009-542449 A 12/2009
JP 2013-082051 A 5/2013
JP 2017-518887 A 7/2017
WO 9806541 A1 2/1998
WO 2015011489 A1 1/2015
WO 2015160857 A1 10/2015
WO 2017123834 A1 7/2017
WO 2018160658 A2 9/2018
WO 2018160663 A2 9/2018

OTHER PUBLICATIONS

Zuo Dun-Wen, "Modern Processing Technology," Beihang University Press, 2005, 9 pages.
English translation of an Office Action for Chinese Application No. 2018800723863, dated Dec. 10, 2021, 13 pages.
Radio Frequency Identification, Winter Superabrasives brochure, 2009, 1 pg.
RAIN RFID Guide, Impinj, 2017, 20 pgs. https://www.impinj.com/about-rfid/.
RFID Selection Guide, EBV Elektronik, 2010, 24 pgs. https://cdn-shop.adafruit.com/datasheets/rfid+guide.pdf.
Holdowsky et al., "Inside the Internet of Things," Deloitte University Press, 2015, 54 pgs.
Manyika et al., "The Internet of Things: Mapping the Value Beyond the Hype," 2015, 144 pgs, McKinsey Global Institute, McKinsey & Company.
The Beginner's Guide to RFID Systems, Atlas RFID Store Ebooks, 2017, 16 pgs, https://www.atlasrfidstore.com/.
Sattlegger et al., "Navigating your way through the RFID jungle," Texas Instruments, 2014, 11 pgs.
Loy et al., "ISM-Band and Short Range Device Regulatory Compliance Overview," Texas Instruments, 2005, 17 pgs.
"Intermec RFID Tags & Media," Honeywell International Inc., 2013, 7 pgs.
EPC Compliant Class-1 Generation-2 UHF RFID Devices Conformance Requirements, GS1, 2015, 96 pages.
Regulatory Status for using RFID in the EPC Gen2 (860 to 960 MHZ) band of the UHF spectrum, GS1, 2018, 18 pgs.
"What is a Wireless Sensor Network?" National Instruments, 2016, 2 pgs. http://www.ni.com/white-paper/7142/en/.
Anghanwa, "Using RFID Technology to Stop Counterfeiting," ATMEL, 2007, 9 pgs.
"RFID for Brand Protection," NXP Semiconductors, 2013, 10 pgs. https://nxp-rfid.com/applications/brand-protection-rfid/.
Armstrong, "PINC Solutions Drives Supply Chain Efficiencies for Daimler Trucks," 2015, 3 pgs, Armstrong & Associates, Inc.
Belfiore, "Solving NASA's Water Problem," RFID Journal, 2015, 4 pgs.
Fasl, "Using NI WSN and NI LabVIEW to Wirelessly Monitor Fatigue Damage on Highway Bridges," National Instruments, 2013, 1 page.http://sine.ni.com/cs/app/doc/p/id/cs-15206.

(56) References Cited

OTHER PUBLICATIONS

International Search Report and Written Opinion for PCT/US2018/054474, dated Jan. 28, 2019, 20 pages.
Brown, "Finding Value in the Industrial Internet of Things," 2016, outline of webinar from Lux Research, Inc., full webinar at http://web.luxresearchinc.com/download-iiot-2_16.

* cited by examiner

ABRASIVE ARTICLE AND METHOD FOR FORMING SAME

CROSS-REFERENCE TO RELATED APPLICATION

The application claims priority to Indian Application 201741035158, filed Oct. 4, 2017, entitled "ABRASIVE ARTICLE AND METHOD FOR FORMING SAME", by Robin Chandras JAYARAM et al., which application is assigned to the current assignee hereof and incorporated by reference herein in its entirety.

FIELD OF THE DISCLOSURE

The present disclosure relates to abrasive articles, and more particularly, abrasive articles including an electronic assembly.

BACKGROUND

Abrasive articles can include abrasive particles attached to a matrix material and be used to remove material from an object. Various types of abrasive articles can be formed, including but not limited to, coated abrasive articles, bonded abrasive articles, convoluted abrasive articles, abrasive brushes, and the like. Coated abrasive articles generally include one or more layers of abrasive material overlying a substrate. The abrasive particles can be affixed to the substrate using one or more adhesive layers. A bonded abrasive article can include a three dimensional matrix of bond material and abrasive particles contained within the matrix of bond material. Bonded abrasive articles may include some content of porosity within the body.

The manufacturing and use of abrasive articles can vary widely and the industry continues to demand improved abrasive articles.

BRIEF DESCRIPTION OF THE DRAWINGS

Embodiments are illustrated by way of example and are not limited to the accompanying figures.

Skilled artisans appreciate that elements in the figures are illustrated for simplicity and clarity and have not necessarily been drawn to scale.

DETAILED DESCRIPTION

The following discussion will focus on specific implementations and embodiments of the teachings. The detailed description is provided to assist in describing certain embodiments and should not be interpreted as a limitation on the scope or applicability of the disclosure or teachings. It will be appreciated that other embodiments can be used based on the disclosure and teachings as provided herein.

The abrasive articles of the embodiments herein can have various structures, grades and architectures and can be used in a variety of material removal operations. In an embodiment, the abrasive articles can include a fixed abrasive article. In a particular embodiment, the abrasive article can include bonded abrasive articles, coated abrasive articles and the like.

Figure 1A:
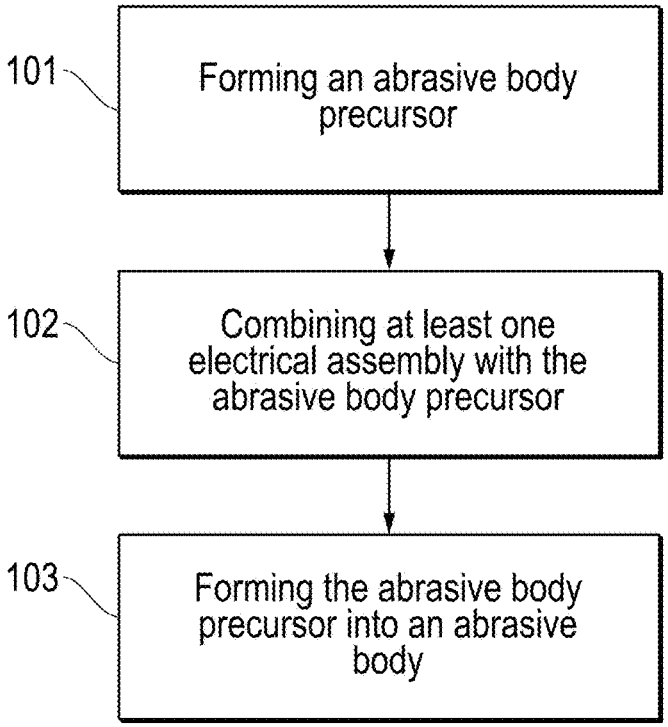
FIG. 1A includes a flow chart for forming an abrasive article according to an embodiment.

FIG. 1A includes a flow chart providing steps for forming an abrasive article according to an embodiment. As illustrated, the process begins at step 101 with forming of abrasive body precursor. An abrasive body precursor can be a green body or unfinished abrasive article, wherein at least one more process is needed to transform the abrasive body precursor into a finally-formed abrasive body. Such processes can include, but are not limited to curing, heating, sintering, cooling, drying, pressing, molding, casting, punching, or any combination thereof.

According to one embodiment, the abrasive body precursor can be a liquid material, such as a liquid mixture. The liquid mixture can include some or all of the components configured to form the finally-formed abrasive article. For example, the liquid mixture can include the abrasive particles and a bond precursor material.

In still another embodiment, the abrasive body precursor can be a solid green body. Reference herein to a green body, is an object that is formed into a solid three-dimensional body, but will undergo a final treatment, such as curing or a heat treatment to further solidify and/or densify the body. In particular, a green body includes a precursor bond material that is solid, but will undergo further treatment to transform the precursor bond material into a finally-formed bond material in the finally-formed abrasive article.

As noted herein, the abrasive body precursor may include a bond precursor material. A bond precursor material can include one or more components that can undergo a process to transform from the bond precursor material into the finally-formed bond material. Some suitable bond precursor materials can include an organic or inorganic material. For example, the bond precursor material can include a resin, an epoxy, a polyamide, a metal, a metal alloy, a vitreous material (e.g., a frit), a ceramic, or any combination thereof.

The abrasive body precursor may also include abrasive particles. The abrasive particles may include one or more various types, including for example, a mix of different types of abrasive particles. The abrasive particles can include any type of abrasive particle used and known by those of skill in the art. For example, the abrasive particles can include an inorganic material, including but not limited to, an oxide, a carbide, a nitride, a boride, a carbon-based materials (e.g., diamond), an oxycarbides, an oxynitride, an oxyboride, a superabrasive material, or any combination thereof. The abrasive particles can include shaped abrasive particles, crushed abrasive particles, exploded abrasive particles, agglomerated particles, unagglomerated particles, monocrystalline particles, polycrystalline particles, or any combination thereof. The abrasive particles can include a material selected from the group of silicon dioxide, silicon carbide, alumina, zirconia, flint, garnet, emery, rare earth oxides, rare earth-containing materials, cerium oxide, sol-gel derived particles, gypsum, iron oxide, glass-containing particles, brown fused alumina (57A), seeded gel abrasive, sintered alumina with additives, shaped and sintered aluminum oxide, pink alumina, ruby alumina (e.g., 25A and 86A), electrofused monocrystalline alumina 32A, MA88, alumina zirconia abrasives (NZ, NV, ZF), extruded bauxite, cubic boron nitride, diamond, aluminum oxy-nitride, extruded alumina (e.g., SR1, TG, and TGII), or any combination thereof. In certain instances, the abrasive particles can be particularly hard, having for example, a Mohs hardness of at least 6, such as at least 6.5, at least 7, at least 8, at least 8.5, at least 9. The finally-formed abrasive article can include any of the types of abrasive particles included in the precursor abrasive body.

The abrasive particles can have an average particle size (D50) of at least 0.1 microns, such as at least 1 micron, at least 5 microns, at least 10 microns, at least 20 microns, at least 30 microns, at least 40 microns or at least 50 microns or at least 100 microns or at least 200 microns or at least 500 microns or at least 1000 microns. Still, in another non-limiting embodiment, the abrasive particles can have an average particle size (D50) of not greater than 5000 microns, such as not greater than 4000 microns or not greater than 3000 microns or not greater than 2000 microns or not greater than 1000 microns or not greater than 500 microns or not greater than 200 microns or not greater than 100 microns or not greater than 80 microns or not greater than 60 microns or not greater than 30 microns or not greater than 10 microns or not greater than 1 micron. It will be appreciated that the abrasive particles can have an average particle size within a range including any of the minimum and maximum values noted above. Moreover, it will be appreciated that the finally-formed abrasive article can have abrasive particles having an average particles size within a range including any of the minimum and maximum percentages noted above.

The abrasive particles can include blend of different particles, which may differ from each other based on one or more abrasive characteristics, such as hardness, average particle size, average grain (i.e., crystallite size), toughness, two-dimensional shape, three-dimensional shape, composition, or any combination thereof. The blends of abrasive particles can include a primary and a secondary abrasive particle. The primary and secondary abrasive particles can include any of the compositions of abrasive particles described herein.

The abrasive body precursor can include a content of abrasive particles suitable for use as an abrasive article. For example, the abrasive body precursor can include at least 0.5 vol % abrasive particles for a total volume of the abrasive body precursor. In still other embodiments, the abrasive body precursor can include at least 1 vol % abrasive particles, such as at least 5 vol % or at least 10 vol % or at least 15 vol % or at least 20 vol % or at least 30 vol % or at least 40 vol % or at least 50 vol % or at least 60 vol % or at least 70 vol % or at least 80 vol % abrasive particles for a total volume of the abrasive body precursor. In yet another non-limiting embodiment, the abrasive body precursor can have not greater than 90 vol % abrasive particles for the total volume of the abrasive body precursor, such as not greater than 80 vol % or not greater than 70 vol % or not greater than 60 vol % or not greater than 50 vol % or not greater than 40 vol % or not greater than 30 vol % or not greater than 20 vol % or not greater than 10 vol % or not greater than 5 vol % abrasive particles. It will be appreciated that the abrasive body precursor can have a content of abrasive particles within a range including any of the minimum and maximum percentages noted above. Moreover, it will be appreciated that the finally-formed abrasive article can have a content of abrasive particles within a range including any of the minimum and maximum percentages noted above.

The abrasive body precursor may further include one or more types of fillers as known by those of skill in the art. The filler can be distinct from the abrasive particles and may have a hardness less than a hardness of the abrasive particles. The filler may provide improved mechanical properties and facilitate formation of the abrasive article. In at least one embodiment, the filler can include various materials, such as fibers, woven materials, non-woven materials, particles, minerals, nuts, shells, oxides, alumina, carbide, nitrides, borides, organic materials, polymeric materials, naturally occurring materials, pore-formers (solid or hollow), and a combination thereof. In particular instances, the filler can include a material such as wollastonite, mullite, steel, iron, copper, brass, bronze, tin, aluminum, kyanite, alusite, garnet, quartz, fluoride, mica, nepheline syenite, sulfates (e.g., barium sulfate), carbonates (e.g., calcium carbonate), cryolite, glass, glass fibers, titanates (e.g., potassium titanate fibers), rock wool, clay, sepiolite, an iron sulfide (e.g., $Fe_2S_3$, $FeS_2$, or a combination thereof), fluorspar ($CaF_2$), potassium sulfate ($K_2SO_4$), graphite, potassium fluoroborate ($KBF_4$), potassium aluminum fluoride ($KAlF_4$), zinc sulfide (ZnS), zinc borate, borax, boric acid, fine alundum powders, P15A, bubbled alumina, cork, glass spheres, silver, Saran™ resin, paradichlorobenzene, oxalic acid, alkali halides, organic halides, and attapulgite. Some fillers can volatilize or be consumed during later processing. Some fillers may become part of the finally-formed abrasive article. It will be appreciated that the body can include one or more reinforcing articles (e.g., woven or non-woven materials) that are incorporated into the body and are part of the finally-formed abrasive article.

The abrasive body precursor may further include one or more additives, including for example, but not limited to stabilizers, binders, plasticizers, surfactants, friction-reducing materials, rheology modifying materials, and the like.

In certain abrasive articles, such as coated abrasive articles, the abrasive body precursor may include a substrate or backing, upon which one or more abrasive layers may be formed. According to one embodiment, the substrate can include an organic material, inorganic material, or any combination thereof. In certain instances, the substrate can include a woven material. However, the substrate may be made of a non-woven material. Particularly suitable substrate materials can include organic materials, including polymers such as polyester, polyurethane, polypropylene, and/or polyimides such as KAPTON from DuPont, and paper. Some suitable inorganic materials can include metals, metal alloys, and particularly, foils of copper, aluminum, steel, and a combination thereof. The backing can include one or more additives selected from the group of catalysts, coupling agents, curants, anti-static agents, suspending agents, anti-loading agents, lubricants, wetting agents, dyes, fillers, viscosity modifiers, dispersants, defoamers, and grinding agents.

In some abrasive articles, such as those utilizing a substrate, a polymer formulation may be used to form any of a variety of layers such as, for example, a frontfill, a pre-size, the make coat, the size coat, and/or a supersize coat. When used to form the frontfill, the polymer formulation generally includes a polymer resin, fibrillated fibers (preferably in the form of pulp), filler material, and other optional additives. Suitable formulations for some frontfill embodiments can include material such as a phenolic resin, wollastonite filler, defoamer, surfactant, a fibrillated fiber, and a balance of water. Suitable polymeric resin materials include curable resins selected from thermally curable resins including phenolic resins, urea/formaldehyde resins, phenolic/latex resins, as well as combinations of such resins. Other suitable polymeric resin materials may also include radiation curable resins, such as those resins curable using electron beam, UV radiation, or visible light, such as epoxy resins, acrylated oligomers of acrylated epoxy resins, polyester resins, acrylated urethanes and polyester acrylates and acrylated monomers including monoacrylated, multiacrylated monomers. The formulation can also comprise a nonreactive thermoplastic resin binder which can enhance the self-sharpening characteristics of the deposited abrasive particles by enhancing the erodability. Examples of such thermoplastic resin include polypropylene glycol, polyethylene glycol, and polyoxypropylene-polyoxyethene block copolymer, etc. Use of a frontfill on the substrate can improve the uniformity of the surface, for suitable application of the make coat and improved application and orientation of shaped abrasive particles in a predetermined orientation.

After forming the abrasive body precursor at step 101, the process continues at step 102 by combining at least one electrical assembly with the abrasive body precursor. According to an embodiment, the electrical assembly can include at least one electronic device. The electronic device can be configured to store and/or transmit information to one or more systems and/or individuals in the life of the abrasive article, including for example, those systems and/or individuals included in the manufacturing, sale, distribution, storage, use, maintenance and/or quality of the abrasive article.

The process of combining the electronic assembly with the abrasive body precursor can vary depending upon the nature of the abrasive body precursor. In one example, the process of combining the abrasive body precursor with the electronic assembly can include depositing the electronic assembly on or within the mixture of material defining the abrasive body precursor. In particular, the process of depositing the electronic assembly on or with the mixture can include incorporation of the electronic assembly into the mixture prior to formation of the finally-formed abrasive article. In such instances, the electronic assembly can be configured to survive one or more forming processes used to create the finally-formed abrasive article from the mixture. For example, the electronic assembly can be configured to survive and function after the mixture and electronic assembly are subjected to one or more processes including, for example, but not limited to, pressing, heating, drying, curing, cooling, molding, stamping, cutting, machining, dressing, and the like.

In one particular embodiment, the electronic assembly can be deposited on the mixture, such that at least a portion of the electronic assembly can be in contact with and overlying an exterior surface of the mixture. For example, the entire electronic assembly can be overlying the exterior surface of the mixture. Such a deposition process may facilitate forming an abrasive article having at least a portion of the electronic assembly at an exterior surface of the abrasive body.

In another embodiment, the electronic assembly can be deposited such that a portion of the electronic assembly can be contained within the mixture, such that at least a portion of the electronic assembly is positioned below the exterior surface of the mixture. For example, in one instance, a portion of the electronic assembly can be embedded within the mixture and another separate portion of the electronic assembly can be overlying the exterior surface of the mixture. Such a deposition process may facilitate formation of an electronic assembly in which a portion of the electronic assembly is embedded within the body of the abrasive article below an exterior surface of the body. In yet another embodiment, the entire electronic assembly can be embedded within the mixture. Such a deposition process may facilitate formation of an abrasive article, wherein the electronic assembly can be embedded entirely within the body of the abrasive article, such that no portion of the electronic assembly is protruding through the exterior surface of the body. It may be desirable to utilize a configuration in which the electronic assembly is partially or entirely embedded within the body of the abrasive article to reduce the likelihood of tampering with the electronic assembly and one or more electronic devices contained therein.

In still another embodiment, the process of depositing the electronic assembly on or within the mixture can further include applying the electronic assembly to one or more components and then applying the mixture to the component. For example, the electronic assembly can be placed on or within an article (e.g., a substrate, a backing, a reinforcing member, a partially-cured or completely cured abrasive portion, or the like) to be part of the finally-formed abrasive article and the mixture can be deposited onto the article. According to one embodiment, the electronic assembly may be adhered to the article and the mixture can be deposited over at least a portion or all of the electronic assembly. Further details regarding the placement of the electronic assembly are described herein.

Manufacturing information can be stored on the electronic assembly during or after one or more forming processes. The electronic assembly can include one or more electronic devices that can facilitate the measurement and/or storage of manufacturing data. Such manufacturing data may be helpful for manufacturers to know the manufacturing conditions used to form the abrasive article, and may further be useful in assessing the quality of the abrasive article. According to one embodiment, one or more read, write or erase operations can be conducted with each process. For example, a first process may be conducted in the manufacturing of the abrasive article and a first set of manufacturing information can be written to the electronic device. After completing the first process a read, write, or erase information can be performed. For example, manufacturing information can be read from the electronic device. Alternatively or additionally, a write operation may be conducted to write new manufacturing information to the electronic device. Alternatively or additionally, an erase operation may be conducted to remove all or a portion of the first set of manufacturing information. Thereafter, further processes can be conducted, and each process may include one or more read, write, or erase operations. In a particular embodiment, the electronic device can include partitioned portions. A partitioned portion may include a memory, and certain data may be stored in the memory. In some instances, one or more partitioned portions may be access-restricted to protect data from being read or edited by personnel who does not have the access. For example, manufacturing data may be stored in a partitioned portion for manufacturer use only so that others, such as users or distributors, may not make changes to the manufacturing data. In another instance, restriction of access to data stored in a partitioned portion may be changed to allow the data to be read or updated by personnel who is restricted from accessing the data previously.

In an alternative embodiment, the process of combining the at least one electronic assembly with the abrasive body precursor can include depositing the electronic assembly on a portion of a solidified green body. As disclosed herein, a green body can be an object that will undergo further processing. The process of depositing the electronic assembly on at least a portion of a green body can include attaching at least a portion of the electronic assembly to an exterior surface of the green body. In such instances, the electronic assembly is processed with the green body through one or more processes to form the finally-formed abrasive article. Various processes for depositing the electronic assembly on at least a portion of the green body can be used. For example, the electronic assembly can be bonded to a portion of the green body, such as the exterior surface of the green body. A bonding agent may be used, such as by an adhesive. In another embodiment, the electronic assembly can be fastened to at least a portion of the green body by one or more various types of fasteners. In still another embodiment, a portion of the electronic assembly can be pressed into a portion of the green body to facilitate attachment, such that a portion of the electronic assembly is embedded within the body of the green body.

In yet another embodiment, the abrasive body precursor can include an unfinished abrasive body that is a portion of a finally formed body. In an example, a portion of an abrasive body can be formed first, and in some instances, may undergo a further treatment during the process of forming a finally formed abrasive body. In another instance, the abrasive body precursor may include a portion of a finally formed body and a green body of another portion. In still another instance, the abrasive body precursor may include a portion of a finally formed body and a material or material precursor for forming another portion of the finally formed body. In a further embodiment, an electronic assembly can be disposed over a portion of the abrasive body precursor, a material for forming another portion of the finally formed body can be applied to the abrasive body precursor and the electronic assembly. The electronic assembly can be coupled to the abrasive body after further treatment for forming the finally formed abrasive body.

After combining the at least one electronic assembly with the abrasive body precursor at step 102, the process can continue at step 103 by forming the abrasive body precursor into an abrasive body. Various suitable processes for forming the abrasive body precursor into an abrasive body can include, but is not limited to, curing, heating, sintering, firing, cooling, molding, pressing, or any combination thereof. It will be appreciated that in such instances, the electronic assembly can survive and function after one or more forming processes used to form the finally-formed abrasive article. Such forming processes may be used on a mixture or a solidified green body.

According to one embodiment, the forming process can include heating of the body to a forming temperature. The forming temperature can affect a transformation of one or more components in the mixture to form the finally-formed abrasive article. For example, the forming temperature can be at least 25° C., such as at least 40° C. or at least 60° C. or at least 80° C. or at least 100° C. or at least 150° C. or at least 200° C. or at least 300° C. or at least 400° C. or at least 500° C. or at least 600° C. or at least 700° C. or at least 800° C. or at least 900° C. or at least 1000° C. or at least 1100° C. or at least 1200° C. or at least 1300° C. Still, in one non-limiting embodiment, the forming temperature can be not greater than 1500° C. or not greater than 1400° C. or not greater than 1300° C. or not greater than 1200° C. or not greater than 1100° C. or not greater than 1000° C. or not greater than 900° C. or not greater than 800° C. or no greater than 700° C. or not greater than 600° C. or not greater than 500° C. or not greater than 400° C. or not greater than 300° C. or not greater than 200° C. or not greater than 100° C. or not greater than 80° C. or not greater than 60° C. It will be appreciated that the forming temperature can be within a range including any of the minimum and maximum values noted above.

In another embodiment, the forming process can include curing the electronic assembly. For instance, the electronic assembly can include a material or a material precursor that can undergo a curing process. Curing the electronic assembly can include curing of the material or material precursor. In another instance, curing of the electronic assembly can be conducted by heating, irradiation, chemical reactions, or any other means known in the art. In another instance, the forming process can include heating to cure the electronic assembly, heating to cure the abrasive body precursor, or heating to cure both. Curing of the abrasive body precursor can include curing of a precursor material of the abrasive body precursor. In an aspect, curing the electronic assembly or the abrasive body can facilitate coupling of the electronic assembly to the abrasive body, and particularly, curing can facilitate directly coupling the electronic assembly to the finally formed abrasive body in a tamper-proof manner. As used herein, the term, tamper-proof, is intended to mean that the manner of coupling may not allow the electronic assembly to be removed or extracted from the abrasive article without damaging the abrasive article. In a particular example, curing the electronic assembly and curing the abrasive body precursor can take place in the same heating process. In another particular embodiment, heating the electronic assembly and abrasive body precursor can allow the electronic assembly and abrasive body precursor to co-cure. In yet another embodiment, curing the electronic assembly and curing the abrasive body precursor can occur at the same heating temperature. In yet another instance, the abrasive body can be finally formed by co-curing the abrasive body precursor and the electronic assembly.

In another embodiment, the forming process can include heating the electronic assembly and heating at least a portion of the abrasive body precursor. Heating can be conducted at a temperature at that the abrasive body precursor and/or the electronic assembly can cure. Particularly, heating can be performed at the temperature that can allow both the abrasive body precursor and the electronic assembly to cure. In an aspect, co-curing the electronic assembly and the abrasive body can be performed at a temperature that can facilitate improved coupling of the electronic assembly to the abrasive body and formation of the abrasive article. For instance, co-curing the electronic assembly and the abrasive body precursor can be performed at a temperature of at least 90° C., at least 95° C., at least 100° C., at least 105° C., at least 108° C., at least 110° C., at least 115° C., at least 120° C., at least 130° C., at least 140° C., at least 150° C., at least 155° C., at least 160° C., at least 165° C., at least 170° C., at least 175° C., at least 180° C., at least 190° C., at least 200° C., at least 210° C., at least 220° C., at least 230° C., at least 240, ° C., or at least 250° C. In another instance, co-curing the abrasive body precursor and the electronic assembly may be performed at a temperature of not greater than 250° C., not greater than 245° C., not greater than 240° C., not greater than 235° C., not greater than 230° C., not greater than 220° C., not greater than 215° C., not greater than 210° C., not greater than 200° C., not greater than 195° C., not greater than 185° C., not greater than 180° C., or not greater than 170° C., not greater than 165° C., not greater than 160° C., not greater than 155° C., not greater than 150° C., not greater than 145° C., not greater than 140° C., not greater than 135° C., not greater than 130° C., not greater than 125° C., or not greater than 120° C. Moreover, co-curing the abrasive body precursor and the electronic assembly can be performed at a temperature including any of the minimum and maximum values noted herein. For instance, co-curing may be performed at a temperature in a range including at least 90° C. and not greater than 250° C., such as in a range including at least 120° C. and not greater than 140° C., or in a range including at least 150° C. and not greater than 190° C.

In a further aspect, co-curing the abrasive body precursor and the electronic assembly can be performed for a certain period of time to facilitate improved coupling of the electronic assembly to the abrasive body and formation of the abrasive article. For instance, co-curing can be performed for at least 0.5 hours, at least 1 hour, at least 2 hours, at least 3 hours, at least 4 hours, at least 5 hours, at least 6 hours, at least 7 hours, at least 8 hours, at least 10 hours, at least 12 hours, at least 15 hours, at least 18 hours, at least 20 hours, at least 30 hours, at least 26 hours, at least 28 hours, at least 30 hours, at least 32 hours, at least 35 hours, or at least 36 hours. In another instance, co-curing may be performed for not greater than 38 hours, not greater than 36 hours, not greater than 32 hours, not greater than 30 hours, not greater than 28 hours, not greater than 25 hours, not greater than 21 hours, not greater than 18 hours, not greater than 16 hours, not greater than 14 hours, not greater than 12 hours, not greater than 10 hours, not greater than 8 hours, not greater than 7 hours, not greater than 6 hours, not greater than 5 hours, not greater than 4 hours, not greater than 3 hours, or not greater than 2 hours. Moreover, co-curing the abrasive body precursor and the electronic assembly can be performed for a period of time including any of the minimum and maximum values noted herein. For instance, co-curing may be performed for a period of time in a range including at least 0.5 hours and not greater than 38 hours, such as in a range including at least 4 hours and not greater than 10 hours, or in a range including at least 20 hours and not greater than 32 hours.

After reading this disclosure, a skilled artisan would understand that conditions for co-curing the abrasive body precursor and the electronic assembly can be determined, taking into consideration factors that can affect temperatures at that the abrasive body precursor and the electronic assembly cure, such as the nature of the precursor materials to be cured, to suit particular implementations.

Figure 1B:
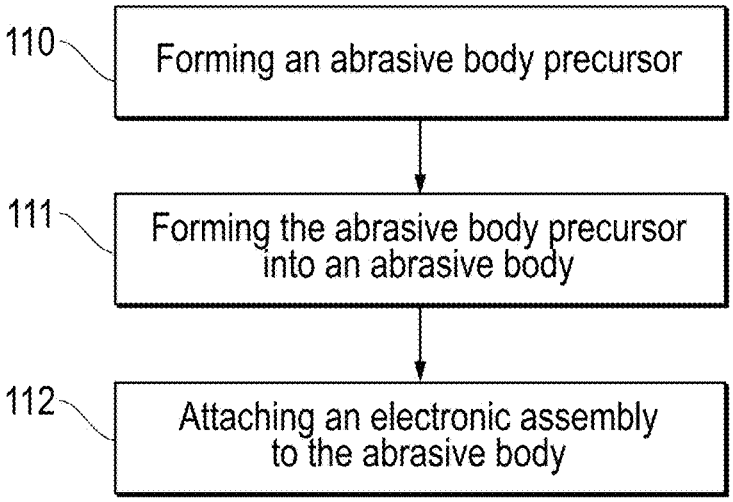
FIG. 1B includes a flow chart for forming an abrasive article according to an embodiment.

FIG. 1B includes a flow chart for forming an abrasive article according to an embodiment. As illustrated in FIG. 1B, the process can be initiated at step 110 forming an abrasive body precursor. The abrasive body precursor can be formed using any of the processes described in embodiments herein. The abrasive body precursor can include any of the features of abrasive body precursors as described in embodiments herein. The process of forming the abrasive body precursor can include forming a mixture as described in embodiments herein.

After forming the abrasive body precursor at step 110, the process can continue at step 111 by forming the abrasive body precursor into a finally-formed abrasive body. Suitable forming processes can include those described in embodiments herein, including for example, but not limited to, curing, heating, sintering, firing, cooling, pressing, molding or any combination thereof. According to one embodiment, the process of forming the abrasive body precursor into a finally-formed abrasive body can include heating the abrasive body precursor to a forming temperature as described in embodiments herein.

After forming the abrasive body precursor into a finally-formed abrasive body at step 111, the process can continue at step 112 by attaching an electronic assembly to the abrasive body, wherein the electronic assembly comprises at least one electronic device. The process of attaching can include adhering, chemical bonding, sinter-bonding, brazing, puncturing, fastening, connecting, heating, pressing, curing, or any combination thereof. Moreover, it will be appreciated that the method of attaching may determine the placement, orientation and exposure of the electronic assembly. For example, at least a portion of the electronic assembly can be attached and exposed at an exterior surface of the body of the abrasive article. In one embodiment, at least a portion of the electronic assembly can be embedded within the body of the abrasive article and another portion of the electronic assembly can be exposed and protruding from the exterior surface of the body of the abrasive article.

In an embodiment, attaching an electronic assembly to the abrasive body can include disposing the electronic assembly over a surface of the abrasive body. In a particular embodiment, the electronic assembly can be disposed on an exterior surface of the abrasive body. An example of an exterior surface can include a major surface or a peripheral surface the abrasive body. In a particular instance, the electronic assembly may be disposed on an exterior surface that is not a grinding surface of the abrasive body to reduce the likelihood of being damaged during a material removal operation. In another particular instance, the exterior surface can include a major surface of the abrasive body, such as a major surface of a grinding wheel or a major surface of a cut-off wheel. In yet another particular instance, the exterior surface can be the surface of an inner circumferential wall of the abrasive body with a central opening.

In an embodiment, attaching an electronic assembly to the abrasive body can include heating the electronic assembly. Heating can be performed at a temperature that can facilitate improved bonding of the electronic assembly to the abrasive body. For instance, heating can be performed at a temperature such that a portion of the electronic assembly can reach its glass transition temperature and adhere to the abrasive body in the subsequent cooling step. In another embodiment, the attaching can include heating the abrasive body and the electronic assembly such that a portion of the abrasive body and a portion of the electronic assembly can reach their respective glass transition temperature and bonding of the abrasive body and the electronic assembly can be formed during subsequent cooling.

In another embodiment, attaching an electronic assembly to the abrasive body can include pressing the electronic assembly at an elevated temperature to facilitate improved coupling of the electronic assembly to the abrasive body. The elevated temperature can include a temperature higher than room temperature (i.e., 20° C. to 25° C.). In a particular example, the elevated temperature can include a glass transition temperature of a material forming a portion of the electronic assembly, a glass transition temperature of the bond material, or both. In another particular instance, pressing the electronic assembly can be performed at a temperature of at least 90° C., such as at least 100, at least 110° C., at least 120° C., at least 125° C., at least 130° C., at least 150° C., at least 150° C., or at least 160° C. Alternatively or additionally, pressing the electronic assembly may be performed at a temperature of not greater than 180° C., not greater than 175° C., not greater than 170° C., not greater than 165° C., not greater than 160° C., not greater than 155° C., not greater than 150° C., not greater than 145° C., not greater than 140° C., not greater than 130° C., or not greater than 125° C. Moreover, pressing the electronic assembly may be performed at a temperature in a range including any of the minimum and maximum values noted herein. For example, pressing the electronic assembly may be performed at a temperature in a range from at least 90° C. to not greater than 180° C.

In a further example, pressing the electronic assembly can be performed for a certain period of time to facilitate improved coupling of the electronic assembly to the bonded body and formation of the abrasive article, such as at least 10 seconds, at least 30 seconds, at least 1 minute, at least 2 minutes, at least 5 minutes, at least 10 minutes, at least 15 minutes, at least 20 minutes, at least 25 minutes, or at least 30 minutes. Alternatively or additionally, pressing the electronic assembly may be performed for not greater than 35 minutes, not greater than 30 minutes, not greater than 25 minutes, or not greater than 20 minutes. Moreover, pressing the electronic assembly may be performed for a time period in a range including any of the minimum and maximum values noted herein. For example, pressing the electronic assembly may be performed for at least 10 seconds to not greater than 35 minutes.

In a further example, pressing the electronic assembly can be performed at a certain pressure to facilitate attaching the electronic assembly to the bonded body and formation of the abrasive article, such as at least 0.3 bars, at least 1 bar, at least 3 bars, at least 5 bars, at least 10 bars, at least 15 bars, at least 20 bars, at least 25 bars, at least 30 bars, at least 35 bars, at least 40 bars, at least 45 bars or at least 50 bars, at least 60 bars, at least 65 bars, at least 70 bars, at least 75 bars, at least 80 bars, at least 85 bars, at least 90 bars, at least 100 bars, at least 120 bars, at least 130 bars, at least 135 bars, at least 140 bars, at least 150 bars, at least 160 bars, at least 170 bars, or at least 180 bars. Alternatively or additionally, the pressure may be at most 200 bars, at most 190 bars, at most 180 bars, at most 170 bars, at most 160 bars, at most 150 bars, at most 140 bars, at most 130 bars, at most 120 bars, at most 110 bars, at most 100 bars, at most 90 bars, at most 80 bars, at most 70 bars, at most 60 bars, or at most 50 bars. Moreover, pressing can be operated at the pressure in a range including any of the minimum and maximum values noted herein. For example, pressing can be performed at a pressure in a range including at least 10 bars and at most 200 bars.

In a particular example, attaching an electronic assembly to the abrasive body can include subjecting the electronic assembly and at least a portion of the abrasive body to an autoclaving operation. In a particular instance, autoclaving can be performed to attach a plurality of the electronic assemblies to the abrasive body. In an aspect, the autoclaving operation can include applying a pressure to the electronic assembly, such as a pressure of at least 2 bars, at least 5 bars, at least 8 bars, at least 10 bars, at least 12 bars, at least 13 bars, at least 15 bars or at least 16 bars. Alternatively or additionally, the pressure may be at most 16 bars, at most 13 bars, at most 11 bars, at most 10 bars, at most 9 bars, at most 7 bars, at most 5 bars, at most 3 bars or at most 2 bars. Moreover, autoclaving can be operated at the pressure including any of the minimum and maximum values noted herein. For instance, autoclaving pressure can be in a range including at least 0.3 bars and at most 16 bars.

The autoclaving operation can also include heating the electronic assembly at a temperature of at least 90° C., such as at least at least 100, at least 110° C., at least 120° C., at least 125° C., at least 130° C., at least 150° C., at least 150° C., or at least 160° C. Alternatively or additionally, the heating temperature for performing autoclaving may be not greater than 160° C., not greater than 155° C., not greater than 150° C., not greater than 145° C., not greater than 140° C., not greater than 130° C., not greater than 125° C., or not greater than 120° C. Moreover, autoclaving can be operated at a temperature including any of the minimum and maximum values noted herein. Autoclaving can be operated for a certain period of time to facilitate coupling the electronic assembly to the abrasive body, such as for at least 10 minutes to not greater than 30 minutes.

In another embodiment, attaching an electronic assembly to the abrasive body can include applying a bonding material over at least a portion of the abrasive assembly, at least a portion of an exterior surface of the abrasive body, or both. The bonding material can include a polymer, an inorganic material, a cement material, or any combination thereof. A particular example of the bonding material can include a cement material. The cement material can be hydraulic or non-hydraulic. A further example of a cement material can include an oxide, a silicate, such as calcium-based silicate, aluminium-based silicate, magnesium-based silicate, or any combination thereof. Another exemplary of the bonding material can include an adhesive, and in some particular instance, the adhesive can include epoxy. In a further embodiment, attaching an electronic assembly to the abrasive body can include curing the bonding material to form the abrasive article including the abrasive body coupled to the electronic assembly. In some instances, curing may be performed at a temperature of at least 15° C., and additionally or alternatively, curing may be performed at a temperature of not greater than 40° C., such as not greater than 35° C. or not greater than 30° C. or not greater than 25° C. Particularly, curing the cement material may be performed at a temperature from 20° C. to 40° C., such as at room temperature.

In an embodiment, the electronic assembly can be coupled to and in direct contact with at least a portion of the abrasive body. In some particular instances, the electronic assembly can bond to a portion of the abrasive body. For instance, the electronic assembly can bond to a component of the abrasive body, such as the bond material, the abrasive particles, an additive, or any combination thereof. In particular embodiments, the electronic assembly can be coupled to the abrasive body in a tamper-proof manner.

Figure 2A:
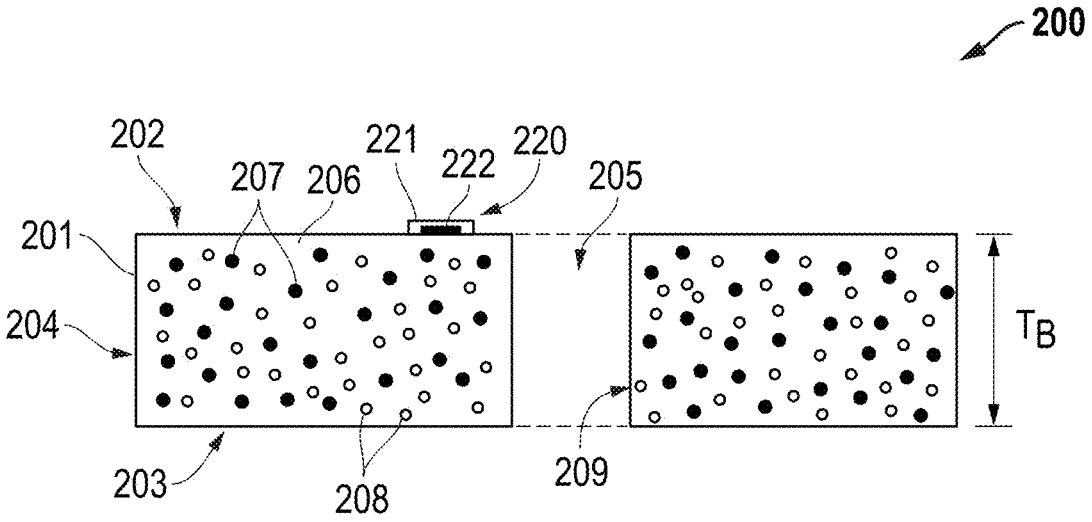
FIG. 2A includes a cross-sectional illustration of a portion of an abrasive article according to an embodiment.
Figure 2B:
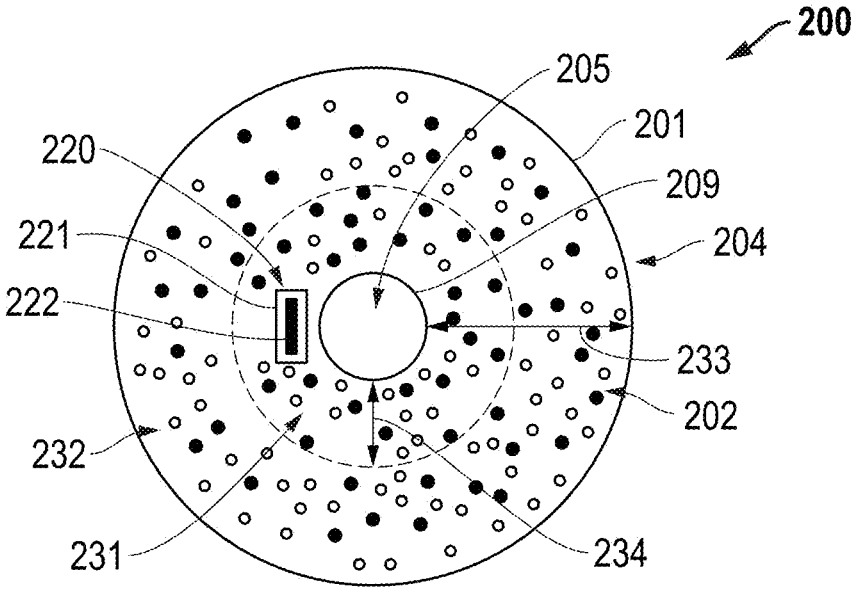
FIG. 2B includes a top-down illustration of the abrasive article of FIG. 2A according to an embodiment.

FIG. 2A includes a cross-sectional illustration of a portion of an abrasive article according to an embodiment. FIG. 2B includes a top-down illustration of the abrasive article of FIG. 2A according to an embodiment.

As illustrated in FIGS. 2A and 2B, the abrasive article 200 include a bonded abrasive including a body 201, a first major surface 202, a second major surface 203 and a side or a peripheral surface extending between the first major surface 202 and second major surface 203. The body 201 can further include abrasive particles 207 contained in a bond material 206. The body 201 can further include optional porosity 208 that may be distributed throughout the body 201. The abrasive particles 207 can have any of the features of abrasive particles described in any of the embodiments herein.

In accordance with an embodiment, the bond material 206 can be an inorganic material, organic material, or any combination thereof. For example, suitable inorganic materials can include a metal, a metal alloy, a vitreous material, a monocrystalline material, a polycrystalline material, a glass, a ceramic, or any combination thereof. Suitable examples of organic materials can include, but is not limited to, thermoplastic materials, thermosets, elastomers, or any combination thereof. In a particular embodiment, the bond material 206 can include a resin, epoxy, or any combination thereof.

In accordance with an embodiment, the bond material 206 may have a particular forming temperature that is the same as the forming temperatures used to form the abrasive body as described in embodiments herein. For example, the bond material 206 may have a forming temperature of at least 25° C., such as at least 40° C. or at least 60° C. or at least 80° C. or at least 100° C. or at least 150° C. or at least 200° C. or at least 300° C. or at least 400° C. or at least 500° C. or at least 600° C. or at least 700° C. or at least 800° C. or at least 900° C. or at least 1000° C. or at least 1100° C. or at least 1200° C. or at least 1300° C. Still, in one non-limiting embodiment, the forming temperature can be not greater than 1500° C. or not greater than 1400° C. or not greater than 1300° C. or not greater than 1200° C. or not greater than 1100° C. or not greater than 1000° C. or not greater than 900° C. or not greater than 800° C. or no greater than 700° C. or not greater than 600° C. or not greater than 500° C. or not greater than 400° C. or not greater than 300° C. or not greater than 200° C. or not greater than 100° C. or not greater than 80° C. or not greater than 60° C. It will be appreciated that the forming temperature of the bond material 206 can be within a range including any of the minimum and maximum values noted above.

As noted herein, the body 201 can include porosity 208 contained within the body. For example, the body 201 may include closed prosody, open porosity, or any combination thereof. Closed pores are generally discrete and separate pores contained within the bond material 206. In contrast, open porosity can define interconnected channels extending through the body 201. In one particular embodiment, the abrasive body may have a content of porosity 208 within a range of at least 0.5 vol % to not greater than 95 vol % for a total volume of the body 201.

According to one embodiment, the abrasive article 200 can include an electronic assembly 220 attached to an exterior surface of the body 201, such as the first major surface 202. In one embodiment, the electronic assembly 220 can include at least one electronic device 222 that may be contained within a package 221. The package 221 may be suitable for attaching the electronic assembly 220 to the body 201, and may provide some suitable protection of the one or more electronic devices contained therein. In particular examples, the electronic device 222 can be encapsulated within the package 221.

According to one embodiment, the electronic device 222 can be configured to be written-to with information, store information, or provide information to other objects during a read operation. Such information may be relevant to the manufacturing of the abrasive article, operation of the abrasive article or conditions encountered by the electronic assembly 220. Reference herein to the electronic device will be understood to be reference to at least one electronic device, which can include one or more electronic devices. In at least one embodiment, the electronic device 222 can include at least one device selected from the group including an integrated circuit and chip, data transponder, a radio frequency based tag or sensor with or without chip, an electronic tag, electronic memory, a sensor, an analog to digital converter, a transmitter, a receiver, a transceiver, a modulator circuit, a multiplexer, an antenna, a near-field communication device, a power source, a display (e.g., LCD or OLED screen), optical devices (e.g., LEDs), global positioning system (GPS) or device, or any combination thereof. In some instances, the electronic device may optionally include a substrate, a power source, or both. In one particular embodiment, the electronic device 222 can include a tag, such as a passive radio frequency identification (RFID) tag. In another embodiment, the electronic device 222 can include an active radio frequency identification (RFID) tag. An active RFID tag can include a power supply, such as a batter or inductive capacitive (LC) tank circuit. In a further embodiment, the electronic device 222 can be wired or wireless.

According to one aspect, the electronic device 222 can include a sensor. The sensor may be selectively operated by any system and/or individual within the supply chain. For example, the sensor can be configured to sense one or more processing conditions during the formation of the abrasive article. In another embodiment, the sensor may be configured to sense a condition during use of the abrasive article. In yet another embodiment, the sensor can be configured to sense a condition in the environment of the abrasive article. The sensor can include an acoustic sensor (e.g., ultrasound sensor), force sensor, vibration sensor, temperature sensor, moisture sensor, pressure sensor, gas sensor, timer, accelerometer, gyroscope, or any combination thereof. The sensor can be configured to alert any system and/or individual associated with the abrasive article, such as a manufacturer and/or customer to a particular condition sensed by the sensor. The sensor may be configured to generate an alarm signal to one or more systems and/or individuals in the supply chain, including but not limited to, manufacturers, distributors, customers, users, or any combination thereof.

In another embodiment, the electronic device 222 may include a near-field communication device. A near field communication device can be any device capable of transmitting information via electromagnetic radiation within a certain defined radius of the device, typically less than 20 meters. The near-field communication device can be coupled to one or more electronic devices, including for example a sensor. In one particular embodiment, a sensor can be coupled to the near-field communication device and configured to relay information to one or systems and/or individuals in the supply chain via the near-field communication device.

In an alternative embodiment, the electronic device 222 can include a transceiver. A transceiver can be a device that can receive information and/or transmit information. Unlike passive RFID tags or passive near-field communication devices, which are generally read-only devices that store information for a read operation, a transceiver can actively transmit information without having to conduct an active read operation. Moreover, the transceiver may be capable of transmitting information over various select frequencies, which may improve the communication capabilities of the electronic assembly with a variety of systems and/or individuals in the supply chain.

In another embodiment, the electronic assembly 220 can include a flexible electronic device. For instance, the electronic device can have a certain bend radius, such as not greater than 13 times the thickness of the electronic device, not greater than 12 times the thickness of the electronic device, not greater than 10 times the thickness of the electronic device, not greater than 9 times the thickness of the electronic device, not greater than 8 times the thickness of the electronic device, not greater than 7 times the thickness of the electronic device, not greater than 6 times the thickness of the electronic device, not greater than 5 times the thickness of the electronic device. Alternatively or additionally, the electronic device can have a bend radius at least half the thickness of the electronic device, or at least the thickness the electronic device. It is to be understood the flexible electronic device can have a bend radius within a range including any of the minimum and maximum values noted herein. As used herein, bend radius is measured to the inside curvature and is the minimum radius that the electronic device can be bent without being damaged. In an embodiment, bend radius may be affected by the structure of the flexible electronics. For example, a single-layered flexible electronic device may have a bending radius not greater than 5 times its thickness, while a flexible electronic device having a plurality of layers may have bending radius not greater than 12 times its thickness.

In an aspect, the flexible electronic device can include a substrate, wherein the substrate can include a flexible material. In another aspect, the flexible electronic device can include a flexible substrate. For instance, the substrate can include an organic material, such as a polymer. In another example, the substrate can include a flexible conductive material, such as conductive polyester. In a particular example, the substrate can consist essentially of an organic material, and in more particular examples, the substrate can consist essentially of a polymer. A particular example of a polymer can include a plastic material. A more particular example of the substrate can include polyester (e.g., PET), polyimide, polyether ether ketone (PEEK), polyimide-fluoropolymer, or the like. Another example of the substrate can include a Pyralux® material. In some even more particular examples, the substrate can consist essentially of at least one of the materials noted herein. In another embodiment, the substrate can include a flexible thin silicon layer or monocrystalline silicon.

In a further example, the substrate can include at least one layer. In a further aspect, the flexible electronic device can include a printed circuit. In another aspect, the electronic device can include a plurality of layers. In a particular aspect, the flexible electronic device can include a substrate that consists essentially of one layer. In a more particular aspect, the flexible electronic device can be a singled-layered electronic device.

In a particular embodiment, the flexible electronic device can have a thickness of not greater than 1 mm, such as not greater than 0.80 mm, not greater than 0.60 mm, not greater than 0.50 mm, not greater than 0.40 mm, not greater than 0.30 mm, not greater than 0.20 mm, not greater than 0.15 mm, or not greater than 0.12 mm, or not greater than 0.10 mm. Alternatively or additionally, the flexible electronic device can have a thickness of at least 0.06 mm, such as at least 0.08 mm, at least 0.10 mm, at least 0.12 mm, at least 0.15 mm, or at least 0.20 mm. Moreover, the flexible electronic device can have a thickness including any of the minimum and maximum values noted herein.

In an embodiment, the electronic assembly 220 can include a flexible printed circuit. In an example, the flexible printed circuit can be contained within the package 221, as illustrated in FIGS. 2A and 2B. In particular instances, the flexible printed circuit can be encapsulated in the package. The flexible electronic device, such as flexible printed circuit (FPC), disclosed in embodiments herein is considered distinct from printed circuit board (PCB) at least due to architecture characteristics. Such characteristics can allow particular placement and orientation to be implemented for coupling the electronic assembly to the abrasive body. For instance, such characteristics can allow the electronic assembly to be coupled in tamper-proof manner.

In an embodiment, a flexible electronic device described in embodiments herein may be particularly suited for abrasive articles including coated abrasives, non-woven abrasives, thin wheels, or the like. In some situations, coupling a single-layered flexible electronics to a coated or non-woven abrasive may not cause detectable or noticeable changes to thickness, flexibility, or other performance of the abrasive. In certain situations, utilizing a flexible electronics can help to prevent issues, such as imbalance of wheels, that can be caused by uneven weight distribution due to coupling of an electronic assembly to the wheels.

In an embodiment, the electronic device can have a certain communication range while the electronic assembly is coupled to the abrasive body. As used herein, the communication range can be determined using the near field or far field method as applicable and according to ISO/IEC 18000 (125 Khz-5.8 Ghz), or related standards such as ISO/IEC 15693, ISO/IEC 14443, EPC Global Gen2, or ISO/IEC 24753. The applicable standard is selected based on the radio frequency of the electronic device. An abrasive article can be placed in a 3-axis turntable, and a transmitting or receiving antenna can be arranged such that communication ranges in different orientations can be tested.

In an embodiment, the electronic device can have a communication range of at least 1.0 meter, at least 1.5 meters, at least 2.0 meters, at least 2.5 meters, at least 3.0 meters, at least 3.5 meters, at least 4.0 meters, at least 4.5 meters, at least 5.0 meters, at least 5.5 meters, at least 6.0 meters, at least 6.5 meters, at least 7.0 meters, at least 7.5 meters, at least 8.0 meters, at least 8.5 meters, at least 9.0 meters, at least 9.5 meters, at least 10 meters, at least 11 meters, at least 12 meters, at least 13 meters, at least 14 meters, at least 15 meters, at least 16 meters, at least 17 meters, at least 18 meters, at least 19 meters, or at least 20 meters. Additionally or alternatively, the electronic device may have a communication range of not greater than 20 meters, not greater than 19 meters, not greater than 18 meters, not greater than 17 meters, not greater than 16 meters, not greater than 15 meters, not greater than 14 meters, not greater than 13 meters, not greater than 12 meters, not greater than 11 meters, not greater than 10 meters, not greater than 9.0 meters, not greater than 8.5 meters, not greater than 8.0 meters, not greater than 7.5 meters, not greater than 7.0 meters, not greater than 6.5 meters, not greater than 6.0 meters, not greater than 5.5 meters, not greater than 5.0 meters, not greater than 4.5 meters, not greater than 4.0 meters, not greater than 3.5 meters, not greater than 3.0 meters, not greater than 2.5 meters, or not greater than 2.0 meters. Moreover, the communication range of the electronic device can be in a range including any of the minimum and maximum values noted herein.

In another embodiment, the abrasive article can include certain electronic devices, such as an active RFID, that have higher communication ranges. In some instances, the communication range can be at least 100 meters, at least 200 meters, at least 400 meters, at least 500 meters, or at least 700 meters. In another instance, the communication range may be not greater than 1000 meters, such as not greater than 800 meters, or not greater than 700 meters. It is to be understood that the communication range can be in a range including any of the minimum and maximum values noted herein.

In another embodiment, the abrasive article can include an electronic device having a communication range of not greater than 35 mm, not greater than 30 mm, or not greater than 25 mm. Additionally or alternatively, the electronic device can have a communication range of at least 10 mm, at least 15 mm, at least 20 mm, or at least 25 mm. Moreover, the communication range of the electronic device can be in a range including any of the minimum and maximum values noted herein. After reading the present disclosure, a skilled artisan would understand that the communication range can be affected by factors, such as the nature of the electronic device, the configuration and materials of the electronic assembly, the manner of coupling, the composition and type of the abrasive article, or any combination thereof. A skilled artisan would also understand that the choice for any or all factors can be made and combined for forming an abrasive article that can suit particular applications.

According to one embodiment, the package 221 can include a thermal barrier material. For example a thermal barrier material can include material from the group of materials including, but not limited to, thermoplastic polymers (e.g., polycarbonates, polyacrylates, polyamides, polyimides, polysulphones, polyketones, polybenzimidizoles, polyesters), blends of thermoplastic polymers, thermoset polymers (e.g., epoxies, cyanoesters, phenol formaldehyde, polyurethanes, polyamides, polyimides, cross-linkable unsaturated polyesters) blends of thermoset polymers, ceramics, cermets, metals, metal alloys, glass, or any combination thereof. In accordance with one particular embodiment, the package 221 can include a thermal barrier material suitable for surviving one or more processes, including the forming temperature used to form the finally form abrasive article.

In accordance with another embodiment, thermal barrier material of the package 221 can have a particular thermal conductivity which may be suitable for protecting the one or more electronic devices contained therein. For example the thermal barrier package may have a thermal conductivity of at least 0.33 W/m/K, such as at least about 0.40 W/m/K, such as at least 0.50 W/m/K or at least 1 W/m/K or at least 2 W/m/K or at least 5 W/m/K or at least 10 W/m/K or at least 20 W/m/K or at least 50 W/m/K or at least 80 W/m/K or at least 100 W/m/K or at least 120 W/m/K or at least 150 W/m/K or at least 180 W/m/K. In still another non-limiting embodiment, the thermal barrier material can have a thermal conductivity that is not greater than 200 W/m/K, such as not greater than 180 W/m/K or not greater than 150 W/m/K or not greater than 120 W/m/K or not greater than 100 W/m/K or not greater than 80 W/m/K or not greater than 60 W/m/K or not greater than 40 W/m/K or not and 20 W/m/K or not greater than 10 W/m/K. It will be appreciated that the thermal barrier material can have a thermal conductivity within a range including any of the minimum and maximum values noted above, including for example within a range of at least 0.33 W/m/K to not greater than 200 W/m/K.

According to one embodiment, the package 221 can include a thermal barrier material that encapsulates some volume of space between the thermal barrier material and the electronic device contained therein. In one embodiment, the volume of space may include a particular gaseous material that may be suitable for survival of the electronic device through one or more manufacturing processes and/or improved performance of the electronic assembly. Some suitable examples of the gaseous materials can include noble gases, nitrogen, air, oxygen, or any combination thereof.

In another embodiment, the volume of space may have a particular pressure that may facilitate survival of the electronic device during one or more manufacturing processes and/or improved performance of the electronic assembly. For example, in one embodiment, the pressure within the electronic assembly can be less than atmospheric pressure. In still another embodiment, the pressure within the electronic assembly can be greater than atmospheric pressure. In still another embodiment, at least a portion of the volume of space can be filled with a liquid material, which may facilitate survival of the electronic device during one or more manufacturing operations and/or improved performance of the electronic assembly. The gaseous material or liquid material may have particularly suitable thermal conductivity to limit thermal damage to the electronic device.

In yet another aspect the package 221 can include one or more materials having a particular water vapor transmission rate to reduce or eliminate water and water vapor being transferred from the exterior of the package 222 the interior. Such a package may be suitable to reduce or eliminate damage to the one or more electronic devices 222 contained within the electronic assembly 220. In accordance with an embodiment, the package 221 can include a material having a water vapor transmission rate. In an embodiment, the barrier layer can prevent or reduce water vapor transmission into the bonded abrasive body, compared to a conventional abrasive tool. In a non-limiting embodiment, the package 221 and/or one or more materials comprising the package 221, can have a water vapor transmission rate (WVTR), as measured according to ASTM F1249-01 (Standard Test Method for Water Vapor Transmission Rate Through Plastic Film and Sheeting Using a Modulated Infrared Sensor), of not greater than about 2.0 $g/m^2$-day (i.e., grams per square meter, per 24 hours), such as not greater than about 1.5 $g/m^2$-day, such as not greater than about 1 $g/m^2$-day or not greater than about 0.1 $g/m^2$-day or not greater than about 0.015 $g/m^2$-day or not greater than about 0.010 $g/m^2$-day or not greater than about 0.005 $g/m^2$-day or not greater than about 0.001 $g/m^2$-day or even not greater than about 0.0005 $g/m^2$-day. In another non-limiting embodiment, the WVTR of the one or more materials of the package 2221, and thus the package 221, can be greater than 0 $g/m^2$-day, such as at least 0.00001 $g/m^2$-day. It will be appreciated that the WVTR can be within a range including any of the minimum and maximum values noted herein. For instance, the WVTR may be within a range including greater than 0 g/m$^2$-day and not greater than 2.0 g/m$^2$-day, such as within a range including at least 0.00001 g/m$^2$-day and not greater than 2.0 g/m$^2$-day.

In another aspect, the electronic device 222 may be configured to transmit information via one or more electromagnetic radiation wavelengths. Accordingly, the package to 221 can be substantially transparent or transmissive to the frequencies or wavelengths of electromagnetic radiation used by the electronic device 222 to receive and/or transmit information. For example, the package 221 can include one or more materials that are transparent to electromagnetic radiation in the radio frequency spectrum, such as electromagnetic radiation having a frequency of 3 kHz to 300 GHz and an approximate wavelength within a range of 1 mm to 100 km. Some suitable examples of such materials can include non-metallic materials, such as glasses, ceramic, thermoplastics, elastomers, thermosets, and the like.

As noted in embodiments herein, the electronic device 222 can be configured to communicate with one or more systems and/or individuals. In particular instances, the electronic device 222 can be configured to communicate with a mobile device. A mobile device will be understood as an electronic device intended for personal use and configured to be carried on or used by an individual.

In accordance with one embodiment, the electronic device 222 can include a read-only device. In an alternative embodiment, the electronic device 222 can be a read-write device. It will be understood that a read-only device is a device that can store information, which can be read by a system and/or individual in an active read operation. An active read operation includes any action by a system and/or individual to access the information stored on the electronic device 222. A read-only device cannot be written to in an active write operation to store information. By contrast a read-write device can be an electronic device wherein information can be read from the device in an active read operation or information can be stored to the electronic device by one or more systems and/or individuals in an active writing operation. Some suitable examples of information that can be stored on the electronic device 222 can include manufacturing information and/or customer information. According to one embodiment, manufacturing information can include, but is not limited to, processing information, manufacturing date, shipment information, or any combination thereof. In accordance with another embodiment, customer information can include, but is not limited to, registration information, product identification information, product cost information, manufacturing date, shipment date, environmental information, use information, or any combination thereof. The customer registration information may include certain information such as an account number of the customer. Environmental information may include details regarding the age or general information about the conditions encountered by the abrasive article (e.g., water vapor, temperature, etc.) during shipment, storage or use. Use information can include details regarding the conditions for use of the wheel, including for example, but not limited to the appropriate wheel speed, force, power of the machine to be used, burst speed, and the like.

In a further embodiment, the package 221 can include a protective layer that can help the electronic device survive one or more forming process, environmental conditions, or grinding operations, or facilitate bonding of the electronic assembly to the abrasive body. For instance, the protective layer may facilitate improved resistance against moisture or humidity of the electronic assembly. In another instance, the protective layer can facilitate improved mechanical integrity, resistance against certain pressure or chemical corrosion, or improved electrical insulation, or improved thermal resistance in some instances. In an aspect, the protective layer can overlie at least a portion of the electronic device. In an aspect, the protective layer can be in contact with the electronic device. In a further aspect, the protective layer may be spaced apart from the abrasive body. In another embodiment, the protective layer can be in contact with at least a portion of the abrasive body. In still another embodiment, the protective layer can encapsulate the electronic device.

Figure 2C:
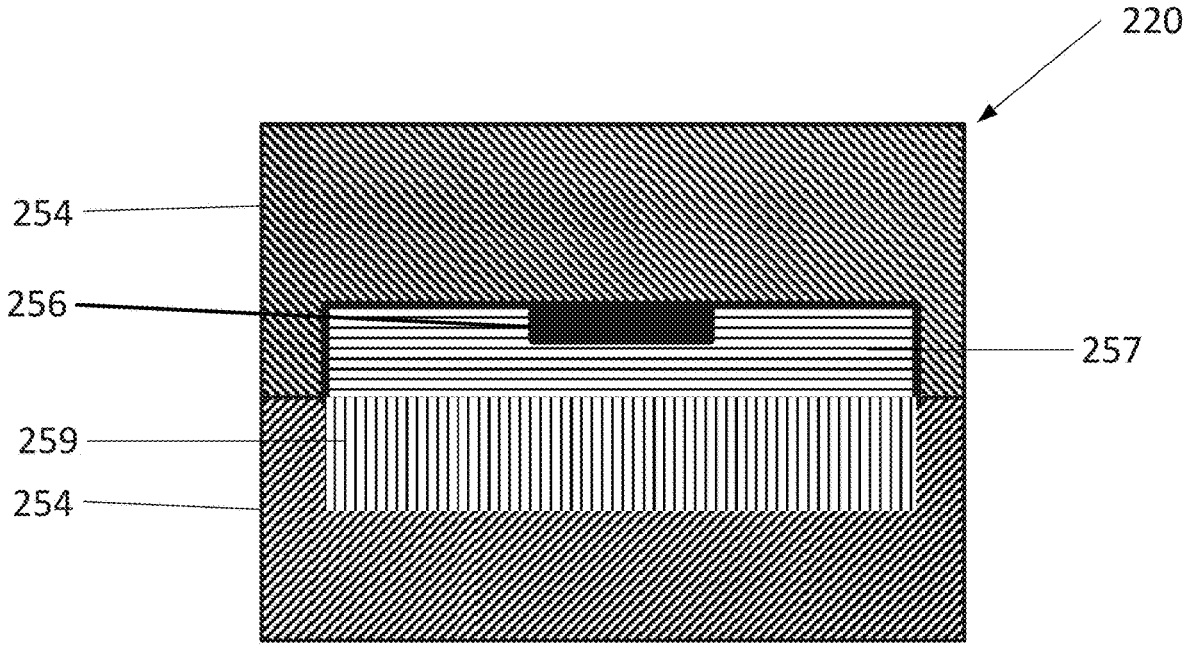
FIG. 2C includes a cross-sectional illustration of a portion of an electronic assembly according to an embodiment.
Figure 2D:
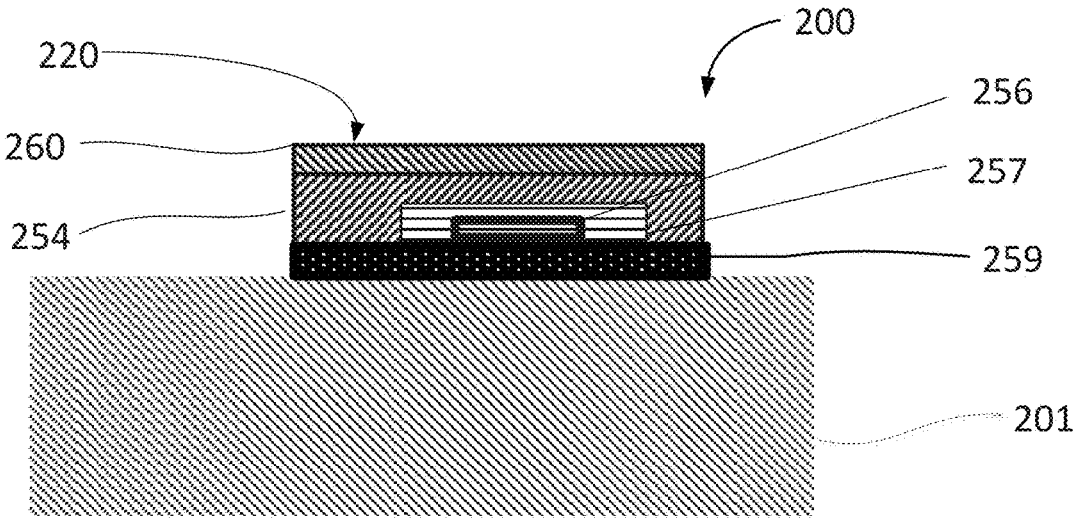
FIG. 2D includes a cross-sectional illustration of a portion of an abrasive article according to an embodiment.

Referring to FIG. 2C, a cross-section of an exemplary electronic assembly 220 is illustrated. The electronic assembly 220 includes a protective layer 254 overlying and in contact with an outer surface of the electronic devices 256 and 257 that are disposed on a substrate 259. As illustrated, the upper and side surfaces of the electronic device 257 can be covered by the protective layer 254, and only the upper surface of the electronic device 256 is covered by the protective layer 254. In an embodiment, the electronic device 257 can include a transducer, and the electronic device 256 can include a radio frequency based tag. An example of the transducer can include a transmitter, a receiver, an antenna, or the like. It is to be understood that the electronic devices 256 and 257 can include any electronic devices noted in embodiments herein. As illustrated, the protective layer 254 underlies and in contact with an outer surface of the substrate 259. In some instances, the substrate can serve as a protective layer or facilitate bonding of the electronic assembly to an abrasive body to obviate the use of a protective layer that is disposed underlying the substrate. In another instance, the electronic device 257 can be in direct contact with an abrasive body and a substrate or a protection layer may not be needed between the abrasive body and the electronic device 257. In another instance, the protective layer may be disposed to underlie the electronic device, and an upper surface and side surfaces of the electronic device 257 or 256 may not be covered by the protective layer. In a further embodiment, the electronic assembly 220 can include an extra protection layer that is disposed over and/or under the protective layer 254 for additional protection. As illustrated in FIG. 2D, another example of the abrasive article 200 can include an abrasive body 201 and an electronic assembly 220 including an additional layer 260 overlying the protective layer 254. The electronic assembly 220 further includes an electronic device 256 and 257 that are disposed on a substrate 259. As illustrated, the protective layer 254 can be disposed to cover the exposed upper surface of the substrate 259 and the exterior surface of the electronic device 256. The extra layer 260 can be an additional protective layer including a same material as or a different material than the protective layer 254.

In an embodiment, a protective layer can include an organic material, an inorganic material, or any combination thereof. In some instances, a protective layer can include parylene, silicone, acrylic, an epoxy based resin, ceramics, metal, such as an alloy (e.g., stainless steel), polycarbonate (PC), polyvinyl chloride (PVC), polyimide, polyvinyl butyral (PVB), polyurethane (PU), polytetrafluoroethylene (PTFE), a high performance polymer, such as polyester, polyurethane, polypropylene, polyimides, polysulfone (PSU), polyethersulfone (PES), polyetherimide (PEI), poly (phenylene sulfide) (PPS), polyetheretherketone (PEEK), polyether ketones (PEK), aromatic polymers, poly(p-phenylene), ethylene propylene rubber and/or cross-linked polyethylene, or a fluoropolymer such as PTFE. In some instances, the protective layer can include the same metal as an antenna contained in the electronic assembly. In some examples, the protective layer can be in the form of a coating, such as a polymer coating, e.g., epoxy-based resin coating, a ceramic coating, or a ceramic coated layer. In another instance, the protective layer may be in the form of a tape, such as a Teflon® tape, a PET tape, or a polyimide film with an adhesive on one side, such as Kapton® tape.

In some instances, the protective layer can include at least one opening to allow a sensing element to be exposed for the sensing element to perform its function, such as sensing environmental conditions the abrasive article is exposed to, e.g., temperature or humidity.

In a further embodiment, the protective layer can include a hydrophobic layer to help to protect the electronic device from potential damage caused by certain fluid, such as coolant or slurries used in some operations. An exemplary hydrophobic layer can include a material including manganese oxide polystyrene ($MnO_2$/PS) nano-composite, zinc oxide polystyrene (ZnO/PS) nano-composite, calcium carbonate (e.g., precipitated calcium carbonate), carbon nanotubes, silica nano-coating, fluorinated silanes, fluoropolymer, or any combination thereof. In an exemplary forming process, a hydrophobic layer can be formed by preparing and applying a gel-based or aerosol based solutions including any of the materials noted herein to the electronic device or over a protection layer.

In a further embodiment, the protective layer can include an autoclavable material that can help the electronic assembly survive an autoclave operation and facilitate bonding of the electronic assembly to the abrasive body. In some instances, the autoclavable material can also facilitate improved environmental resistance and electrical integrity of the electronic assembly. An exemplary material can include poly vinyl butyral (PVB), polycarbonate (PC), acoustic PVB, thermal control PVB, ethylene vinyl acetate (EVA), thermoplastic polyurethane (TPU), ionomer, a thermoplastic material, polybutylene terephthalate (PBT), polyethylenevinylacetate (PET), polyethylene naphthalate (PEN), polyvinyl chloride (PVC), polyvinyl fluorides (PVf), polyacrylate (PA), polymethyl methacrylate (PMMA), polyurethane (PUR), or combinations thereof.

In an embodiment, the package can include any of the protection layer, thermal barrier, pressure barrier, as noted in embodiments herein, or any combination thereof. Any of the component layer of the package can be formed by extrusion, printing, spraying on, coating or the like. The package including a plurality of layers can be formed by adhesion, lamination, coating, printing, or the like. In particular embodiments, treatment, such as heating, curing, pressing, or any combination thereof, can be performed to form a component layer or the package. For instance, a precursor material may be used and cured to form a protection layer.

In an embodiment, the electronic assembly can be coupled to the abrasive body. In some instances, the coupling to the abrasive body can be direct or indirect. In particular instances, the electronic assembly can be coupled to the abrasive body in a tamper-proof manner. In accordance with another embodiment, as illustrated in FIG. 2A or 2B, the electronic assembly 220 can be in direct contact with the body 201, and in some particular instances, the electronic assembly 220 can be bonded directly to an exterior surface of the body 201, such as the first major surface 202 of the body 201. In more particular instances, the electronic assembly 220 can be positioned within an interior circumferential region 231 of the abrasive body 201. For example as illustrated in FIG. 2B, the body 201 can have an interior circumferential region 231 and an outer circumferential region 232. The interior circumferential region 231 and outer circumferential region 232 can be separate, coaxial regions of the abrasive body as viewed top down. According to one embodiment, the outer circumferential region 232 can include the sidewall 204 defining the outer perimeter of the body 201. The body 201 can have a width 233 defined by the radial distance between the sidewall 204 and wall of the central opening (i.e., arbor hole) 205. The interior circumferential region 231 can be spaced apart from the sidewall 204 and define an interior region of the body 201. More particularly, the interior circumferential region 231 can extend radially outward from the central opening 205 for a distance of approximately half of the width 233 or less. As illustrated, in FIG. 2B, the interior circumferential region 231 is that region between the dotted line and the wall defining the central opening 205. The interior circumferential region 231 may include a portion of the body 201 that is unlikely to be used by a customer and material removal operation.

Embodiments herein include various ways to attach the electronic assembly 220 can be coupled to the body 201 of the abrasive article. For example, the electronic assembly 220 can be bonded directly to an exterior surface of the abrasive body 201, such as the first major surface 202. It will be appreciated that the electronic assembly 220 can be bonded directly to other surfaces of the body 201, including for example, a portion of the second major surface 203.

Figure 2E:
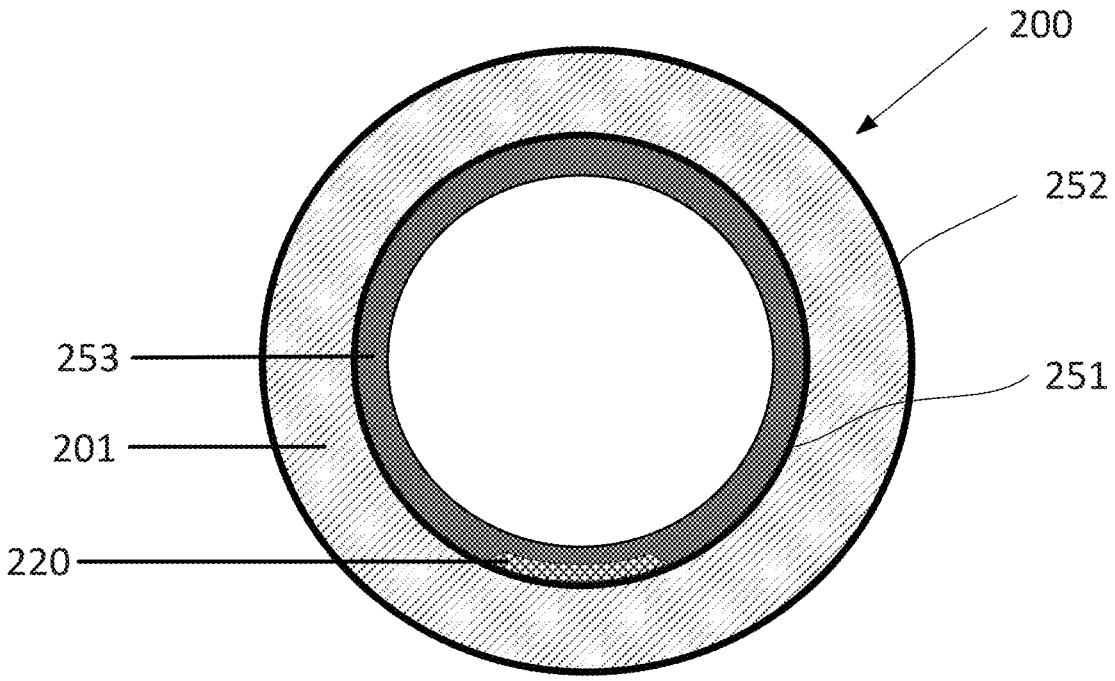
FIG. 2E includes a top-down illustration of a portion of an abrasive article according to an embodiment.

FIG. 2E includes an illustration of a top view of another example of the abrasive article 200 including the abrasive body 201 having an inner circumferential wall 251 and an outer circumferential wall 252. In the illustrated particular implementation, the electronic assembly 220 is disposed on the surface of the inner circumferential wall 251. A bonding agent can be applied over at least a portion of the electronic assembly 220 and at least a portion of the surface of the inner circumferential wall 251. An exemplary bonding agent can include a cement material, an organic material, a bond material, or the like. Curing of the bonding agent can allow the electronic assembly to bond to the abrasive body. In a particular embodiment, the bonding agent can include a cement material, and in more particular instances, the cement material can cure at room temperature In a particular example, the bonding agent can form a layer 253 on the surface of the inner circumferential wall 251, and more particularly the layer 253 can cover substantially the entire surface of the inner circumferential wall. As illustrated, the electronic assembly 220 can be fully embedded in the layer 253. In an embodiment, a portion of the electronic assembly 220 can be embedded in the layer 253, and a portion of the electronic assembly 220 can be exposed to the environment. Exposing a portion of the electronic assembly may be helpful for the electronic device to perform its function, such as detecting operation or storage conditions of the abrasive article. In a further embodiment, a portion of the electronic assembly 220 can be above the surface of the layer 253. In an embodiment, the abrasive article can include a bonded abrasive article, such as a grinding wheel. In a more particular instance, the abrasive body of the abrasive article 200 can include a vitreous material, a ceramic material, a glass, a metal, an oxide, or any combination thereof.

Figure 3A:
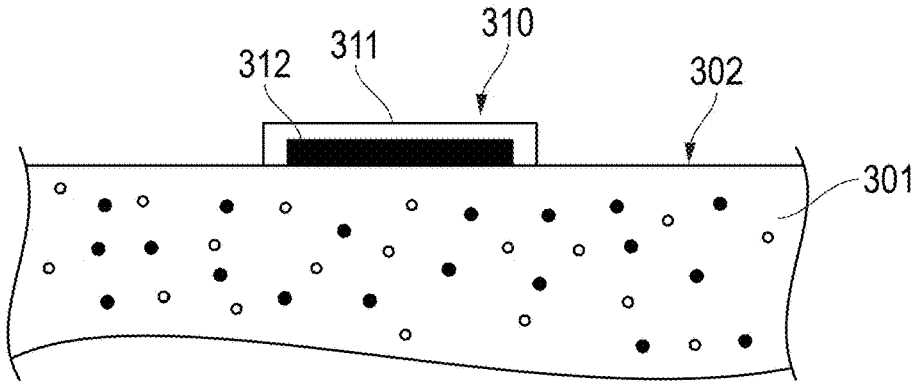
FIG. 3A includes a cross-sectional illustration of a portion of an abrasive article according to an embodiment.

FIG. 3A includes a cross-sectional view of a portion of an abrasive article in accordance with an embodiment. In a more particular embodiment, the abrasive article includes a bonded abrasive including a body 301, an exterior surface 302, and an electronic assembly 310 attached to the exterior surface 302 of the body 301. As illustrated and according to one embodiment, the electronic assembly 310 can include a package 311 and at least one electronic device 312 contained within the package 311. As further illustrated in FIG. 3A, the package 311 can extend around approximately three surfaces of the at least one electronic device 312. However as illustrated and in accordance with one particular embodiment, at least a portion of the electronic device 312 can be in direct contact with the exterior surface 302 of the body 301. Furthermore, at least a portion of the package 311 may be in direct contact with the exterior surface 302 of the body 301. In one embodiment, the entirety of the electronic assembly 310 can be positioned on the exterior surface 302 of the body 301. In such instances, essentially no part of the electronic assembly 310 including the package 311 and at least one electronic device 312 are positioned below the exterior surface 302 or embedded within a portion of the body 301.

In an embodiment, a non-abrasive portion can be disposed over at least a portion of the exterior surface 302 and at least a portion of the electronic assembly 301. For instance, the non-abrasive portion can form an outer surface of the finally formed abrasive article, covering at least a portion of the electronic assembly and at least a portion of the abrasive body. In another instance, the non-abrasive portion can cover the exposed exterior surface 302 and the exposed exterior surface of the electronic assembly 310 entirely. In a further instance, the non-abrasive portion may be in direct contact with at least a portion of the electronic assembly 310 and at least a portion of the exterior surface 302. An example of the non-abrasive portion can include a material including a fabric, a fiber, a film, a woven material, a non-woven material, a glass, a fiberglass, a ceramic, a polymer, a resin, a polymer, a fluorinated polymer, an epoxy resin, a polyester resin, a polyurethane, a polyester, a rubber, a polyimide, a polybenzimidazole, an aromatic polyamide, a modified phenolic resin, paper, or any combination thereof.

In an exemplary forming process, the non-abrasive portion may be applied overlying at least a portion of the electronic assembly and at least a portion of the abrasive body, the combination of which can undergo a further treatment for forming the finally formed abrasive body. The further treatment can include any treatment noted in the embodiments herein, such as heating, pressing, curing, or any commination thereof. In a particular example of the forming process, a non-abrasive portion may be placed directly on the electronic assembly, wherein the electronic assembly is disposed on a portion of an exterior surface in an interior circumferential region of the abrasive body. The non-abrasive portion may cover the entire interior circumferential region. The non-abrasive portion can be pressed against the electronic assembly and the body at an elevated temperature to form the finally formed abrasive body, wherein the non-abrasive portion can be attached to the electronic assembly and the bonded abrasive body, and the electronic assembly can bond to the abrasive body.

In some instances, the electronic assembly can be disposed on the surface of the abrasive body precursor, and the non-abrasive portion can be disposed covering the electronic assembly and at least a portion of the surface of the abrasive body precursor. Heat can be applied to allow curing of the electronic assembly, the abrasive body precursor, or both to realize bonding between the electronic assembly and the abrasive body and attachment of the non-abrasive portion to the abrasive body. In an example, the non-abrasive portion can be directly attached to at least a portion of the exterior surface of the bonded abrasive body, a portion of the electronic assembly, or both.

In a particular embodiment, the non-abrasive portion can include a reinforcement component, a layer of fabric, a layer including a woven or non-woven material, a layer including fiber, blotter paper, or the like, or any combination thereof. In another particular embodiment, the abrasive body can be a bonded body of a grinding wheel, a thin wheel, such as a cut-off wheel, a combination wheel, or an ultra thin wheel. In more particular embodiments, the bonded body can include an organic bond material, and in even more particular embodiments, the bond material can consist essentially of an organic material. In a particular example of a thin wheel, the bonded body can include in the body, at least one abrasive portion and at least one non-abrasive portion that can be the same as or different from the non-abrasive portion attached to the surface of the bonded body. An example of the non-abrasive portion in the abrasive body can include a reinforcement component.

Figure 3B:
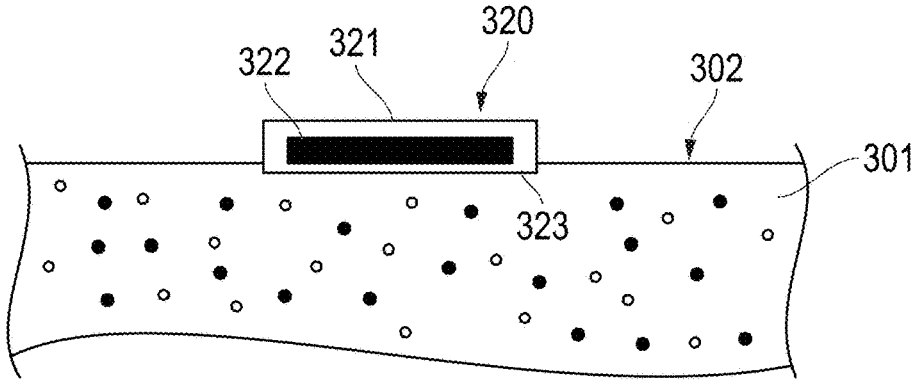
FIG. 3B includes a cross-sectional illustration of a portion of an abrasive article according to an embodiment.

FIG. 3B includes a cross-sectional illustration of a portion of an abrasive article in accordance with an embodiment. In particular FIG. 3B includes a bonded abrasive having a body 301 including an exterior surface 302 and an electronic assembly 320 coupled to the exterior surface 302 of the body 301. In the embodiment as illustrated FIG. 3B, the electronic assembly 320 can include a package 321 and at least one electronic device 322 contained within the package 321. As further illustrated in FIG. 3B, and in accordance with an embodiment, at least a portion of the electronic assembly 320 can be contained within the body 301 and extending below the exterior surface 302 of the body 301. In more particular instances, a portion of the package 321 can be extending below the exterior surface 302 and embedded within the body 301. As illustrated in FIG. 3B, a portion of the package 323 below the electronic device 322 can extend into the body 301 and below the exterior surface 302 of the body 301. In certain instances, essentially all of the at least one electronic device 322 can be encompassed within the package 321 and contained above the exterior surface 302 of the body 301. For example, in the illustrated embodiment of FIG. 3B essentially none of the electronic device 322 is in contact with the body 301 and is contained entirely within the package 321.

Figure 3C:
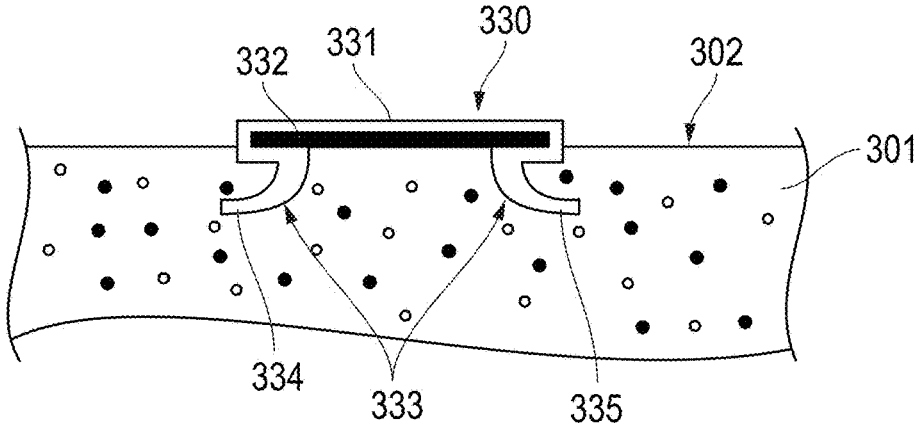
FIG. 3C includes a cross-sectional illustration of a portion of an abrasive article according to an embodiment.

FIG. 3C includes a cross-sectional illustration of a portion of an abrasive article according to one embodiment. As illustrated the abrasive article can include a body 301 including exterior surface 302, and an electronic assembly 330 coupled to the body 301. More particularly, the electronic assembly 330 can include a package 331 configured to contain at least a portion of at least one electronic device 332 therein. In accordance with one embodiment, the electronic assembly 330 can include an embedded portion 333, which can include a first embedded portion 334 and a second embedded portion 335. It will be understood that an embedded portion can include a single portion or multiple different portions. The first and second embedded portions 334 and 335 may be configured to extend into the interior volume of the body 301, below the exterior surface 302 of the body 301. In one particular embodiment, the first embedded portion 334 and the second embedded portion 335 can be bonded directly to the bond material of the body 301. The embedded portion 333, and particularly, the first and second embedded portions 334 and 335, can be extensions of the packaging 331 extending into the body 301 below the exterior surface 302. The first and second embedded portions 334 and 335 may have a size and shape suitable to facilitate a strong attachment between the electronic assembly 330 and the body 301. For example, as illustrated in FIG. 3C, the first and second embedded portions 334 and 335 may be curved tabs that extend away from each other in opposite directions to facilitate a rigid and permanent attachment of the electronic assembly 330 with the body 301. It will be appreciated that other shapes, sizes and orientations of one or more embedded portions may be used to facilitate attachment between the electronic assembly 330 and the body 301.

In accordance with an embodiment, the embedded portion 333 may have a particular size relative to the total volume of the electronic assembly that facilitates suitable engagement with the body 301. For example the embedded portion 333 can be at least 1% of the total volume of the electronic assembly, such as at least 5% or at least 10% or at least 15% or at least 20% or at least 30% or at least 40% or at least 50% or at least 60% or at least 70% or at least 80% or even at least 90% of the total volume of electronic assembly 330. Still, in another non-limiting embodiment, the embedded portion 333 can have a particular size such as not greater than 95% of the total volume of electronic assembly, such as not greater than 90%, or not greater than 80% or not greater than 70% or not greater than 60% or not greater than 50% or not greater than 40% or not greater than 30% or not greater than 20% or not greater than 10% or not greater than 5% of the total volume of the electronic assembly. It will be appreciated that the embedded portion 333 can have a size relative to the volume of electronic assembly 330 that is within a range including any of the minimum and maximum percentages noted above. Furthermore, will be appreciated that alternative size and shaped embedded portions may be utilized to facilitate suitable attachment of electronic assembly 330 in the body 301.

As further illustrated in the embodiment of FIG. 3C at least a portion of the electronic device 332 can be in direct contact with the body 301, and more particularly, may be in direct contact with the exterior surface 302 of the body 301. However, in other embodiments, the electronic device 332 can be contained entirely within the package 331 and the embedded portions 333 can extend into the body 301 from the package 331.

In accordance with another embodiment, a certain amount of the electronic assembly 330 can be contained within the interior volume of the body 301 below the exterior surface 302 of the body 301. For example, at least 1% of the total volume of electronic assembly 330 can be contained within the interior volume of the abrasive body 301, such as at least 5% or at least 10% or at least 15% or at least 20% or at least 30% or at least 40% or at least 50% or at least 60% or at least 70% or at least 80% or at least 90%. Still, and another non-limiting embodiment, not greater than 99% of the electronic assembly can be contained within the interior volume of the body 301 below the exterior surface 302, such as not greater than 95% or not greater than 90% or not greater than 80% or not greater than 70% or not greater than 60% or not greater than 50% or not greater than 40% or not greater than 30% or not greater than 20% or not greater than 10% or not greater than 5%. It will be appreciated that the total volume of electronic assembly 330 contained within an interior volume of the abrasive body 301 can be within the range between any of the minimum and maximum percentages noted above. It will be appreciated that utilization of a certain volume of electronic summary 330 contained within the interior volume of the body 301 may be suitable to limit tampering with the electronic device 332 and or electronic assembly 330.

Figure 3D:
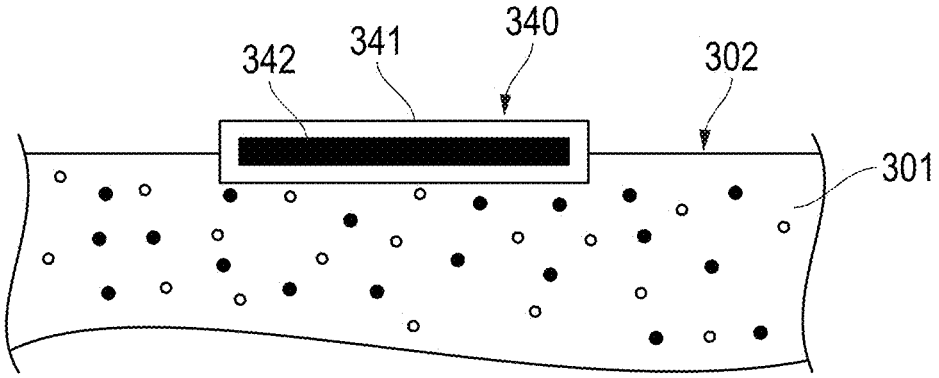
FIG. 3D includes a cross-sectional illustration of a portion of an abrasive article according to an embodiment.

FIG. 3D includes a cross-sectional view of a portion of an abrasive article according to an embodiment. As illustrated, the abrasive article can include a body 301 including an exterior surface 302 and an abrasive assembly 340 coupled to a portion of the body 301. The electronic assembly 340 can include electronic device 342 contained within a package 341. As further illustrated, at least a portion, and approximately half of the electronic assembly, can be contained within the interior of the body 301 below the exterior surface 302. Furthermore as illustrated in FIG. 3D and in accordance with an embodiment, approximately half of the electronic assembly 340 can be contained above the exterior surface 302 of the body 301.

Figure 3E:
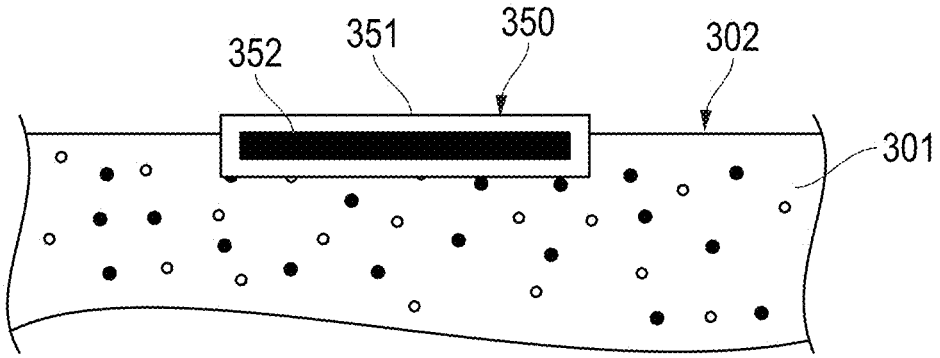
FIG. 3E includes a cross-sectional illustration of a portion of an abrasive article according to an embodiment.

FIG. 3E includes a cross-sectional illustration of a portion of an abrasive article in accordance with an embodiment. As illustrated, the abrasive article can include a body 301 including an exterior surface 302 and an electronic assembly 350 coupled to the body 301. As illustrated, the electronic assembly 350 can include at least one electronic device 352 and a package 351 configured to contain the at least one electronic device 352 therein. As further illustrated, a majority of the electronic assembly 350 can be embedded in the body 301, such that a majority of the volume of the electronic assembly 350 may be contained under the exterior surface 302 of the body 301. Moreover, according to one embodiment, essentially all of the electronic device 352 may be contained within the interior volume of the body 301, such that essentially all of the electronic device 352 is underlying the exterior surface 302 of the body 301. Still, however, as shown in FIG. 3E, at least a portion of the electronic assembly 350, and particularly an upper surface of the package 351 can be protruding through the exterior surface 302 of the body 301.

Figure 3F:
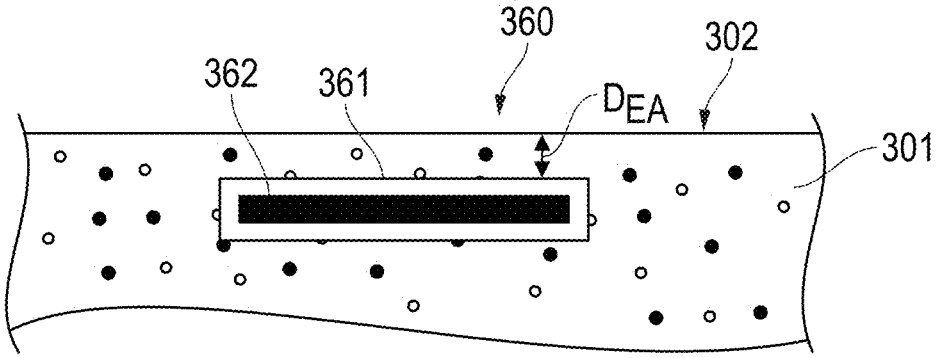
FIG. 3F includes a cross-sectional illustration of a portion of an abrasive article according to an embodiment.

FIG. 3F includes a cross-sectional illustration of a portion of an abrasive article according to an embodiment. As illustrated, the abrasive article can include a body 301, an exterior surface 302, and at least one electronic assembly 360 contained within the body 301. The electronic assembly 360 can include at least one electronic device 362 contained within a package 361. As further illustrated in FIG. 3F, the electronic assembly 360 can be embedded entirely within the volume of the body 301 and spaced apart from the exterior surface 302 of the body 301. In an embodiment, the exterior surface 302 can be a grinding surface that can be in contact with a workpiece in, e.g., a material removal operation. The electronic assembly can be spaced apart from the grinding surface. In an embodiment, the abrasive body 301 can be a bonded abrasive body including a bond material, and the abrasive assembly can be bonded directly to the bond material. In a particular embodiment, the bond material can include any organic material noted in embodiments herein, and in more particular instances, the bond material can consist essentially of the organic material.

In accordance with an embodiment, the electronic assembly 360 can be embedded at a particular depth that is suitable for protecting the electronic assembly 360 while maintaining suitable capabilities to allow information to be sent to and/or received by the electronic device 362. For example, the electronic assembly 360 can be embedded at a depth ($D_{EA}$) of less than 50% of the total thickness of the abrasive body ($T_B$). In other instances, the embedded depth ($D_{EA}$) of electronic assembly 360 can be less, such as not greater than 45% or not greater than 40% or not greater than 35% or not greater than 30% or not greater than 25% or not greater than 20% or not greater than 15% or not greater than 10% or not greater than 5% or not greater than 3% of the total thickness of the abrasive body ($T_B$). Still in one non-limiting embodiment, the electronic assembly 360 can be embedded at a depth ($D_{EA}$) of at least 1% of the total thickness of the abrasive body ($T_B$), such as at least 2% or at least 3% or at least 5% or at least 8% or at least 10% or at least 12% or at least 13% or at least 15% or at least 20% or at least 25% or at least 30% or even at least 40% of the total thickness of the abrasive body ($T_B$). It will be appreciated that the embedded depth ($D_{EA}$) of the electronic assembly 360 can be within a range including any of the minimum and maximum percentages noted above.

Figure 3G:
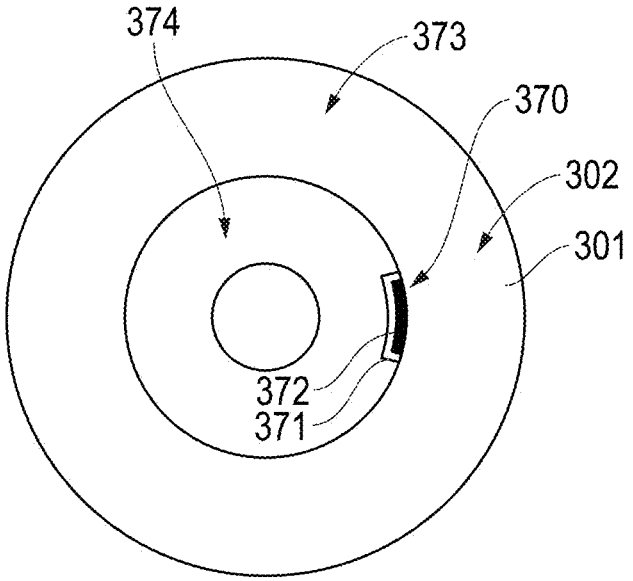
FIG. 3G includes a top-down illustration of a portion of an abrasive article according to an embodiment.

In one alternative embodiment, the body can be made of more than one abrasive portion. FIG. 3G includes a top-down illustration of a portion of an abrasive article according to an embodiment. As illustrated, the abrasive article can include a body 301 having an exterior surface 302, and an electronic assembly 370 contained within a portion of the body 301. More particularly, the body 301 can include an outer abrasive portion 373 and an inner abrasive portion 374 coaxial with each other. In accordance with an embodiment, the outer abrasive portion 373 and inner abrasive portion 374 can have at least one different abrasive characteristic relative to each other, such as, a different type of abrasive particle, different bond material, different structure (i.e., content of bond, abrasive particles and/or porosity), different type of porosity, different filler, or any combination thereof.

According to one particular embodiment, the outer abrasive portion 373 can include a first type of bond material that can be different from the bond material used to form the inner abrasive portion 374. For example, the outer abrasive portion 373 can include a vitrified material and the inner abrasive portion 374 can include an organic material, such as a resin or epoxy material. In such instances, the outer abrasive portion 373 may first be formed into the vitrified bonded abrasive component. After the outer abrasive portion 373, the electronic assembly 370 including the package 371 and electronic device 372 may be attached to the inner circumferential wall of the outer abrasive portion 373. Thereafter, the inner abrasive portion 374 may be formed on the interior of the outer abrasive portion 373 and overlying and/or encompassing the electronic assembly 370.

According to one embodiment, the electronic assembly can be completely encased or encompassed in the material of the inner abrasive portion 374. In another embodiment, the electronic assembly 370 may be partially surrounded by or encased within the material of the inner abrasive portion 374. As illustrated, the electronic assembly 370 can be disposed at an interface of the inner abrasive portion 374 and the outer abrasive portion 373. Such a configuration may facilitate formation of a two component abrasive article. Furthermore, such an arrangement may facilitate recycling of the inner abrasive portion 374 and the electronic assembly after a certain amount or content of the outer abrasive portion 373 is used or spent in a material removal operation. While not illustrated, it will be appreciated that the electronic assembly 370 may be disposed at another location in the inner abrasive portion, including for example, disposed entirely within the inner abrasive portion 374.

Figure 3H:
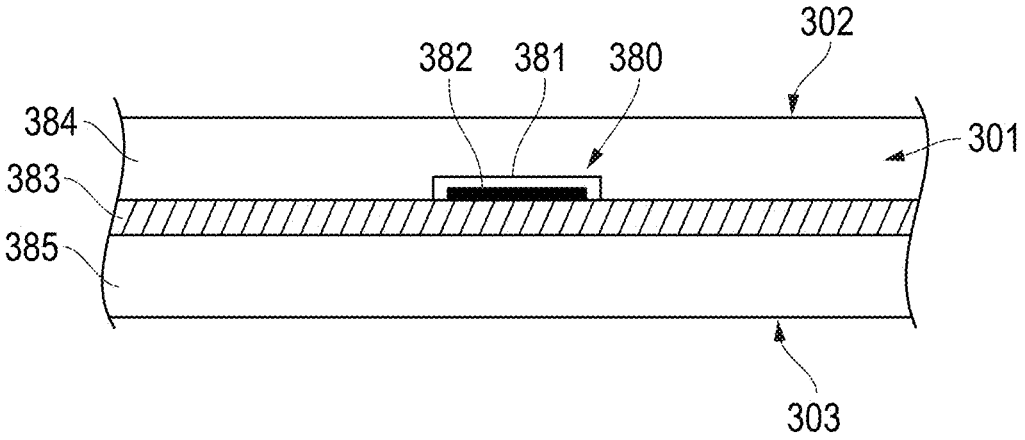
FIG. 3H includes a cross-sectional illustration of a portion of an abrasive article according to an embodiment.

FIG. 3H includes a cross-sectional illustration of a portion of an abrasive article according to one embodiment. As illustrated, the abrasive can include a body 301 including a exterior surface 302 and an exterior surface 303 opposite the exterior surface 302. As further illustrated, the body 301 can include a first abrasive portion 384, a second abrasive portion 385, and a reinforcing member 383 disposed between the first abrasive portion 384 and the second abrasive portion 385. In accordance with an embodiment the electronic assembly 380 can include an electronic device 382 contained within a package 381. The electronic assembly 380 can be coupled to a surface of the reinforcing member 383.

For one embodiment, the first abrasive portion 384 can be generally in the form of a layer and the second abrasive portion 385 may also be in the form of a layer. Regarding the forming process, the electronic assembly 380 may first be coupled to the reinforcing member 383. Thereafter, the first abrasive layer 384 and second abrasive layer 385 may be formed around the reinforcing member 383 and the electronic assembly 380. In another embodiment, the second abrasive layer 385 may be first formed, thereafter the reinforcing member 383 and electronic assembly 380 coupled thereto, may be placed on top of the partially-formed or fully-formed second abrasive layer 385. After coupling the second abrasive layer 385 and the reinforcing member 383 including the electronic assembly 380, the first abrasive layer 384 may be formed overlying the reinforcing member 383 and the electronic assembly 380 to form the finally-formed abrasive article. It will be appreciated that other abrasive articles may utilize one or more reinforcing layers and one or more abrasive layers.

Figure 3I:
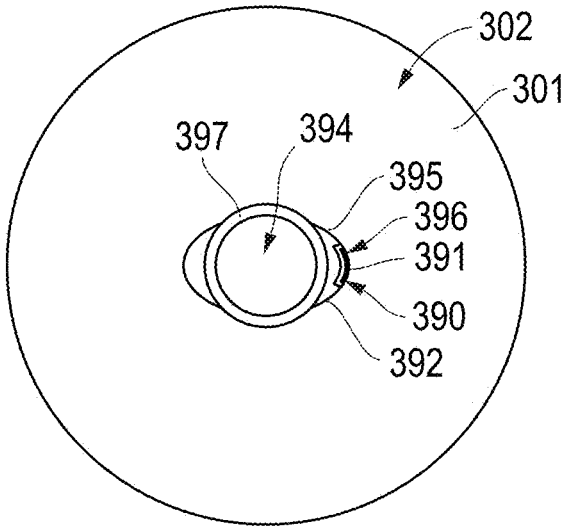
FIG. 3I includes a top-view illustration of an abrasive article according to an embodiment.

FIG. 3I includes a top-view illustration of an abrasive article according to an embodiment. As illustrated, the abrasive article can include an abrasive body 301 having an exterior surface 302 of an abrasive portion. The body 301 can further include a central opening 394 extending axially through the body between major opposing surfaces. The central opening 394 can include a bushing 397 configured to fit in the central opening 394 and facilitate attachment of the body 301 to a spindle for a material removal operation. In one embodiment, the body 301 can further include at least one cavity 395 adjacent to and intersecting the central opening 394. The cavity 395 can have a surface 396 that is defined by at least a portion of the abrasive body 301, such that the surface is at least partially defined by the bond material and/or abrasive particles of the abrasive body 301. At least one electronic assembly 390 including an electronic device 391 contained within a package 392 can be contained within the cavity 395.

In one aspect, the electronic assembly 390 can be releasably coupled to the surface 396 of the cavity 395. For example, the electronic assembly 390 can be bonded to the surface 396 of the cavity 395 by an adhesive that can facilitate removal of the electronic assembly 390 after use of the abrasive article. For one particular embodiment, the adhesive can be changed by one or more external stimuli, such that it facilitates removal of the electronic assembly 390 from the surface 396. An example can include the application of heat to change and/or volatilize a portion of the adhesive to facilitate removal of the electronic assembly 390 from the surface 396. In such instances, the electronic assembly may be recycled for use with another, different abrasive article. According to an alternative embodiment, the electronic assembly 390 can be attached to the surface 396 using one or more fasteners that facilitate removal and recycling of the electronic assembly 390. Other releasable connections as known to those of skill in the art may be utilized. Furthermore, such a releasable connection can be used with any of the other electronic assemblies described in the embodiments herein, particularly those embodiments wherein the electronic assembly is coupled to a surface of a body.

Figure 3J:
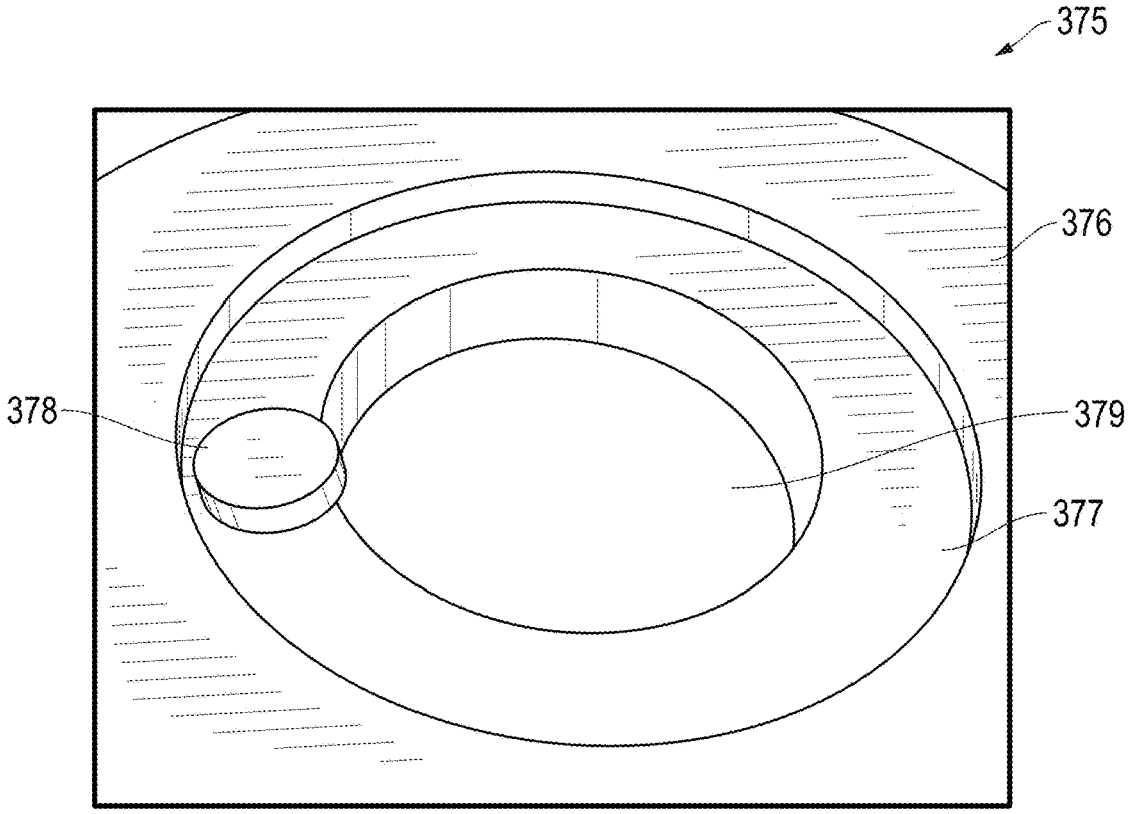
FIG. 3J includes an illustration of an image of a portion of an abrasive body precursor according to an embodiment.
Figure 3K:
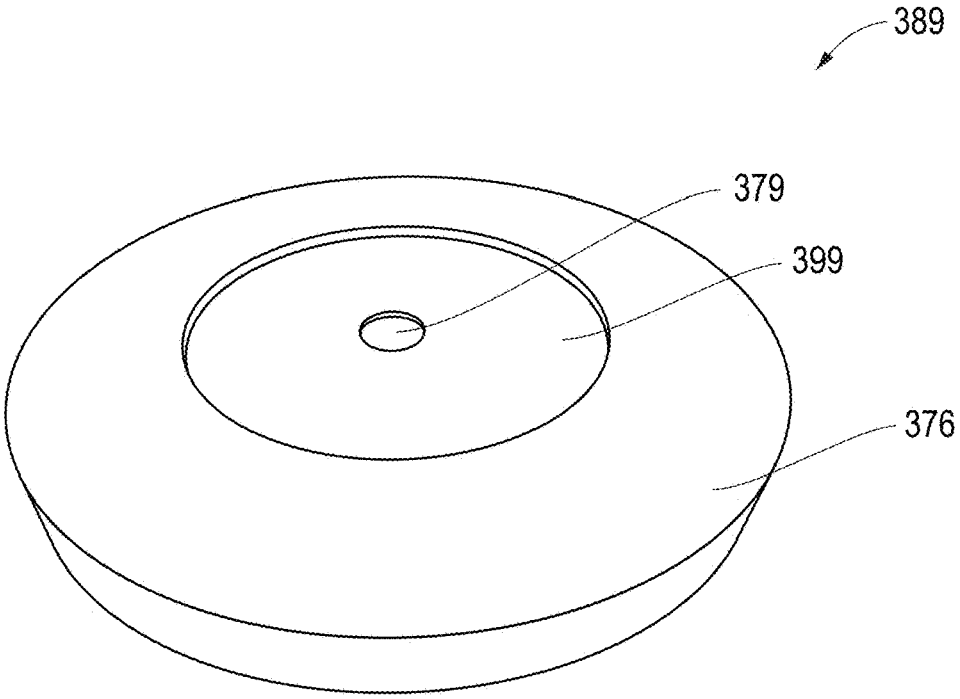
FIG. 3K includes a top-view illustration of a portion of an abrasive article according to an embodiment.

FIGS. 3J and 3K include illustrations of a particular embodiment of forming an abrasive article including an electronic assembly coupled to the abrasive body. FIG. 3J includes a close-up image of an abrasive body precursor 375 including an inner abrasive portion 377, outer abrasive portion 376, and an opening 379 defined by the inner circumferential wall of the body precursor 375. The inner abrasive portion 377 and outer abrasive portion 376 can include any features noted in embodiments with respect to an inner and outer abrasive portion in this disclosure. As demonstrated in FIG. 3J, the inner abrasive portion 377 has a thickness less than the thickness of the outer abrasive portion 376. For example, the thickness of the inner abrasive portion 377 may be not greater than 90% of the thickness of the outer abrasive portion, such as not greater than 80%, not greater than 70%, not greater than 60%, or not greater than 50% of the thickness of the outer abrasive portion 376. Additionally or alternatively, the thickness of the inner abrasive portion 377 can be at least 10% of the thickness of the outer abrasive portion 376, at least 15%, at least 20%, at least 25%, at least 30%, at least 40%, at least 45%, or at least 50% of the second thickness of the outer abrasive portion 376. Moreover, the inner abrasive portion can include a thickness in a range including any of the minimum and maximum percentages noted herein. For instance, the thickness of the inner abrasive portion 377 may be at least 10% and not greater than 90% of the thickness of the outer abrasive portion.

In an embodiment, the abrasive body precursor 375 can be a bonded abrasive body including a bond material including an organic material, an inorganic material, or any combination thereof. In some particular instances, the bond material can include a vitreous material, a ceramic material, glass, metal, an oxide, or any combination thereof, and in more particular examples, the bond material of the abrasive body precursor can consist essentially of vitreous material, a ceramic material, a glass, metal, an oxide, or a combination thereof. In another embodiment, the bond material included in the inner abrasive portion 377 can be the same as the bond material included in the outer abrasive portion 376. More particularly, the inner abrasive portion 377 can include the substantially same composition as the outer abrasive portion 376.

As demonstrated in FIG. 3J, an electronic assembly 378 can be disposed over the surface of the inner abrasive portion 377. In an embodiment, for forming the finally formed abrasive body, a material 399 can be disposed over the surface of the inner abrasive portion 377. The material 399 can be different from or the same as the bond material included in the inner abrasive portion 377. For example, the material 399 can include an organic material, an inorganic material, or any combination thereof, and in a more particular example, the material 399 can consist essentially of an organic material. In another instance, the material 399 can include a bond material including a polymer, a resin, or a combination thereof. A particular example of the material 399 can include epoxy or a cement material. As illustrated in FIG. 3K, the material 399 can fully cover the electronic assembly 378, and the entire surface of the inner abrasive portion 377. In some other instances, the electronic assembly 378 may be partially embedded in the material 399 such that a portion of the electronic assembly 378 may be exposed.

In a further embodiment, a treatment can be applied to the material 399, the electronic assembly 378, and optionally, at least a portion of abrasive body precursor 375 to form the finally formed abrasive article. For example, heating, radiation, a chemical reaction, or any combination thereof can be applied to or take place to allow the material 399 to cure. In some instances, heating may be performed at a temperature to facilitate curing of the material 399. An exemplary temperature for curing the material 399 can be up to 160° C. In another example, heating may facilitate bonding of the electronic assembly 378 to the material 399, to the inner abrasive portion 377, the outer abrasive portion 376, or any combination thereof. In still another example, heating may facilitate bonding of the material 399 to the inner abrasive portion 377, the outer abrasive portion 376, or both.

The finally formed abrasive body 389 can include an inner abrasive portion including a first portion (e.g., formed by the material 399) and a second portion and the electronic assembly embedded in the inner abrasive portion, wherein the first portion and the second portion can include a different composition, including a difference in, such as materials or contents of the materials used to form the first and second portions, or the same composition. In an example, a first portion of the inner abrasive portion can include an organic material, and the second portion may include an organic material, inorganic material, or a combination thereof. In a particular instance, the first portion of the inner abrasive portion can include a bond material that can consist essentially of an organic material, and the second abrasive portion can include a vitreous material, glass, crystalline material, a metal, an oxide, or any combination thereof. In an embodiment, the thickness of the inner abrasive portion can be substantially the same as the outer abrasive portion. In a further embodiment, the electronic assembly 378 can bond to the material of the first portion. In another embodiment, the electronic assembly 378 can be in direct contact with the first portion, the second portion of the inner abrasive portion, or both. In still another embodiment, the electronic assembly 378 can be in direct contact with the outer abrasive portion 376, such as in direct contact with the inner circumferential wall of the outer abrasive portion 377.

FIG. 4 includes a cross-sectional illustration of a coated abrasive article according to an embodiment. As illustrated, the coated abrasive 400 can include a substrate 401 and a make coat 402 overlying a surface of the substrate 401. The coated abrasive 400 can further include one or more types of particulate material 404, which can include abrasive particles (e.g., primary abrasive particles and/or secondary abrasive particles), filler particles, additive particles, or any combination thereof. The coated abrasive 400 may further include size coat 403 overlying and bonded to the particulate material 404 and the make coat 402.

According to one embodiment, the substrate 401 can include an organic material, inorganic material, and a combination thereof. In certain instances, the substrate 401 can include a woven material. However, the substrate 401 may be made of a non-woven material. Particularly suitable substrate materials can include organic materials, including polymers, and particularly, polyester, polyurethane, polypropylene, polyimides such as KAPTON from DuPont, paper or any combination thereof. Some suitable inorganic materials can include metals, metal alloys, and particularly, foils of copper, aluminum, steel, and a combination thereof.

The make coat 402 can be applied to the surface of the substrate 401 in a single process, or alternatively, the particulate material 404 can be combined with a make coat 402 material and the combination of the make coat 402 and particulate material 404 can be applied as a mixture to the surface of the substrate 401. In certain instances, controlled deposition or placement of the particulate material 404 in the make coat 402 may be better suited by separating the processes of applying the make coat 402 from the deposition of the particulate material 404 in the make coat 402. Still, it is contemplated that such processes may be combined. Suitable materials of the make coat 402 can include organic materials, particularly polymeric materials, including for example, polyesters, epoxy resins, polyurethanes, polyamides, polyacrylates, polymethacrylates, polyvinylchlorides, polyethylene, polysiloxane, silicones, cellulose acetates, nitrocellulose, natural rubber, starch, shellac, and mixtures thereof. In one embodiment, the make coat 402 can include a polyester resin. The coated substrate can then be heated in order to cure the resin and the particulate material 404 to the substrate 401. In general, the coated substrate 401 can be heated to a temperature of between about 100° C. to less than about 250° C. during this curing process.

The particulate material 404 can include different types of abrasive particles according to embodiments herein. The different types of abrasive particles can include different types of shaped abrasive particles, different types of secondary particles or any combination thereof. The different types of particles can be different from each other in composition, two-dimensional shape, three-dimensional shape, grain size, particle size, hardness, friability, agglomeration, or any combination thereof.

After sufficiently forming the make coat 402 with the particulate material 404 contained therein, the size coat 403 can be formed to overlie and bond the particulate material 404 to the make coat 402 and the substrate 401. The size coat 403 can include an organic material, and may be made essentially of a polymeric material, and notably, can use polyesters, epoxy resins, polyurethanes, polyamides, polyacrylates, polymethacrylates, poly vinyl chlorides, polyethylene, polysiloxane, silicones, cellulose acetates, nitrocellulose, natural rubber, starch, shellac, and mixtures thereof.

As further illustrated in FIG. 4, the coated abrasive 400 can include an electronic assembly 420 including an electronic device 422 contained within a package 421. According to an embodiment, the package may be optional and one may opt to utilize the make coat 402 and/or size coat 403 as a material suitable for packaging and enclosing at least a portion of the electronic device 422. The electronic assembly 420 can have any of the features of electronic assemblies described in embodiments herein. The electronic device 422 may have any of the features of other electronic devices described in embodiments herein. The package 421 may have any of the features of any of the other packages described in embodiments herein.

According to one particular embodiment, the electronic assembly 420 can be overlying and/or coupled to the substrate 401. In a particular embodiment, at least a portion of the electronic device 422 can be in contact with the substrate 401. Furthermore, as illustrated in FIG. 4, at least a portion of the electronic device 422 can be encompassed by the package 421. According to one embodiment, the electronic assembly 420 can be embedded within the make coat 402 such that the make coat 402 covers the entirety of the electronic assembly 420. However, in other embodiments, at least a portion of the electronic assembly 410 may be protruding from the make coat 402 and/or size coat 403 such that at least a portion of the electronic assembly 420 can be exposed above the exterior surface 431 of the size coat 403.

FIG. 4 provides one potential embodiment for the incorporation of the electronic assembly 420 into a coated abrasive article 400. Other possible placements and orientations of the electronic assembly for 20 are possible. For example, the electronic assembly 420 may be placed on the opposite side of the backing 401, such as the backside 425 of the backing 401. In still another embodiment, the electronic assembly 420 can be overlying at least a portion of the exterior surface 431 of the abrasive article 400, and particularly the size coat 403. In certain instances, none of the electronic assembly 420 may be embedded within the size coat 403 or make coat 402 of the coated abrasive article 400.

Figure 4A:
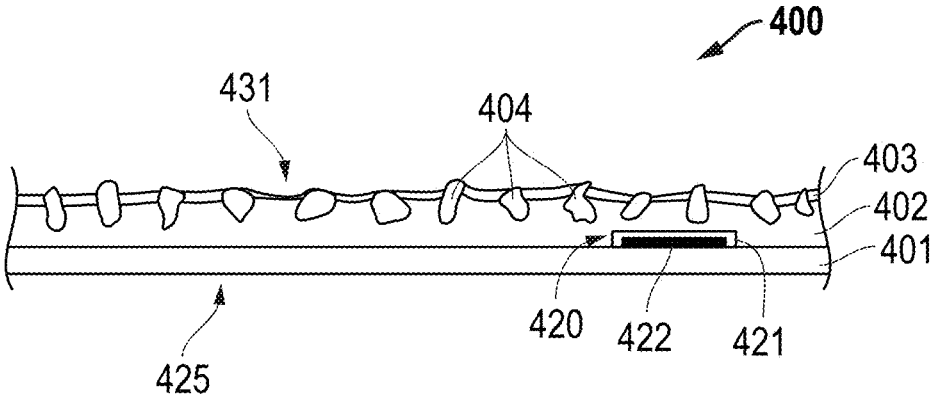
FIG. 4A includes a cross-sectional illustration of a portion of a coated abrasive article according to an embodiment.

In an embodiment, an abrasive article can include a substrate and an abrasive coating overlying the substrate. The substrate can be any substrate disclosed in embodiments herein. For instance, the abrasive article can include a non-woven abrasive article, wherein the substrate can include a fibrous web. The abrasive coating can include any composition that is known to a skilled artisan for forming the non-woven abrasive article. In another instance, the abrasive article can include a coated abrasive article including a substrate similar to the backing 401, and the abrasive coating can include the make coat 402 and abrasive particles 404, and optionally the size coat 403. In some instances, the abrasive coating can include a top coat overlying the size coat 403. In an embodiment, the abrasive coating can include an exterior surface that can be a grinding surface. For instance, the grinding surface can be the upper surface of the size coat 403, as illustrated in FIG. 4A.

In an embodiment, an electronic assembly can be coupled to the abrasive coating in a manner such that at least a portion of the electronic assembly is in direct contact with a portion of the abrasive coating. For instance, as illustrated in FIG. 4A, the electronic assembly 420 is in direct contact with the make coat 402. In a particular embodiment, the electronic assembly can be coupled to the abrasive coating in a tamper-proof manner.

In an embodiment, the electronic assembly can be at least partially embedded in the abrasive coating. For instance, the electronic assembly can be disposed such that at least a portion of the electronic assembly can be beneath the grinding surface of the abrasive coating. In a particular embodiment, the electronic assembly can be fully embedded within the abrasive coating. For example, the electronic assembly can be fully enveloped in the abrasive coating. In another instance, the entire electronic assembly can be beneath the grinding surface of the abrasive coating.

In a further embodiment, the electronic assembly can be disposed over the substrate, such as between the substrate and the abrasive coating. In an example, the electronic assembly can be on the substrate. Alternatively, the electronic assembly can be spaced apart from the substrate. In some instances, the electronic assembly may be partially embedded in the substrate.

In another embodiment, the electronic assembly can have a certain thickness that can facilitate placement and coupling of the electronic assembly to the abrasive coating. In an instance, the electronic assembly can have a thickness of at least 1 micron, such as at least 2 microns, at least 3 microns, or at least 4 microns. In another instance, the electronic assembly can be thicker, having a thickness of at least 0.5 mm, at least 0.7 mm, at least 0.8 mm, at least 1 mm, or at least 2 mm. Alternatively or additionally, the electronic assembly may have a thickness of not greater than 5 mm, such as not greater than 4 mm, not greater than 3 mm, not greater than 2 mm, or not greater than 1 mm. In some instances, the electronic assembly can be thinner, such as having a thickness of not greater than 10 microns, not greater than 9 microns, not greater than 7 microns, not greater than 5 microns, or not greater than 4 microns. Moreover, the thickness of the electronic assembly can be in a range including any of the minimum and maximum values noted herein. For example, the electronic assembly may have a thickness in a range including at least 1 micron and not greater than 5 mm, or in a range including at least 1 microns and not greater than 10 microns, or in a range including at least 1 mm and not greater than 5 mm. After reading the instant disclosure, a skilled artisan would understand that the thickness of the electronic assembly can be selected to suit a forming process of the abrasive article, such as placement and coupling of the electronic assembly or surviving a condition used to form the abrasive article, or to improve use of the abrasive article having the electronic assembly.

In another embodiment, the electronic assembly can have a certain thickness relative to the average thickness of the abrasive coating that can facilitate formation of the abrasive article. For instance, the thickness of the electronic assembly may be not greater than 99% of the average thickness of the abrasive coating, such as not greater than 98%, not greater than 96%, not greater than 94%, not greater than 92%, not greater than 90%, not greater than 88%, not greater than 86%, not greater than 84%, not greater than 82%, not greater than 80%, not greater than 78%, not greater than 76%, not greater than 75%, not greater than 73%, not greater than 71%, not greater than 70%, not greater than 68%, not greater than 66%, not greater than 64%, not greater than 62%, not greater than 60%, not greater than 58%, not greater than 55%, not greater than 53%, not greater than 51%, not greater than 50%, not greater than 48%, not greater than 45%, not greater than 43%, not greater than 41%, not greater than 40%, not greater than 38%, not greater than 36%, not greater than 34%, not greater than 32%, or not greater than 30% of the average thickness of the abrasive coating. In another instance, the electronic assembly can have a thickness of at least 5% of an average thickness of the abrasive coating, such as at least 10%, at least 12%, at least 13%, at least 15%, at least 17%, at least 18%, at least 20%, at least 22%, at least 24%, at least 25%, at least 27%, at least 30%, at least 31%, at least 33%, at least 35%, at least 37%, at least 40%, at least 42%, at least 44%, at least 46%, at least 48%, at least 50%, at least 52%, at least 54%, at least 55%, at least 58%, at least 60%, at least 62%, at least 64%, at least 66%, at least 68%, or at least 70% of the average thickness of the abrasive coating. Moreover, the thickness of the electronic assembly can include any minimum and maximum percentages noted herein. For instance, the electronic assembly can have a thickness of at least 5% and at most 99% of the average thickness of the abrasive coating. In another embodiment, the abrasive coating can have an average thickness from 0.015 mm to 1.5 mm. As used herein, average thickness of the abrasive coating can be determined according to ASTM D1777-96. The average thickness can be the average of 10 samples taken from the abrasive article in the same longitudinal direction (or machine direction).

In another embodiment, the electronic assembly can have a certain thickness relative to the average thickness of the abrasive article that can facilitate formation of the abrasive article. A particular abrasive article can include a coated abrasive, as illustrated in FIG. 4, or a non-woven abrasive article. For instance, the thickness of the electronic assembly may be not greater than 55% of an average thickness of the abrasive article, such as not greater than 53%, not greater than 51%, not greater than 50%, not greater than 48%, not greater than 45%, not greater than 43%, not greater than 41%, not greater than 40%, not greater than 38%, not greater than 36%, not greater than 34%, not greater than 32%, or not greater than 30% of the average thickness of the abrasive article. In another instance, the electronic assembly can have a thickness of at least 1% of an average thickness of the abrasive article, such as at least 3%, at least 5%, at least 7%, at least 10%, at least 12%, at least 13%, at least 15%, at least 17%, at least 18%, at least 20%, at least 22%, at least 24%, at least 25%, at least 27%, at least 30%, at least 31%, at least 33%, at least 35%, at least 37%, at least 40%, at least 42%, at least 44%, at least 46%, at least 48%, or at least 50% of the average thickness of the abrasive article. Moreover, the thickness of the electronic assembly can include any minimum and maximum percentages noted herein. For instance, the electronic assembly can have a thickness of at least 1% and at most 55% of the average thickness of the abrasive article. In another embodiment, the average thickness of the coated abrasive can be from 0.2 mm to 3.5 mm. As used herein, average thickness of the abrasive article can be determined according to ASTM D1777-96. The average thickness can be the average of 10 samples taken from the abrasive article in the same longitudinal direction (or machine direction)

In an exemplary forming process for forming an exemplary abrasive article, an electronic assembly can be disposed over the substrate, such as the backing 401, and at least a portion of the abrasive coating, such as at least a portion of the make coat 402, can be disposed over the substrate and the electronic assembly 420. In an instance, curing of the portion can be performed prior to applying the rest of the abrasive coating. For instance, the make coat 402 overlying the electronic assembly 420 can be cured prior to application of abrasive particles 404, the size coat 403, or both. The rest of the abrasive coating can be applied and cured to form a finally formed abrasive article. In another instance, a first portion of the abrasive coating may be applied to the substrate before an electronic assembly is disposed on the substrate, and another portion or the rest of the abrasive coating can be applied before or after curing of the first portion of the abrasive coating and cured. The abrasive article may be formed when all of the abrasive coating is applied and cured.

In an embodiment, the abrasive article can have a certain flexibility difference that can allow the abrasive article to perform and function in the similar manner as a same abrasive article not including the electronic assembly, particularly when the abrasive article is a non-woven or coated abrasive. A first portion of the abrasive article including the electronic assembly and a substantially same second portion not including the electronic assembly can be cut from the abrasive article. Flexibility of the first and second portions can be used to determine the flexibility difference. Each of the first and second portion samples can have a size of 75 mm×150 mm. Test of flexibility can be performed using mandrel bend test according to ASTM D4338-97 with modifications. Tests are conducted on freshly prepared portion samples. Each portion sample is folded to form an inverted U-shaped angle over the mandrel maintaining intimate contact across the mandrel surface. The test is repeated with progressively smaller diameter mandrels until the sample cracks or fails in bending. Flexibility is considered as the smallest diameter mandrel over which four out of five test portion samples do not break. Test of flexibility of the first and second portions can be performed in the longitudinal, transversal, or both directions.

The flexibility difference can be determined using the formula, $\delta F=[|(F_{2nd}-F_{1st})|/F_{2nd}]\times 100\%$, wherein $\delta F$ is the flexibility difference in the tested direction, $F_{1st}$ is the first flexibility in the tested direction (i.e., longitudinal or transversal), and $F_{2nd}$ is the second flexibility in the tested direction. In an aspect, the first portion can have a first flexibility in a longitudinal direction and the second portion can have a second flexibility in the longitudinal direction, wherein the flexibility difference between the first and the second flexibility may be not greater than 50%, not greater than 45%, not greater than 40%, not greater than 35%, not greater than 30%, not greater than 25%, not greater than 20%, not greater than 15%, not greater than 10%, not greater than 9%, not greater than 8%, not greater than 6%, not greater than 5%, not greater than 4%, not greater than 2%, or not greater than 1%. In another aspect, the flexibility difference in the longitudinal direction can be greater than 0, such as at least 0.001%, at least 0.005%, at least 0.01%, at least 0.05%, at least 0.1%, at least 0.3%, at least 0.5%, at least 0.8%, at least 1%, at least 2%, at least 5%, or at least 10%. In a further aspect, the flexibility difference in the longitudinal direction can be in a range including any of the minimum and maximum percentages noted herein. In a particular aspect, the first flexibility and the second flexibly in the longitudinal direction can be substantially the same.

In a further aspect, the first portion can have a third flexibility in a transversal direction and the second portion can have a fourth flexibility in the transversal direction, wherein the flexibility difference between the first and second portion in the transversal direction may be not greater than 50%, not greater than 45%, not greater than 40%, not greater than 35%, not greater than 30%, not greater than 25%, not greater than 20%, not greater than 15%, not greater than 10% of the fourth flexibility or not greater than 9% or not greater than 8% or not greater than 6% or not greater than 5% or not greater than 4% or not greater than 2%. In another aspect, the flexibility difference between the third and fourth flexibility can be greater than 0, such as at least 0.001%, at least 0.005%, at least 0.01%, at least 0.05%, at least 0.1%, at least 0.3%, at least 0.5%, at least 0.8%, at least 1%, at least 2%, at least 5%, or at least 10%. In a further aspect, the flexibility difference between the third and fourth flexibility can be in a range including any of the minimum and maximum percentages noted herein. In a particular aspect, the third flexibility and the fourth flexibly in the longitudinal direction can be substantially the same.

In another embodiment, the abrasive article can have a certain flexural rigidity difference that can allow the abrasive article to perform and function in the similar manner as a same abrasive article not including the electronic assembly, particularly when the abrasive article is a non-woven or coated abrasive. The flexural rigidity difference can be determined based on the flexural rigidity difference of the first portion and the second portion and using the formula, $\delta FX=[|(FX_{2nd}-FX_{1st})|/FX_{2nd}]\times 100\%$, wherein $\delta FX$ is the flexure rigidity difference, $FX_{1st}$ is flexure rigidity of the first portion, and $FX_{2nd}$ is flexure rigidity of the second portion. The first portion of the abrasive article includes the electronic assembly and the second portion is substantially the same not including the electronic assembly. The first portion and second portion samples are cut in the machine direction having the dimension of 200 mm×25 mm. Flexure rigidity of the first and second portions can be determined according to ASTM D1388-96 using a heart loop tester. 5 samples for each of the first and second portions can be tested. Each sample is formed into a heart-shaped loop. The length of the loop is measured when it is hanging vertically under its own mass. From this measured length, the bending length, and flexural rigidity can be calculated.

In an aspect, the flexural rigidity difference of the abrasive article may be not greater than 50% or not greater than 45% or not greater than 40% or not greater than 35% or not greater than 30% or not greater than 25% or not greater than 20% or not greater than 19% or not greater than 18% or not greater than 16% or not greater than 15% or not greater than 14% or not greater than 12% or not greater than 11% or not greater than 10% or not greater than 9% or not greater than 8% or not greater than 6% or not greater than 5% or not greater than 4% or not greater than 2% or not greater than 1% of the second flexural rigidity. In another aspect, the flexure rigidity difference can be greater than 0, such as at least 0.001%, at least 0.005%, at least 0.01%, at least 0.05%, at least 0.1%, at least 0.3%, at least 0.5%, at least 0.8%, at least 1%, at least 2%, at least 5%, or at least 10%. In a further aspect, the flexure rigidity difference can be in a range including any of the minimum and maximum percentages noted herein. In a particular aspect, the flexure rigidity of the first portion and the second portion can be substantially the same.

In another embodiment, the abrasive article can have a certain tensile strength difference that can allow the abrasive article to perform and function in the similar manner as a same abrasive article not including the electronic assembly, particularly when the abrasive article is a non-woven or coated abrasive. The tensile strength difference can be determined based on the tensile strength difference of a first portion and a second portion of the abrasive article, using the formula, $\delta T=[|(T_{2nd}-T_{1st})|/T_{2nd}]\times 100\%$, wherein $\delta T$ is the tensile strength difference, $T_{1st}$ is the tensile strength of the first portion, and $T_{2nd}$ is the tensile strength of the second portion. The tensile strength of the first and second portions is determined using a method derived from ASTM D5035. The first portion includes the electronic assembly, and the second portion is substantially the same without the electronic assembly. The portion samples are cut such that the gauge length is parallel to the longitudinal (machine) direction or the radial axis based on the type of abrasive article. 5 samples for each of the first and second portions can be prepared having the size of 25 mm×50 mm. Each sample is clamped in a tensile testing machine and a force is applied until the sample breaks at a loading rate of 300 mm/min. The breaking force and elongation is recorded and used to determine the tensile strength. The average of 5 samples is used as the tensile strength of the abrasive article.

In an aspect, the tensile strength difference of the abrasive article may be not greater than 50% or not greater than 45% or not greater than 40% or not greater than 35% or not greater than 30% or not greater than 25% or not greater than 20% or not greater than 19% or not greater than 18% or not greater than 16% or not greater than 15% or not greater than 14% or not greater than 12% or not greater than 11% or not greater than 10% or not greater than 9% or not greater than 8% or not greater than 6% or not greater than 5% or not greater than 4% or not greater than 2% or not greater than 1% of the second flexural strength. In another aspect, the tensile difference can be greater than 0, such as at least 0.001%, at least 0.005%, at least 0.01%, at least 0.05%, at least 0.1%, at least 0.3%, at least 0.5%, at least 0.8%, at least 1%, at least 2%, at least 5%, or at least 10%. In a further aspect, the tensile strength difference can be in a range including any of the minimum and maximum percentages noted herein. In a particular aspect, the tensile strength of the first portion and the second portion can be substantially the same.

In an embodiment, the electronic assembly can be placed out of the flange area to help to reduce the likelihood of damaging the electronic assembly during a material removal operation of the abrasive article. In a further embodiment, the electronic assembly may be placed in an area between the discard diameter of a wheel and the flange diameter. In another embodiment, the electronic assembly can be placed in the inner circumferential region.

Figure 4B:
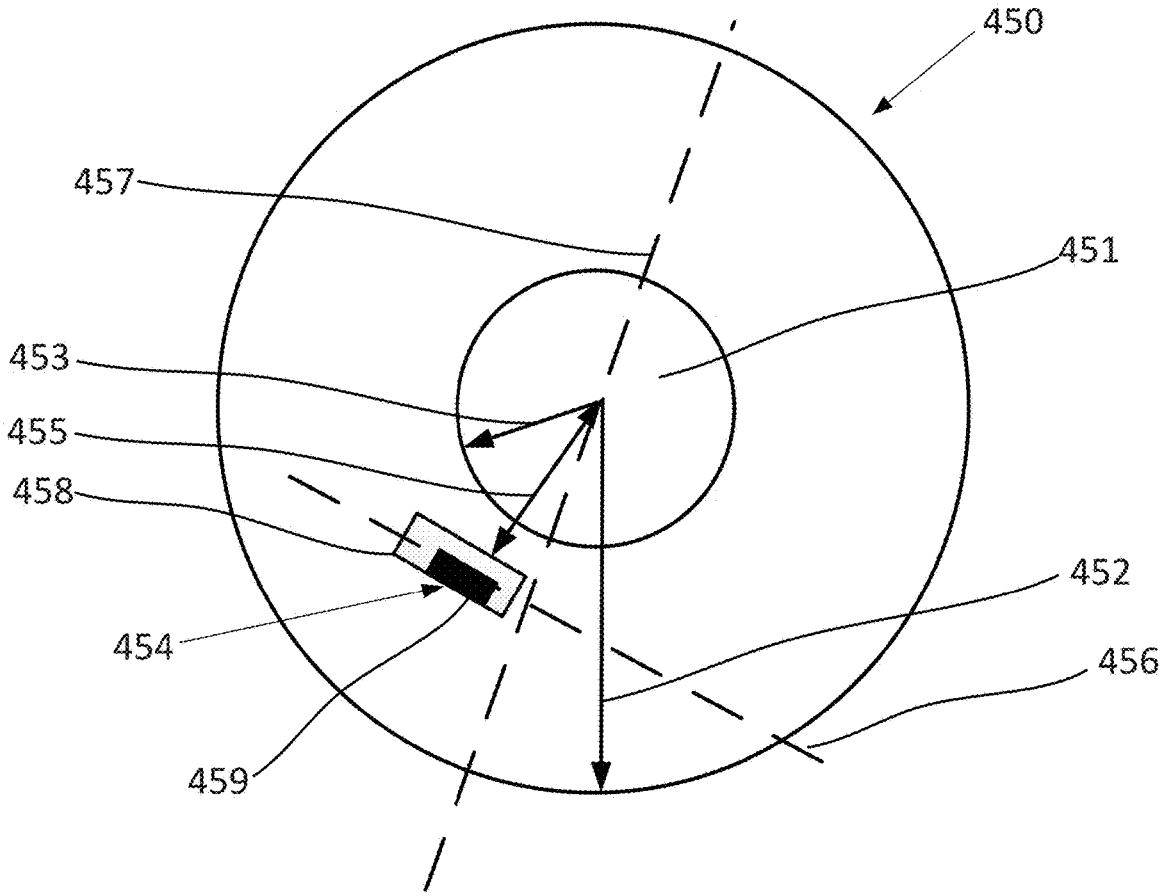
FIG. 4B includes an illustration of a top view of an abrasive article according to an embodiment.

In another embodiment, the abrasive article can be in the form of a disc or a wheel having a central opening. As illustrated in FIG. 4B, the abrasive article 450 including an opening 451 having an inner radius 453, and an outer radius 452 (referred to as "R"). In an embodiment, an electronic assembly 454 including a package 458 containing at least one electronic device 459 can be disposed at a position relative to the central opening 451 to facilitate operations utilizing the abrasive article, facilitate function and performance of the electronic assembly, and/or reduce the likelihood of damaging the electronic assembly. For instance, the electronic assembly can be adjacent the central opening 451, wherein the distance 455 between the center of the abrasive article and the electronic assembly 454 may be less than 0.5 R, such as not greater than 0.4 R, not greater than 0.3 R, not greater than 0.2 R, or not greater than 0.1 R. Additionally or alternatively, the distance 455 can be at least 0.05 R, such as at least 0.08 R or at least 0.1 R. Moreover, the distance 455 can be in a range including any of the minimum and maximum values noted herein.

In another instance, the electronic assembly can be distal to the central opening 451 and adjacent the outer circumference of the abrasive article. For instance, the distance 455 between the center of the abrasive article and the electronic assembly 454 may be greater than 0.5 R, such as at least 0.6 R, at least 0.7 R, at least 0.8 R, or at least 0.9 R. Additionally or alternatively, the distance 455 may be not greater than 0.99 R or not greater than 0.95 R or not greater than 0.93 R or not greater than 0.9 R. Moreover, the distance 455 can be in a range including any of the minimum and maximum values noted herein.

In another embodiment, the electronic assembly 454 can have a certain orientation that can facilitate improved performance of the electronic assembly or help to reduce likelihood of damaging the electronic assembly during operations utilizing the abrasive article. For example, as illustrated in FIG. 4B, the abrasive article 450 can have a radial axis 457, and the electronic assembly 454 can have a longitudinal axis 456, wherein the radial axis 457 and the longitudinal axis 456 can be angled.

Figure 4C:
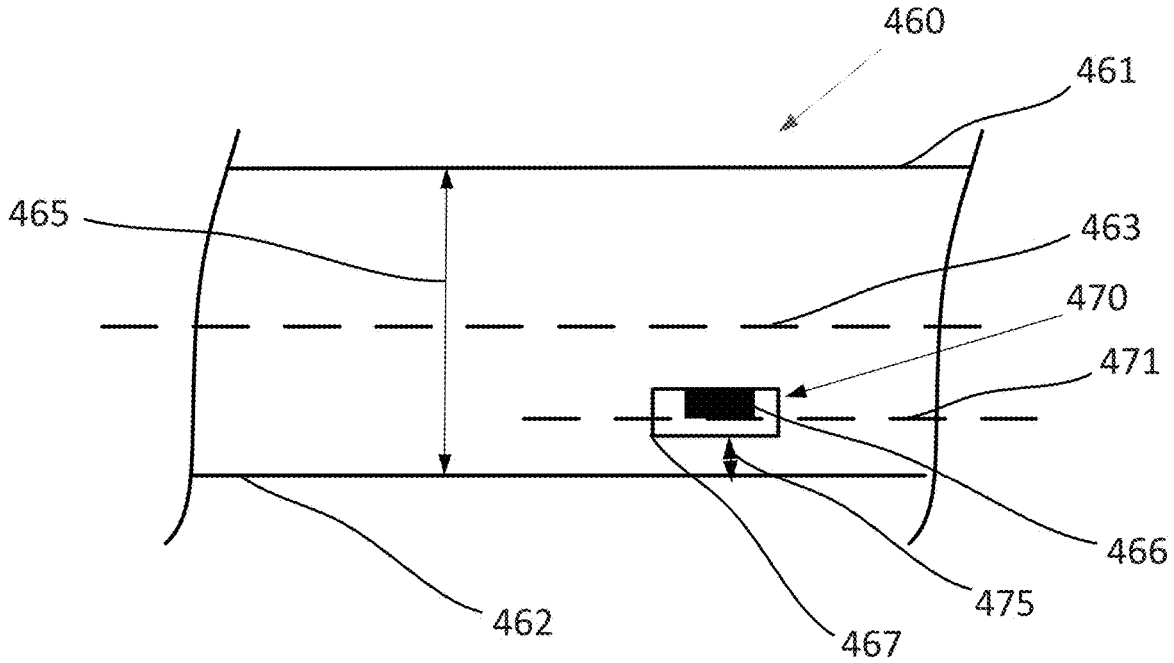
FIG. 4C includes an illustration of a portion of an abrasive article according to another embodiment.

In another embodiment, the abrasive article may be in the form of a belt. As illustrated in FIG. 4C, a portion of an abrasive belt 460 can include an edge 461 and an opposite edge 462, and a longitudinal axis 471. As illustrated, the longitudinal axis 471 extends along a midline of the belt 460. The belt 460 can include a width 465 (referred to as "W") across the belt in the lateral direction. The electronic assembly 470 can include a package 467 and an electronic device 466. In an embodiment, the electronic device 470 can be disposed at a position that is adjacent an edge, such as 462 as illustrated, and distal to the midline of the belt, which can facilitate operations utilizing the abrasive article, facilitate function and performance of the electronic assembly, and/or reduce the likelihood of damaging the electronic assembly during operations utilizing the belt. For instance, the distance 475 between the edge 462 and the electronic assembly 470 may be less than 0.5 W or not greater than 0.4 W or not greater than 0.3 W or not greater than 0.2 W or not greater than 0.1 W, wherein W is a width across the belt in lateral direction. In another instance, the distance 475 from the edge 462 of the belt 460 to the electronic assembly 470 can be at least 0.05 W or at least 0.07 W or at least 0.09 W or at least 0.1 W or at least 0.15 W. Moreover, the distance 475 can be in a range including any of the minimum and maximum values noted herein.

In a further embodiment, the electronic assembly 470 can have a certain orientation that can facilitate improved performance of the electronic assembly or help to reduce likelihood of damaging the electronic assembly during operations utilizing the abrasive article. For example, as illustrated, the longitudinal axis 471 of the electronic assembly 470 can substantially aligned with a longitudinal axis 463 of the abrasive article 460. In another example, a lateral axis of the electronic assembly can be substantially aligned with the longitudinal axis of the abrasive article. In another instance, the longitudinal axis of the electronic assembly can be angled with respect to the longitudinal axis of the abrasive article.

Figure 4D:
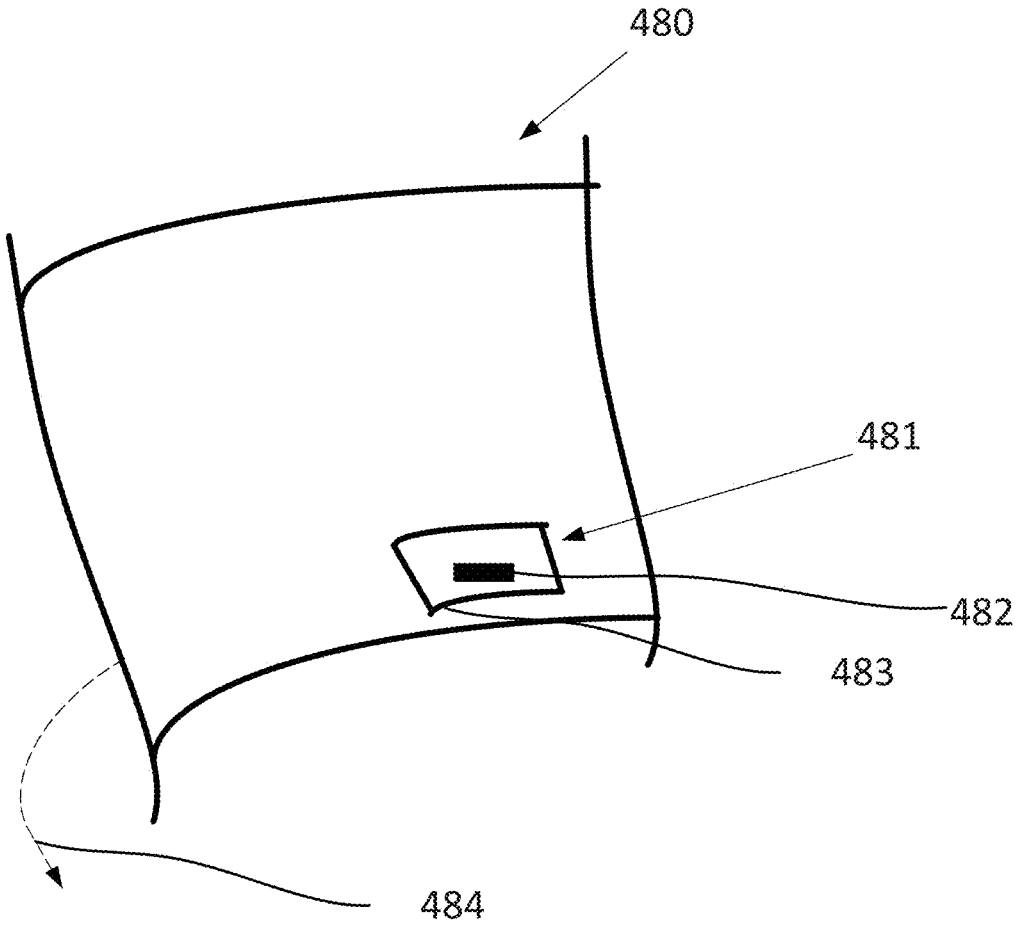
FIG. 4D includes an illustration of a portion of an abrasive article according to another embodiment.

As illustrated in FIG. 4D, the abrasive article 480 can have a curvature and a curvature axis 482. The electronic assembly 481 can include a package 483 and at least one electronic device 482. As illustrated, the electronic assembly 481 can also have a curvature, and in some particular instances, the curvature of the electronic assembly can be co-axial with the curvature of the abrasive article 480.

Figure 5:
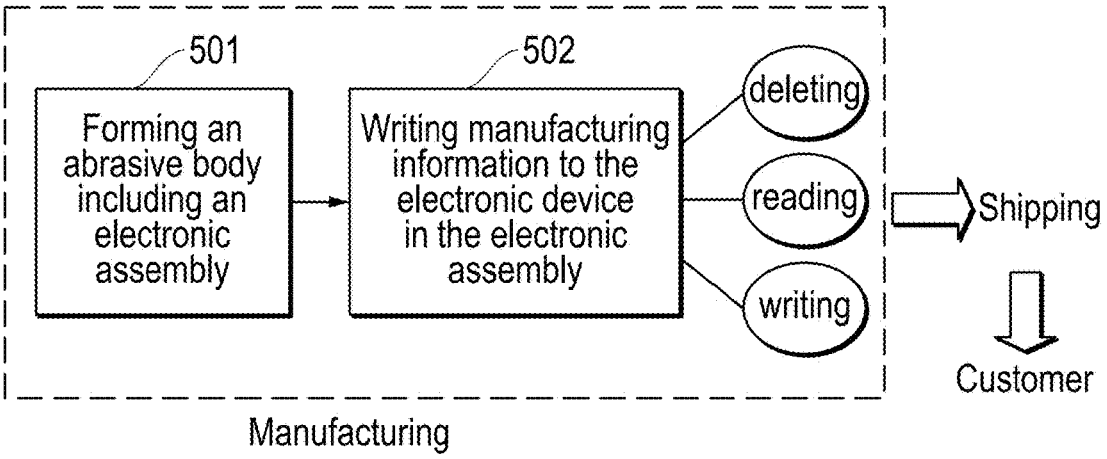
FIG. 5 includes a diagram of a supply chain and function of an abrasive article according to an embodiment.

FIG. 5 includes a diagram of a supply chain and function of an abrasive article according to an embodiment. The embodiments provided in FIG. 5 include examples of using an electronic assembly as part of an abrasive article, particularly as part of the manufacturing portion of the supply chain. As illustrated in the diagram of FIG. 5, the diagram includes forming an abrasive body including an electronic assembly at 501. Forming of the abrasive body can include any forming methods described in the embodiments herein.

After forming the abrasive body with the electronic assembly including the electronic device, the process can further include writing manufacturing information to the electronic device at 502. Writing information can be conducted during a write operation, wherein information can be written to and stored on the electronic device. Some suitable examples of manufacturing information can include processing information, manufacturing date, shipment information, product identification information or any combination thereof. In certain instances, processing information can include information pertaining to at least one processing condition used during forming of the abrasive body. Some suitable examples of processing information can include manufacturing machine data (e.g., machine identification, serial number, etc.) processing temperature, a processing pressure, processing time, processing atmosphere, or any combination thereof.

According to one embodiment, writing manufacturing information to the electronic device can occur during at least one process of forming the abrasive body. The process of forming can include any of the processes described herein, including for example, but not limited to, pressing, molding, casting, heating, curing, coating, cooling, stamping, drying, or any combination thereof. In certain instances, a machine conducting the forming process can conduct the writing operation and write the manufacturing information onto the electronic device. It will be appreciated that such manufacturing information can be processing information.

In an alternative embodiment, a sensor included in the electronic assembly can assist writing manufacturing information to the electronic device during forming of the abrasive body. The sensor may be configured to sense the conditions occurring during processing and write this information to an electronic device as manufacturing information. In still another embodiment, one or more other systems and/or individuals may write the one or more processing conditions used during the forming of the abrasive body as manufacturing information to the electronic device.

In an alternative embodiment, the process of writing manufacturing information to the electronic device can occur after forming the abrasive body. One or more systems and/or individuals may conduct a writing operation to write the manufacturing information on the electronic device after forming of the abrasive body.

In accordance with an embodiment, the manufacturing information stored on the electronic device may be utilized to conduct a quality control inspection of an abrasive article or a plurality of abrasive articles. Review of the manufacturing information, such as processing information, may assist with the identification of processing conditions and identification of abrasive articles that may not meeting a desired minimum quality rating.

After writing information to the electronic device, the one or more actions may be conducted using the manufacturing information. For example, in one embodiment, a system and/or individual may delete at least a portion of the manufacturing information prior to sending the abrasive article to a customer. It may be suitable to delete certain manufacturing information, such as certain processing information pertaining to aspects of forming the abrasive article.

In another embodiment, one or more write operations may be conducted to write information to the electronic device prior to sending the abrasive article to a customer. Such a writing operation may include storing customer information on the electronic device. The customer information may assist with the shipment and/or use of the abrasive article. Various types of customer information that can be included on the electronic device are described herein.

In another embodiment, a read operation may be conducted after writing information to the electronic device. For example, the read operation may read information from the electronic device prior to sending the abrasive article to a customer. Conducting a read operation may facilitate a quality inspection of the abrasive article and the information contained on the electronic device. Upon finalizing of the manufacturing operation, the abrasive article may be sent to shipping and thereafter sent to a customer for use of the abrasive article.

Figure 6:
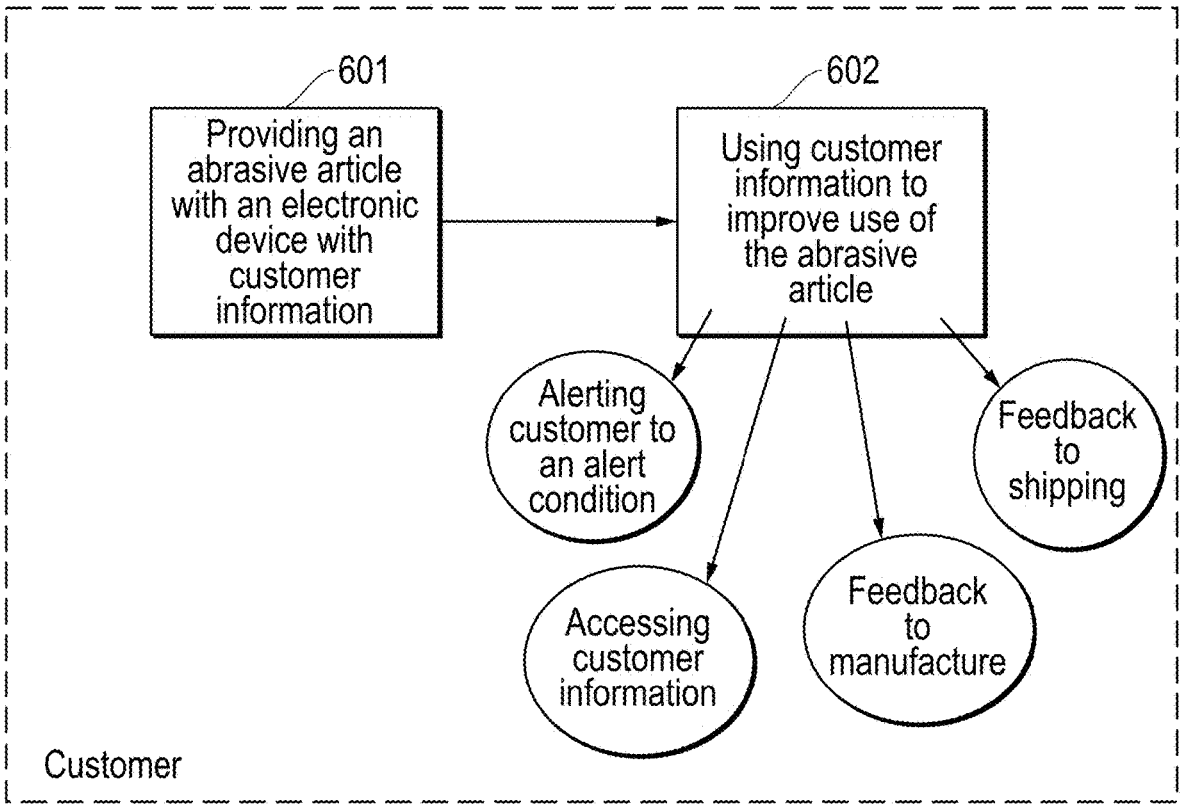
FIG. 6 includes a diagram of a supply chain and function of an abrasive article according to an embodiment.

FIG. 6 includes a diagram of a supply chain and function of the abrasive article according to an embodiment. As illustrated, the customer may obtain or be provided with an abrasive article including an electronic device. Depending upon the one or more electronic devices, the abrasive article may be supplied with customer information or alternatively, the customer may conduct a write operation to write certain customer information onto the electronic device. According to an embodiment, customer information can include information such as customer registration information, product identification information, product cost information, manufacturing date, shipment date, environmental information, use information, or any combination thereof. The customer information may be used to improve the use of the customer at 602. For example, the customer information may facilitate improved information exchange between the manufacturer and customer, and such feedback of information from the customer to the manufacturer may facilitate improved use of the abrasive article.

In one particular embodiment, customer information can include use information pertaining to suitable use conditions of the abrasive article. Accordingly, the customer may use the use information to ensure that the abrasive article is used under the proper operating conditions. Specific example of the use information can include, but is not limited to, minimum operating speed, maximum operating speed, burst speed, maximum power of the machine, maximum depth of cut, maximum down force, optimal wheel angle, and the like.

In still another embodiment the process of using customer information can include alerting one or more systems and/or individuals in the supply chain to a particular alert condition. Alert conditions may be based upon one or more pre-programmed thresholds, whereupon exceeding such a threshold, the electronic device can be configured to generate an alert signal. The alert signal can be any signal suitable to contact a system and/or individual in the supply chain, including any system and/or individual associated with manufacturing, shipping, and customers. According to one embodiment, the alert signal may be a sound, optical indicia, or a combination thereof intended to alert a user. In another embodiment, the alert signal may be an electronic communication sent to one or more remote systems or individuals. For example, the alert signal can be sent to a customer-registered device, a manufacturer-registered device, or any combination thereof. Some examples of customer-registered devices can include a customer-registered mobile device or a machine configured to use the abrasive article. In one embodiment the alert signal can be in the form of a text message to a customer-registered mobile device. In another embodiment the alert signal can be an electronic mail (i.e., email) communication to a customer-registered mobile device. A manufacturer-registered device can include for example a manufacturer-registered mobile device, or a manufacturer-registered computer system configured to monitor alert signals from various customers and associated abrasive articles.

In one embodiment, the alert condition can warn of potential damage to the abrasive article. The alert signal can be sent to a user, a system utilizing the abrasive article, and/or other systems and/or individuals in the supply chain of the abrasive article. According to a particular embodiment, the electronic device may include one or more sensors be configured to sense one or more operating conditions. When one of the operating conditions is exceeded, the sensors can communicate with one or more other electronic devices in the electronic assembly and create an alert condition. The alert condition can generate an alert signal that can be sent to one or more systems and/or individuals in the supply chain. In particular instance, the alert signal can be sent to the grinding machine using the abrasive article. The alert signal may be used by the grinding machine to change the operating conditions and eliminate the alert condition.

In another embodiment, the process of alerting the customer can include alerting the customer to alert condition associated with the age of the abrasive article. For example, the electronic device may include one or more timers, wherein after a programmed amount of time has elapsed without use of the abrasive article, the timer can generate an alert condition warning the customer of the age of the abrasive article. It will be appreciated that the other systems and/or individuals in the supply chain can be alerted.

According to another aspect, alerting the customer can include alerting the customer to an alert condition associated with one or more environmental conditions of the abrasive article. For example, in one embodiment, the electronic device can be coupled to a sensor configured to sense one or more environmental conditions. Some suitable examples of environmental conditions that may be sensed by the sensor can include, but is not limited to, the presence of a threshold amount of water vapor within the packaging of the abrasive article, the presence of a threshold amount of water vapor in the abrasive article, the temperature of the abrasive article, the pressure on the abrasive article, the presence of harmful chemicals in the packaging, the presence of harmful chemicals in the abrasive article, damage to the abrasive article, tampering, age of the abrasive article or any combination thereof. The sensors can be pre-programmed with suitable threshold values for certain environmental conditions. If any of the pre-programmed threshold values are exceeded, the sensor can communicate with an electronic device to generate an alert condition and send an alert signal. The alert signal can be sent to one or more systems and/or individuals in the supply chain.

In still another embodiment, alerting the customer can include alerting the customer and/or manufacturer to an alert condition associated with the shipment of the abrasive article. Such an alert signal may facilitate improved distribution and transfer of abrasive articles between a manufacturer and customer. For example, the electronic assembly may include a GPS, which may facilitate tracking of the abrasive article by a customer or manufacturer. Customer information may be used to provide feedback to other systems and/or individuals in the supply chain. For example, customer information may be used to provide feedback to systems and/or individuals associated with the shipping of abrasive articles between the manufacturer and customer. As noted herein, feedback of customer information may facilitate smoother and improved sales, distribution and/or transportation of abrasive articles to customers.

According to another aspect, customer information may be utilized to provide feedback to a manufacturer. For example, in one embodiment customer information such as product use information may be utilized and provided to a manufacturer to better understand conditions of use by customer for a given abrasive article. Such information may be valuable to a manufacturer to assist with providing a customer with optimized abrasive articles and or making suggestions for alternative use conditions or alternative abrasive products.

In another embodiment, the customer information may be used to facilitate future exchanges between the manufacturer and the customer. For example, one or more types of information, such as environmental information or customer information may be used to notify the manufacturer that the customer is in need of more abrasive articles. In one particular embodiment, the customer information may be used to alert the one or more systems or individuals in the supply chain, including for example, an alert to one or more website addresses, emails, and/or sales representatives of the manufacturer.

Many different aspects and embodiments are possible. Some of those aspects and embodiments are described herein. After reading this specification, skilled artisans will appreciate that those aspects and embodiments are only illustrative and do not limit the scope of the present invention. Embodiments may be in accordance with any one or more of the items as listed below.

Embodiment 1. An abrasive article comprising:

an abrasive body including:

a bond material;

abrasive particles contained within the bond material; and an electronic assembly coupled to the abrasive body, wherein the electronic assembly comprises at least one electronic device.

Embodiment 2. An abrasive article comprising:

an abrasive body including:

a bond material;

abrasive particles contained within the bond material; and an electronic assembly bonded to the abrasive body, wherein at least a portion of the electronic assembly is contained within the interior volume of the abrasive body, and wherein the electronic assembly comprises at least one electronic device.

Embodiment 3. The abrasive article of any one of embodiments 1 and 2, wherein the at least one electronic device includes a device selected from the group consisting of an electronic tag, electronic memory, a sensor, an analog to digital converter, a transmitter, a receiver, a transceiver, a modulator circuit, a multiplexer, an antenna, a near-field communication device, a power source a display, an optical device, a global positioning system, or any combination thereof.

Embodiment 4. The abrasive article of any one of embodiments 1 and 2, wherein the at least one electronic device comprises a passive radio frequency identification (RFID) tag.

Embodiment 5. The abrasive article of any one of embodiments 1 and 2, wherein the at least one electronic device comprises an active radio frequency identification (RFID) tag.

Embodiment 6. The abrasive article of any one of embodiments 1 and 2, wherein the at least one electronic device comprises a sensor selected from the group consisting of an acoustic sensor, force sensor, vibration sensor, temperature sensor, moisture sensor, pressure sensor, gas sensor, timer, or any combination thereof.

Embodiment 7. The abrasive article of any one of embodiments 1 and 2, wherein the at least one electronic device comprises a near-field communication device and further comprising a sensor coupled to the near-field communication device.

Embodiment 8. The abrasive article of any one of embodiments 1 and 2, wherein the at least one electronic device comprises a near-field communication device.

Embodiment 9. The abrasive article of any one of embodiments 1 and 2, wherein the at least one electronic device comprises a transceiver.

Embodiment 9. The abrasive article of any one of embodiments 1 and 2, wherein the at least one electronic device is configured to communicate with a mobile device.

Embodiment 10. The abrasive article of any one of embodiments 1 and 2, wherein the at least one electronic device is read-only device.

Embodiment 11. The abrasive article of any one of embodiments 1 and 2, wherein the at least one electronic device is a read-write device.

Embodiment 12. The abrasive article of any one of embodiments 1 and 2, wherein the at least one electronic device includes manufacturing information selected from the group consisting of processing information, manufacturing date, shipment information, product identification information or any combination thereof.

Embodiment 13. The abrasive article of any one of embodiments 1 and 2, wherein the at least one electronic devices includes customer information selected from the group consisting of customer registration information, product identification information, product cost information, manufacturing date, shipment date, environmental information, use information, or any combination thereof.

Embodiment 14. The abrasive article of embodiment 1, wherein the electronic assembly is bonded directly to an exterior surface of the abrasive body.

Embodiment 15. The abrasive article of embodiment 1, wherein the electronic assembly is positioned in an interior circumferential region of the abrasive body.

Embodiment 16. The abrasive article of embodiment 15, wherein the entirety of the electronic assembly is bonded directly to an exterior surface of the abrasive body.

Embodiment 17. The abrasive article of embodiment 15, wherein at least a portion of the electronic assembly is exposed at the exterior surface of the abrasive body.

Embodiment 18. The abrasive article of any one of embodiments 1 and 2, wherein the electronic assembly includes an embedded portion, extending into the interior volume of the abrasive body below the exterior surface of the abrasive body.

Embodiment 19. The abrasive article of any one of embodiments 1 and 2, wherein the embedded portion is bonded directly to the bond material.

Embodiment 20. The abrasive article of embodiment 19, wherein the embedded portion is at least 1% of the total volume of the electronic assembly or at least 5% or at least 10% or at least 15% or at least 20% or at least 30% or at least 40% or at least 50% or at least 60% or at least 70% or at least 80% or at least 90%.

Embodiment 21. The abrasive article of embodiment 19, wherein the embedded portion is not greater than 95% or the total volume of the electronic assembly or not greater than 90% or not greater than 80% or not greater than 70% or not greater than 60% or not greater than 50% or not greater than 40% or not greater than 30% or not greater than 20% or not greater than 10% or not greater than 5%.

Embodiment 22. The abrasive article of embodiment 19, wherein the embedded portion includes a portion of a packaging and the electronic device is coupled to an exterior surface of the abrasive body.

Embodiment 23. The abrasive article of any one of embodiments 1 and 2, wherein the electronic assembly is positioned in an interior circumferential region of the abrasive body.

Embodiment 24. The abrasive article of any one of embodiments 1 and 2, wherein at least 1% of the total volume of the electronic assembly is contained within the interior volume of the abrasive body or at least 5% or at least 10% or at least 15% or at least 20% or at least 30% or at least 40% or at least 50% or at least 60% or at least 70% or at least 80% or at least 90%.

Embodiment 26. The abrasive article of any one of embodiments 1 and 2, wherein not greater than 99% of the electronic assembly is contained within the interior volume of the abrasive body or not greater than 95% or not greater than 90% or not greater than 80% or not greater than 70% or not greater than 60% or not greater than 50% or not greater than 40% or not greater than 30% or not greater than 20% or not greater than 10% or not greater than 5%.

Embodiment 27. The abrasive article of embodiment 1 and 2, wherein the electronic assembly is embedded entirely within the volume of the body and spaced apart from an exterior surface of the abrasive body.

Embodiment 28. The abrasive article of embodiment 27, wherein the electronic assembly is embedded at a depth ($D_{EA}$) of less than 50% of the total thickness of the abrasive body ($T_B$) or not greater than 45% or not greater than 40% or not greater than 35% or not greater than 30% or not greater than 25% or not greater than 20% or not greater than 15% or not greater than 10% or not greater than 5% or not greater than 3%.

Embodiment 28. The abrasive article of embodiment 27, wherein the electronic assembly is embedded at a depth ($D_{EA}$) of at least 1% of the total thickness of the abrasive body ($T_B$) or at least 2% or at least 3% or at least 5% or at least 8% or at least 10% or at least 12% or at least 15% or at least 20% or at least 25% or at least 30% or at least 40%.

Embodiment 29. The abrasive article of any one of embodiments 1 and 2, wherein the electronic assembly comprises a package, wherein the electronic device is contained within the package.

Embodiment 30. The abrasive article of embodiment 29, wherein the package comprises a thermal barrier material.

Embodiment 31. The abrasive article of embodiment 30, wherein the thermal barrier material comprises a material selected from the group consisting of thermoplastic polymers includes polycarbonates, polyacrylates, polyamides, polyimides, polysulphones, polyketones, polybenzimidizoles, polyesters, and blends of the above mentioned polymers, thermoset polymers includes, epoxies, cyanoesters, phenol formaldehyde, polyurethanes, poly (amide/imide), cross-linkable unsaturated polyesters, ceramics or any combination thereof.

Embodiment 32. The abrasive article of embodiment 30, wherein the thermal barrier package comprises a thermal conductivity within a range of at least 0.33 W/m/K to not greater than 200 W/m/K.

Embodiment 33. The abrasive article of embodiment 30, wherein the package comprises a water vapor transmission rate within a range of not greater than 2.0 g/m$^2$-day.

Embodiment 34. The abrasive article of embodiment 30, wherein the package is substantially transparent to radio frequency electromagnetic radiation.

Embodiment 35. The abrasive article of any one of embodiments 1 and 2, wherein the abrasive particles comprise a material selected from the group consisting of oxides, carbides, nitrides, borides, or any combination thereof.

Embodiment 36. The abrasive article of embodiment 35, wherein the abrasive particles comprise a superabrasive material.

Embodiment 37. The abrasive article of any one of embodiments 1 and 2, wherein the abrasive body comprises a content of abrasive particles within a range of at least 0.5 vol % and not greater than 90 vol % for a total volume of the abrasive body.

Embodiment 38. The abrasive article of any one of embodiments 1 and 2, wherein the abrasive particles comprise a median particle size (D50) within a range of at least 0.1 microns to not greater than 5000 microns.

Embodiment 39. The abrasive article of any one of embodiments 1 and 2, wherein the bond material includes a material selected from the group consisting of an inorganic material, an organic material, or any combination thereof.

Embodiment 40. The abrasive article of any one of embodiments 1 and 2, wherein the bond material includes an inorganic material selected from the group consisting of a metal, metal alloy, vitreous material, monocrystalline material, polycrystalline material, glass, ceramic, or any combination thereof.

Embodiment 41. The abrasive article of any one of embodiments 1 and 2, wherein the bond material comprises an organic material selected from the group consisting of a thermoplastic, thermoset, elastomer or any combination thereof.

Embodiment 42. The abrasive article of any one of embodiments 1 and 2, wherein the bond material comprises at least one of a resin, an epoxy, or any combination thereof.

Embodiment 43. The abrasive article of any one of embodiments 1 and 2, wherein the bond material comprises a forming temperature of not greater than 1500° C. or not greater than 1400° C. or not greater than 1300° C. or not greater than 1200° C. or not greater than 1100° C. or not greater than 1000° C. or not greater than 900° C. or not greater than 800° C. or not greater than 700° C. or not greater than 600° C. or not greater than 500° C. or not greater than 400° C. or not greater than 300° C.

Embodiment 44. The abrasive article of any one of embodiments 1 and 2, wherein the bond material comprises a forming temperature of at least 100° C. or at least 200° C. or at least 300° C. or at least 400° C. or at least 500° C. or at least 600° C. or at least 700° C. or at least 800° C. or at least 900° C. or at least 1000° C. or at least 1100° C. or at least 1200° C. or at least 1300° C. or at least 1400° C.

Embodiment 45. The abrasive article of any one of embodiments 1 and 2, wherein the abrasive body comprises porosity present in an amount within a range including at least 0.5 vol % and not greater than 90 vol % for the total volume of the body.

Embodiment 46. The abrasive article of any one of embodiments 1 and 2, wherein the abrasive body comprises porosity selected from the group consisting of closed porosity, open porosity, or any combination thereof.

Embodiment 47. The abrasive article of any one of embodiments 1 and 2, wherein the abrasive body comprises abrasive particles contained within a three-dimensional volume of bond material defining a bonded abrasive body.

Embodiment 48. The abrasive article of any one of embodiments 1 and 2, wherein the abrasive body comprises a layer of abrasive particles contained in one or more bond material layers overlying a substrate and defining a coated abrasive article.

Embodiment 49. A method for forming an abrasive article including forming an abrasive body precursor including abrasive particles and a bond material precursor;

combining at least one electronic assembly with the abrasive body precursor, wherein the at least one electronic assembly comprises an electronic device; and forming the abrasive body precursor into an abrasive body.

Embodiment 50. The method of embodiment 49, wherein the abrasive body precursor is a liquid mixture including the abrasive particles and bond material precursor.

Embodiment 51. The method of embodiment 49, wherein the abrasive body precursor is a solid green body including the abrasive particles and bond material precursor.

Embodiment 52. The method of embodiment 49, wherein forming includes heating the body to a forming temperature within a range of at least 25° C. and not greater than 1500° C.

Embodiment 53. The method of embodiment 49, further comprising:

forming the abrasive body precursor by creating a mixture of the abrasive particles and the bond material precursor;

depositing the electronic assembly on or within the mixture; and forming the abrasive body precursor into the abrasive body using at least one process selected from the group consisting of curing, heating, sintering, firing, cooling, molding, pressing, or any combination thereof.

Embodiment 54. The method of embodiment 49, further comprising:

forming the abrasive body precursor including the abrasive particles and the bond material precursor into a solidified green body; and depositing the electronic assembly on the solidified green body; and forming the solidified green body into the abrasive body using at least one process selected from the group consisting of curing, heating, sintering, firing, cooling, molding, pressing, or any combination thereof.

Embodiment 55. The method of embodiment 49, wherein the electronic assembly is bonded directly to an exterior surface of the abrasive body.

Embodiment 56. The method of embodiment 49, wherein the electronic assembly is positioned in an interior circumferential region of the abrasive body.

Embodiment 57. The method of embodiment 49, wherein the entirety of the electronic assembly is bonded directly to an exterior surface of the abrasive body.

Embodiment 58. The method of embodiment 49, wherein at least a portion of the electronic assembly is exposed at the exterior surface of the abrasive body.

Embodiment 59. The method of embodiment 49, wherein the electronic assembly includes an embedded portion, extending into the interior volume of the abrasive body below the exterior surface of the abrasive body.

Embodiment 60. The method of embodiment 49, wherein the embedded portion is bonded directly to the bond material.

Embodiment 61. The method of embodiment 49, wherein the embedded portion includes a portion of a packaging and the electronic device is coupled to an exterior surface of the abrasive body.

Embodiment 62. The method of embodiment 49, wherein the electronic assembly is embedded entirely within the volume of the abrasive body and spaced apart from an exterior surface of the abrasive body.

Embodiment 63. The method of embodiment 49, wherein the electronic assembly comprises a package, wherein the electronic device is contained within the package and wherein the package comprises a thermal barrier material.

Embodiment 64. A method for forming an abrasive article including forming an abrasive body precursor including abrasive particles and a bond material precursor;

forming the abrasive body precursor into an abrasive body including abrasive particles and bond material; and attaching an electronic assembly to the abrasive body, wherein the electronic assembly comprises at least one electronic device.

Embodiment 65. The method of embodiment 64, wherein forming abrasive body precursor including abrasive particles and a bond material precursor includes forming a mixture including the abrasive particles and the bond material precursor.

Embodiment 66. The method of embodiment 64, wherein forming the abrasive body precursor into an abrasive body including abrasive particles and bond material includes at least one process selected from the group consisting of curing, heating, sintering, firing, cooling, pressing, molding or any combination thereof.

Embodiment 67. The method of embodiment 64, wherein forming includes heating the body to a forming temperature within a range of at least 100° C. and not greater than 1500° C.

Embodiment 68. The method of embodiment 64, wherein attaching includes at least one process selected from the group consisting of adhering, chemical bonding, sinter-bonding, brazing, puncturing, fastening, connecting or any combination thereof.

Embodiment 69. A method of using an abrasive article comprising:

forming an abrasive body including:

a bond material;

abrasive particles contained within the bond material; and an electronic assembly coupled to the abrasive body, wherein the electronic assembly comprises an electronic device; and writing manufacturing information to the electronic device.

Embodiment 70. The method of embodiment 69, wherein writing manufacturing information to the electronic device occurs during at least one process of forming the abrasive body.

Embodiment 71. The method of embodiment 69, wherein writing manufacturing information to the electronic device occurs after forming the abrasive body.

Embodiment 72. The method of embodiment 69, wherein manufacturing information is selected from the group consisting of processing information, manufacturing date, shipment information, product identification information or any combination thereof.

Embodiment 73. The method of embodiment 72, wherein processing information includes information pertaining to at least one processing condition used to form the abrasive body.

Embodiment 74. The method of embodiment 69, wherein processing information includes at least one of a manufacturing machine data, processing temperature, a processing pressure, a processing time, a processing atmosphere, or any combination thereof.

Embodiment 75. The method of embodiment 69, further comprising conducting a quality control inspection by reviewing the manufacturing information.

Embodiment 76. The method of embodiment 69, further comprising conducting at least one action selected from the group consisting of:

a) deleting at least a portion of the manufacturing information prior to sending the abrasive article to a customer;

b) reading information from the electronic device prior to sending the abrasive article to a customer;

c) writing information to the electronic device prior to sending the abrasive article to a customer; or d) any combination thereof.

Embodiment 77. A method of using an abrasive article comprising:

providing an abrasive body including:

a bond material;

abrasive particles contained within the bond material; and an electronic assembly coupled to the abrasive body, wherein the electronic assembly comprises an electronic device including customer information; and using customer information contained on the electronic device.

Embodiment 78. The method of embodiment 77, wherein the customer information includes information selected from the group consisting of customer registration information, product identification information, product cost information, manufacturing date, shipment date, environmental information, use information, or any combination thereof.

Embodiment 79. The method of embodiment 77, wherein using includes accessing the customer information to determine the appropriate conditions for use of the abrasive article.

Embodiment 80. The method of embodiment 77 wherein using includes alerting the customer to one or more alert conditions.

Embodiment 81. The method of embodiment 80, wherein alerting the customer includes alerting the customer to an alert condition associated with the use of the abrasive article.

Embodiment 82. The method of embodiment 81, wherein alerting the customer includes alerting the customer to an alert condition associated with the age of the abrasive article.

Embodiment 83. The method of embodiment 81, wherein alerting the customer includes alerting the customer to an alert condition associated with one or more environmental conditions of the abrasive article.

Embodiment 84. The method of embodiment 83, wherein one or more environmental conditions include at least one of the presence of water vapor within the packaging of the abrasive article, the water vapor in the abrasive article, the temperature of the abrasive article, the pressure on the abrasive article, the presence of harmful chemicals in the packing, the presence of harmful chemicals in the abrasive article, damage to the abrasive article, tampering information, age of the abrasive article or any combination thereof.

Embodiment 85. The method of embodiment 80, wherein alerting the customer includes sending at least one alert signal to at least one of a customer-registered device, a manufacturer-registered device or any combination thereof.

Embodiment 86. The method of embodiment 80, wherein alerting the customer includes sending at least one alert signal to a customer-registered mobile device, a manufacturer-registered mobile device, or any combination thereof.

Embodiment 87. The method of embodiment 85, wherein the alert signal can include a text message to a customer-registered mobile device.

Embodiment 88. The method of embodiment 80, wherein alerting the customer includes alerting the customer or manufacturer to an alert condition associated with the shipment of the abrasive article.

Embodiment 89. A method of using an abrasive article comprising:

providing an abrasive article including an electronic device having customer information; and alerting the customer to one or more alert conditions, wherein alerting includes sending an alert signal to one or more customer-registered mobile devices.

Embodiment 90. The method of embodiment 89, wherein the customer information includes information selected from the group consisting of customer registration information, product identification information, product cost information, manufacturing date, shipment date, environmental information, use information, or any combination thereof.

Embodiment 91. The method of embodiment 89, wherein alerting the customer includes alerting the customer to an alert condition associated with the use of the abrasive article.

Embodiment 92. The method of embodiment 89, wherein alerting the customer includes alerting the customer to an alert condition associated with the age of the abrasive article.

Embodiment 93. The method of embodiment 89, wherein alerting the customer includes alerting the customer to an alert condition associated with one or more environmental conditions of the abrasive article.

Embodiment 94. The method of embodiment 93, wherein one or more environmental conditions include at least one of the presence of water vapor within the packaging of the abrasive article, the water vapor in the abrasive article, the temperature of the abrasive article, the pressure on the abrasive article, the presence of harmful chemicals in the packing, the presence of harmful chemicals in the abrasive article, damage to the abrasive article, tampering information, age of the abrasive article or any combination thereof.

Embodiment 95. The method of embodiment 90, wherein the alert signal can include a text message to a customer-registered mobile device.

Embodiment 96. The method of embodiment 90, wherein alerting the customer includes alerting the customer or manufacturer to an alert condition associated with the shipment of the abrasive article.

Embodiment 97. An abrasive article comprising:

an abrasive portion; and an electronic assembly coupled to the abrasive portion, wherein at least a portion of the electronic assembly is in direct contact with a portion of the abrasive portion.

Embodiment 98. The abrasive article of Embodiment 97, further comprising:

a backing;

an abrasive coating overlying the backing, wherein the abrasive portion is a portion of the abrasive coating; and an electronic assembly coupled to the abrasive coating, wherein at least a portion of the electronic assembly is in direct contact with a portion of the abrasive coating, wherein the abrasive article is a coated abrasive article.

Embodiment 99. The abrasive article of embodiment 98, wherein the electronic assembly is coupled to the abrasive coating in a tamper-proof manner.

Embodiment 100. The abrasive article of embodiment 98, wherein the electronic assembly is at least partially embedded in the the abrasive coating.

Embodiment 101. The abrasive article of embodiment 98, wherein at least a portion of the electronic assembly is disposed beneath a grinding surface of the abrasive portion or a grinding surface of the abrasive coating.

Embodiment 102. The abrasive article of embodiment 98, wherein the entire electronic assembly is beneath a grinding surface of the abrasive coating.

Embodiment 103. The abrasive article of embodiment 98, wherein the entire electronic assembly is embedded within the abrasive coating.

Embodiment 104. The abrasive article of embodiment 98, wherein the entire electronic assembly is fully enveloped in the abrasive coating.

Embodiment 105. The abrasive article of embodiment 98, wherein the electronic assembly is disposed between the backing and the abrasive coating.

Embodiment 106. The abrasive article of embodiment 98, wherein the electronic assembly is spaced apart from the backing.

Embodiment 107. The abrasive article of embodiment 98, wherein the electronic assembly is disposed on the backing.

Embodiment 108. The abrasive article of embodiment 98, wherein the electronic assembly is partially embedded in the backing.

Embodiment 109. The abrasive article of embodiment 97 or 98, wherein the electronic assembly has a thickness of not greater than 99% of an average thickness of the abrasive portion, such as not greater than 98%, not greater than 96%, not greater than 94%, not greater than 92%, not greater than 90%, not greater than 88%, not greater than 86%, not greater than 84%, not greater than 82%, not greater than 80%, not greater than 78%, not greater than 76%, not greater than 75%, not greater than 73%, not greater than 71%, not greater than 70%, not greater than 68%, not greater than 66%, not greater than 64%, not greater than 62%, not greater than 60%, not greater than 58%, not greater than 55%, not greater than 53%, not greater than 51%, not greater than 50%, not greater than 48%, not greater than 45%, not greater than 43%, not greater than 41%, not greater than 40%, not greater than 38%, not greater than 36%, not greater than 34%, not greater than 32%, or not greater than 30% of the average thickness of the abrasive portion.

Embodiment 110. The abrasive article of embodiment 97 or 98, wherein the electronic assembly has a thickness of at least 10% of an average thickness of the abrasive portion, such as at least 12%, at least 13%, at least 15%, at least 17%, at least 18%, at least 20%, at least 22%, at least 24%, at least 25%, at least 27%, at least 30%, at least 31%, at least 33%, at least 35%, at least 37%, at least 40%, at least 42%, at least 44%, at least 46%, at least 48%, at least 50%, at least 52%, at least 54%, at least 55%, at least 58%, at least 60%, at least 62%, at least 64%, at least 66%, at least 68%, or at least 70% of the average thickness of the abrasive portion.

Embodiment 111. The coated abrasive article of embodiment 97, wherein the electronic assembly has a thickness of not greater than 55% of an average thickness of the abrasive article, such as not greater than 53%, not greater than 51%, not greater than 50%, not greater than 48%, not greater than 45%, not greater than 43%, not greater than 41%, not greater than 40%, not greater than 38%, not greater than 36%, not greater than 34%, not greater than 32%, or not greater than 30% of the average thickness of the coated abrasive.

Embodiment 112. The abrasive article of embodiment 97 or 98, wherein the electronic assembly has a thickness of at least 10% of an average thickness of the abrasive article, such as at least 12%, at least 13%, at least 15%, at least 17%, at least 18%, at least 20%, at least 22%, at least 24%, at least 25%, at least 27%, at least 30%, at least 31%, at least 33%, at least 35%, at least 37%, at least 40%, at least 42%, at least 44%, at least 46%, at least 48%, or at least 50% of the average thickness of the coated abrasive.

Embodiment 113. The abrasive article of embodiment 97 or 98, wherein the abrasive article comprises a coated abrasive or a non-woven abrasive, wherein the abrasive article comprises a flexibility difference in a longitudinal direction of not greater than 50%, not greater than 45%, not greater than 40%, not greater than 35%, not greater than 30%, not greater than 25%, not greater than 20%, not greater than 15%, not greater than 10%, not greater than 9%, not greater than 8%, not greater than 6%, not greater than 5%, not greater than 4%, not greater than 2%, or not greater than 1%.

Embodiment 114. The abrasive article of embodiment 97 or 98, wherein the abrasive article comprises a coated abrasive or a non-woven abrasive, wherein the abrasive article comprises a flexibility difference in a transversal direction of not greater than 50%, not greater than 45%, not greater than 40%, not greater than 35%, not greater than 30%, not greater than 25%, not greater than 20%, not greater than 15%, not greater than 10%, not greater than 9%, not greater than 8%, not greater than 6%, not greater than 5%, not greater than 4%, not greater than 2%.

Embodiment 115. The abrasive article of embodiment 97 or 98, wherein the abrasive article comprises a coated abrasive or a non-woven abrasive, wherein the abrasive article comprises a flexural strength difference of not greater than 50% or not greater than 45% or not greater than 40% or not greater than 35% or not greater than 30% or not greater than 25% or not greater than 20% or not greater than 19% or not greater than 18% or not greater than 16% or not greater than 15% or not greater than 14% or not greater than 12% or not greater than 11% or not greater than 10% or not greater than 9% or not greater than 8% or not greater than 6% or not greater than 5% or not greater than 4% or not greater than 2% or not greater than 1% of the second flexural strength.

Embodiment 116. The abrasive article of embodiment 97 or 98, wherein the abrasive article comprises a coated abrasive or a non-woven abrasive, wherein the abrasive article comprises a tensile strength difference of not greater than 50% or not greater than 45% or not greater than 40% or not greater than 35% or not greater than 30% or not greater than 25% or not greater than 20% of the second tensile strength or not greater than 19% or not greater than 18% or not greater than 16% or not greater than 15% or not greater than 14% or not greater than 12% or not greater than 11% not greater than 10% or not greater than 9% or not greater than 8% or not greater than 6% or not greater than 5% or not greater than 4% or not greater than 2% or not greater than 1% of the second tensile strength.

Embodiment 117. The abrasive article of embodiment 97 or 98, wherein the abrasive article is in a form of a disc including a central opening, wherein the electronic assembly is disposed adjacent the central opening, wherein a distance between a center of the disc to the electronic assembly is less than 0.5 R, such as not greater than 0.4 R, not greater than 0.3 R, not greater than 0.2 R, or not greater than 0.1 R, wherein R is an outer radius of the disc.

Embodiment 118. The abrasive article of embodiment 117, wherein the distance is at least 0.05 R, such as at least 0.08 R or at least 0.1 R.

Embodiment 119. The abrasive article of embodiment 97 or 98, wherein the abrasive article is in a form of a disc including a peripheral surface, wherein the electronic assembly is disposed adjacent the peripheral surface, wherein a distance between a center of the disc to the electronic assembly is greater than 0.5 R, such as at least 0.6 R, at least 0.7 R, at least 0.8 R, or at least 0.9 R, wherein R is an outer radius of the disc.

Embodiment 120. The abrasive article of embodiment 119, wherein the distance between the center of the disc to the electronic assembly is not greater than 0.99 R or not greater than 0.95 R or not greater than 0.93 R or not greater than 0.9 R.

Embodiment 121. The abrasive article of embodiment 97 or 98, wherein the abrasive article is in a form of a belt, wherein the electronic assembly is disposed adjacent an edge of the belt, wherein a distance between the edge of the belt to the electronic assembly is less than 0.5 W or not greater than 0.4 W or not greater than 0.3 W or not greater than 0.2 W or not greater than 0.1 W, wherein W is a width across the belt in lateral direction.

Embodiment 122. The abrasive article of embodiment 121, wherein the distance between the edge of the belt to the electronic assembly is at least 0.05 W or at least 0.07 W or at least 0.09 W or at least 0.1 W or at least 0.15 W.

Embodiment 123. The abrasive article of embodiment 97 or 98, wherein a longitudinal axis of the electronic assembly is substantially aligned with a longitudinal axis of the coated abrasive article.

Embodiment 124. The abrasive article of embodiment 97 or 98, wherein a lateral axis of the electronic assembly is substantially aligned with a longitudinal axis of the abrasive article.

Embodiment 125. The abrasive article of embodiment 97 or 98, wherein a longitudinal axis of the electronic assembly is angled with respect to a longitudinal axis of the abrasive article.

Embodiment 126. The abrasive article of embodiment 97 or 98, wherein a longitudinal axis of the electronic assembly is substantially aligned with a radial axis of the abrasive article.

Embodiment 127. The abrasive article of embodiment 97 or 98, wherein a longitudinal axis of the electronic assembly is angled with respect to a radial axis of the coated abrasive article.

Embodiment 128. The abrasive article of embodiment 97 or 98, wherein the electronic assembly comprises a curvature and is co-axial with a curvature of the abrasive article.

Embodiment 129. The abrasive article of embodiment 97 or 98, wherein the electronic assembly comprises at least one electronic device including a radio frequency identification tag, a near field communication tag, a moisture sensor, a temperature senor, or a combination thereof.

Embodiment 130. The abrasive article of embodiment 97 or 98, wherein the electronic assembly comprises a package, wherein at least one electronic device is contained within the package.

Embodiment 131. The abrasive article of embodiment 130, wherein the package comprises a thermal barrier material.

Embodiment 132. The abrasive article of embodiment 131, wherein the thermal barrier material comprises a material selected from the group consisting of thermoplastic polymers includes polycarbonates, polyacrylates, polyamides, polyimides, polysulphones, polyketones, polybenzimidizoles, polyesters, and blends of the above mentioned polymers, thermoset polymers includes, epoxies, cyanoesters, phenol formaldehyde, polyurethanes, poly (amide/imide), cross-linkable unsaturated polyesters, ceramics, polypropylene, polyimides, polysulfone (PSU), poly(ethersulfone) (PES) and polyetherimide (PEI), poly(phenylene sulfide) (PPS), polyetheretherketone (PEEK), polyether ketones (PEK), aromatic polymers, poly(p-phenylene), ethylene propylene rubber and/or cross-linked polyethylene, a fluoropolymer including polytetrafluorethylene or Teflon, or any combination thereof.

Embodiment 133. The abrasive article of embodiment 131, wherein the thermal barrier package comprises at least one of the following:

thermal conductivity within a range of at least 0.33 W/m/K to not greater than 200 W/m/K; and a water vapor transmission rate within a range of not greater than 2.0 g/m$^2$-day.

Embodiment 134. The abrasive article of embodiment 130, wherein the package is substantially transparent to radio frequency electromagnetic radiation.

Embodiment 135. The abrasive article of embodiment 130, wherein the package comprises a layer including a hydrophobic material.

Embodiment 136. The abrasive article of embodiment 135, wherein the hydrophobic material comprises manganese oxide polystyrene (MnO2/PS) nano-composite, zinc oxide polystyrene (ZnO/PS) nano-composite, calcium carbonate, carbon nano-tubes, silica nano-coating, fluorinated silanes, fluoropolymer, or a combination thereof.

Embodiment 137. The abrasive article of embodiment 130, wherein the package comprises a protection layer, wherein the protection layer overlies at least a portion of the at least one electronic device.

Embodiment 138. The abrasive article of embodiment 130, wherein the package comprises a protection layer, wherein the protection layer overlies an entire exterior surface of the at least one electronic device.

Embodiment 139. The abrasive article of embodiment 130, wherein the package comprises a protection layer, wherein the protection layer comprises parylene, silicone, acrylic, epoxy based resin, ceramics, metal, polycarbonate (PC), polyvinyl chloride (PVC), polyimide, PVB, poly vinyl butyral (PVB), Polyurethane (PU), Polytetrafluoroethylene (PTFE), polybutylene terephthalate (PBT), polyethylenevinylacetate (PET), polyethylene naphthalate (PEN), polyvinyl chloride (PVC), polyvinyl fluorides (PVF), polyacrylate (PA), polymethyl methacrylate (PMMA), polyurethane (PUR), or a combination thereof.

Embodiment 140. The abrasive article of embodiment 130, wherein the package comprises an autoclavable material.

Embodiment 141. The abrasive article of embodiment 97 or 98, wherein the electronic assembly comprises at least one electronic device including an electronic integrated circuit chip, data transponder, a tag, a sensor or any combination thereof.

Embodiment 142. The abrasive article of embodiment 141, wherein the electronic device further comprises an antenna.

Embodiment 143. The abrasive article of embodiment 141, wherein the electronic assembly further comprises a power source, a substrate, or a combination thereof.

Embodiment 144. The abrasive article of embodiment 97 or 98, wherein the electronic assembly comprises an electronic device having a communication range of at least 10 mm, at least 15 mm, at least 20 mm, or at least 25 mm.

Embodiment 145. The abrasive article of embodiment 97 or 98, wherein the electronic assembly comprises an electronic device having a communication range of not greater than 35 mm, not greater than 30 mm, or not greater than 25 mm.

Embodiment 146. The abrasive article of embodiment 97 or 98, wherein the electronic assembly comprises an electronic device having a communication range of at least 1.0 meter, at least 1.5 meters, at least 2.0 meters, at least 2.5 meters, at least 3.0 meters, at least 3.5 meters, at least 4.0 meters, at least 4.5 meters, at least 5.0 meters, at least 5.5 meters, at least 6.0 meters, at least 6.5 meters, or at least 7.0 meters.

Embodiment 147. The abrasive article of embodiment 97 or 98, wherein the electronic assembly comprises an electronic device having a communication range of not greater than 9.0 meters, not greater than 8.5 meters, not greater than 8.0 meters, not greater than 7.5 meters, not greater than 7.0 meters, not greater than 6.5 meters, not greater than 6.0 meters, not greater than 5.5 meters, not greater than 5.0 meters, not greater than 4.5 meters, not greater than 4.0 meters, not greater than 3.5 meters, not greater than 3.0 meters, not greater than 2.5 meters, or not greater than 2.0 meters.

Embodiment 148. The abrasive article of embodiment 97 or 98, wherein the electronic assembly comprises an electronic device having a communication range of at least 100 meters, at least 200 meters, at least 400 meters, at least 500 meters, or at least 700 meters.

Embodiment 149. The abrasive article of embodiment 97 or 98, wherein the electronic assembly comprises an electronic device having a communication range of not greater than 1000 meters, such as not greater than 800 meters, or not greater than 700 meters.

Embodiment 150. The abrasive article of embodiment 97, wherein the abrasive article comprises non-woven abrasive article, wherein the non-woven abrasive article comprises the abrasive portion overlying a fibrous web, wherein the abrasive portion is an abrasive coating.

Embodiment 151. The abrasive article of embodiment 150, wherein the electronic assembly is disposed between the fibrous web and the abrasive coating.

Embodiment 152. The abrasive article of embodiment 150, wherein the electronic assembly is spaced apart from the fibrous web.

Embodiment 153. The abrasive article of embodiment 150, wherein the electronic assembly is disposed on the fibrous web.

Embodiment 154. The abrasive article of embodiment 150, wherein the electronic assembly is in contact with a portion of the fibrous web.

Embodiment 155. The abrasive article of embodiment 150, wherein the electronic assembly is partially embedded in the fibrous web.

Embodiment 156. The abrasive article of embodiment 97, comprising an abrasive body comprising the abrasive portion, wherein the abrasive portion comprises a bond material and abrasive particles contained within the bond material.

Embodiment 157. The abrasive article of embodiment 156, wherein the bond material comprises an organic material, a vitreous material, a ceramic material, or any combination thereof.

Embodiment 158. The abrasive article of embodiment 156, wherein the electronic assembly comprises an electronic device, wherein the electronic device is directly bonded to the bond material of the bonded abrasive body.

Embodiment 159. The abrasive article of embodiment 156, wherein the electronic assembly is bonded directly to an exterior surface of the abrasive body.

Embodiment 160. The abrasive article of embodiment 159, wherein the exterior surface of the bonded abrasive body is a major surface of the bonded abrasive body.

Embodiment 161. The abrasive article of embodiment 156, wherein the electronic assembly is positioned in an interior circumferential region of the abrasive body.

Embodiment 162. The abrasive article of embodiment 156, wherein the electronic assembly is positioned in an inner abrasive portion of the abrasive body.

Embodiment 163. The abrasive article of embodiment 156, wherein the electronic assembly is at least partially embedded in the abrasive body.

Embodiment 164. The abrasive article of embodiment 156, wherein the electronic assembly is embedded entirely within the bonded abrasive body and spaced apart from an exterior surface of the bonded abrasive body.

Embodiment 165. The abrasive article of embodiment 164, wherein the embedded electronic assembly is bonded directly to the bond material.

Embodiment 166. The abrasive article of embodiment 164, wherein the electronic assembly is embedded at a depth ($D_{EA}$) of less than 80% of a total thickness of the bonded abrasive body ($T_B$) or not greater than 75% or not greater than 70% or not greater than 65% or not greater than 60% or not greater than 55% or not greater than 50% or not greater than 45% or not greater than 40% or not greater than 35% or not greater than 30% or not greater than 25% or not greater than 20% or not greater than 15% or not greater than 10% or not greater than 5% or not greater than 3% of the total thickness of the abrasive body ($T_B$).

Embodiment 167. The abrasive article of embodiment 164, wherein the electronic assembly is embedded at a depth ($D_{EA}$) of at least 1% of a total thickness of the abrasive body ($T_B$) or at least 2% or at least 3% or at least 5% or at least 8% or at least 10% or at least 12% or at least 15% or at least 20% or at least 25% or at least 30% or at least 40% or at least 50% of the total thickness of the abrasive body ($T_B$).

Embodiment 168. The abrasive article of embodiment 156, wherein the body comprises an inner abrasive portion and an outer abrasive portion, wherein the electronic assembly is at least partially embedded within the inner abrasive portion.

Embodiment 169. The abrasive article of embodiment 168, wherein the inner abrasive portion and the outer abrasive portion comprise a different bond material.

Embodiment 170. The abrasive article of embodiment 168, wherein the inner abrasive portion and the outer abrasive portion comprise a same bond material.

Embodiment 171. The abrasive article of embodiment 168, wherein the outer abrasive portion comprises a vitreous material, and the inner abrasive portion comprises a vitreous material that is essentially the same as the outer abrasive portion.

Embodiment 172. The abrasive article of embodiment 168, wherein the outer abrasive portion comprises a vitreous material, and the inner abrasive portion comprises an organic material.

Embodiment 173. The abrasive article of embodiment 168, wherein the inner abrasive portion comprises a first portion comprising a vitreous material, and a second portion comprising an organic material, wherein the electronic assembly is disposed between the first portion and the second portion.

Embodiment 174. The abrasive article of embodiment 168, wherein the organic material comprises, a resin, phenolic resin, epoxy, cement, or any combination thereof.

Embodiment 175. The abrasive article of embodiment 168, wherein the electronic assembly is in contact with an inner circumferential wall of the outer abrasive portion.

Embodiment 176. The abrasive article of embodiment 168, wherein the electronic assembly is embedded entirely within the inner abrasive portion and spaced apart from the outer abrasive portion.

Embodiment 177. The abrasive article of embodiment 156, wherein the body comprises a central opening and an inner circumferential wall defining the central opening, wherein the electronic assembly is in contact with a portion of the circumferential wall.

Embodiment 178. The abrasive article of embodiment 177, wherein the electronic assembly is bonded to the inner circumferential wall.

Embodiment 179. The abrasive article of embodiment 175, wherein a cement material overlies at least a portion of an exterior surface of the electronic assembly.

Embodiment 180. The abrasive article of embodiment 179, wherein a cement material overlies at least a portion of the inner circumferential wall, wherein the electronic assembly is at least partially embedded in the cement material.

Embodiment 181. The abrasive article of embodiment 178, wherein the cement material comprises calcium silicate, an oxide, aluminium silicate, magnesium silicate, or any combination thereof.

Embodiment 182. The abrasive article of embodiment 156, wherein the bond material consists essentially of an organic material.

Embodiment 183. The abrasive article of embodiment 156, wherein the bond material comprises an organic material and a vitreous material.

Embodiment 184. The abrasive article of embodiment 156, wherein the bond material consists essentially of a vitreous material.

Embodiment 185. The abrasive article of embodiment 156, wherein the body further comprises a non-abrasive portion.

Embodiment 186. The abrasive article of embodiment 185, wherein the electronic assembly is disposed between the abrasive portion and the non-abrasive portion.

Embodiment 187. The abrasive article of embodiment 185, wherein the electronic assembly is in contact with the non-abrasive portion.

Embodiment 188. The abrasive article of embodiment 185, wherein the electronic assembly is spaced apart from the non-abrasive portion.

Embodiment 189. The abrasive article of embodiment 185, wherein the non-abrasive portion comprises a material selected from the group consisting of a fabric, a fiber, a film, a woven material, a non-woven material, a glass, a fiberglass, a ceramic, a polymer, a resin, a polymer, a fluorinated polymer, an epoxy resin, a polyester resin, a polyurethane, a polyester, a rubber, a polyimide, a polybenzimidazole, an aromatic polyamide, a modified phenolic resin, paper, or any combination thereof.

Embodiment 190. The abrasive article of embodiment 156, further comprising a non-abrasive portion overlying the body.

Embodiment 191. The abrasive article of embodiment 190, wherein the electronic assembly is disposed between the abrasive portion and the non-abrasive portion.

Embodiment 192. The abrasive article of embodiment 190, wherein the electronic assembly is in contact with the non-abrasive portion.

Embodiment 193. The abrasive article of embodiment 190, wherein the electronic assembly is spaced apart from the non-abrasive portion.

Embodiment 194. The abrasive article of embodiment 190, wherein the non-abrasive portion forms an exterior surface of the abrasive article, wherein the non-abrasive portion covers a major surface of the body.

Embodiment 195. The abrasive article of embodiment 190, wherein the non-abrasive portion comprises a material selected from the group consisting of a fabric, a fiber, a film, a woven material, a non-woven material, a glass, a fiberglass, a ceramic, a polymer, a resin, a polymer, a fluorinated polymer, an epoxy resin, a polyester resin, a polyurethane, a polyester, a rubber, a polyimide, a polybenzimidazole, an aromatic polyamide, a modified phenolic resin, paper, or any combination thereof.

Embodiment 196. The abrasive article of embodiment 185, wherein the abrasive article comprises an ultra thin wheel, a cut-off wheel, or a combination wheel.

Embodiment 197. The abrasive article of embodiment 97, wherein the electronic assembly comprises at least one electronic device, wherein the electronic device comprises a partitioned portion comprising data, wherein the partitioned portion is access-restricted.

Embodiment 198. A process of forming an abrasive article, comprising:

forming an abrasive body precursor coupled to an electronic assembly; and applying a treatment to the abrasive body precursor coupled to the electronic assembly to form the abrasive article.

Embodiment 199. The process of embodiment 198, wherein applying the treatment comprises applying a heat, pressure or a combination thereof to the abrasive body precursor coupled to the electronic assembly.

Embodiment 200 The process of embodiment 198, wherein forming the abrasive body precursor coupled to the electronic assembly comprises:

disposing an electronic assembly over a portion of a backing or a fibrous web; and disposing an abrasive coating layer overlying at least a portion of the electronic assembly and at least a portion of the backing or the fibrous web, wherein the abrasive coating layer comprises a precursor bond material.

Embodiment 201. The process of embodiment 198, wherein applying a treatment comprises heating to co-cure the abrasive coating layer and the electronic assembly.

Embodiment 202. The process of embodiment 201, wherein co-curing the abrasive coating layer and the electronic assembly is performed at a temperature of at least 90° C., at least 95° C., at least 100° C., at least 105° C., at least 108° C., at least 110° C., at least 115° C., or at least 120° C.

Embodiment 203. The process of embodiment 201, wherein co-curing the abrasive coating layer and the electronic assembly is performed at a temperature of not greater than 185° C., not greater than 180° C., not greater than 175° C., not greater than 170° C., not greater than 165° C., not greater than 160° C., not greater than 155° C., not greater than 150° C., not greater than 145° C., not greater than 140° C., not greater than 135° C., not greater than 130° C., not greater than 125° C., or not greater than 120° C.

Embodiment 204. The process of embodiment 201, wherein co-curing the abrasive coating layer and the electronic assembly is performed for at least 0.5 hours, at least 1 hour, at least 2 hours, at least 3 hours, at least 4 hours, at least 5 hours, at least 6 hours, at least 7 hours, or at least 8 hours.

Embodiment 205. The process of embodiment 201, wherein co-curing the abrasive coating layer and the electronic assembly is performed for not greater than 8 hours, not greater than 7 hours, not greater than 6 hours, not greater than 5 hours, not greater than 4 hours, not greater than 3 hours, or not greater than 2 hours.

Embodiment 206. The process of embodiment 200, wherein disposing the abrasive coating layer comprises disposing a first abrasive coating layer including the precursor bond material over at least a portion of the electronic assembly and at least a portion of the backing or fibrous web.

Embodiment 207. The process of embodiment 200, wherein disposing the abrasive coating layer comprises disposing a second abrasive coating layer over the first abrasive coating layer, disposing abrasive particles over the second abrasive coating layer, and disposing a third abrasive coating layer over the abrasive particles and at least a portion of the second abrasive coating layer.

Embodiment 208. The process of embodiment 198, wherein applying the treatment comprises heating the abrasive coating layer, wherein heating the abrasive coating layer comprises curing the first abrasive coating layer, wherein the second abrasive coating layer is disposed after curing the first abrasive coating layer.

Embodiment 209. The process of embodiment 208, wherein heating the abrasive coating layer comprises curing the second abrasive coating layer, wherein the third abrasive coating layer is disposed after the curing the second abrasive coating layer.

Embodiment 210. The process of embodiment 208, wherein heating the abrasive coating layer comprises curing the third abrasive coating layer, wherein curing the first, second, and third abrasive layers is performed at a temperature of at least 110° C., at least 115° C., at least 120° C., at least 125° C., at least 130° C., at least 135° C., or at least 140° C.

Embodiment 211. The process of embodiment 208, wherein heating the abrasive coating layer comprises curing the third abrasive coating layer, wherein curing the first, second, and third abrasive layers is performed at a temperature of not greater than 145° C., not greater than 140° C., not greater than 135° C., not greater than 130° C., not greater than 125° C., or not greater than 120° C.

Embodiment 212. The process of embodiment 208, wherein heating the abrasive coating layer comprises curing the third abrasive coating layer, wherein curing the first, second, and third abrasive layers is performed for at least 0.5 hours and not greater than 8 hours.

Embodiment 213. The process of embodiment 198, wherein coupling an electronic assembly to an abrasive body precursor comprises combining the electronic assembly with a mixture including the abrasive particles and bond material precursor.

Embodiment 214. The process of embodiment 213, wherein coupling an electronic assembly to an abrasive body precursor comprises pressing the mixture and the electronic assembly.

Embodiment 215. The process of embodiment 213, wherein pressing is performed at a temperature of at least 15° C., at least 20° C., at least 25° C., at least 30° C., at least 50° C., at least 70° C., at least 80° C. or at least 90° C.

Embodiment 216. The process of embodiment 213, wherein pressing is performed at a temperature of not greater than 160° C., not greater than 150° C., not greater than 140° C., not greater than 130° C., not greater than 120° C., not greater than 110° C., not greater than 100° C., not greater than 90° C., not greater than 70° C., not greater than 60° C., not greater than 50° C., or not greater than 40° C.

Embodiment 217. The process of embodiment 213, wherein pressing is performed at a pressure of at least 0.3 bars, at least 1 bar, at least 3 bars, at least 10 bars, at least 15 bars, at least 20 bars, at least 25 bars, at least 30 bars, at least 35 bars, at least 40 bars, at least 45 bars or at least 50 bars, at least 60 bars, at least 65 bars, at least 70 bars, at least 75 bars, at least 80 bars, at least 85 bars, at least 90 bars, at least 100 bars, at least 120 bars, at least 130 bars, at least 135 bars, at least 140 bars, at least 150 bars, at least 160 bars, at least 170 bars, or at least 180 bars.

Embodiment 218. The process of embodiment 213, wherein pressing is performed at pressure of at most 200 bars, at most 190 bars, at most 180 bars, at most 170 bars, at most 160 bars, at most 150 bars, at most 140 bars, at most 130 bars, at most 120 bars, at most 110 bars, at most 100 bars, at most 90 bars, at most 80 bars, at most 70 bars, at most 60 bars, or at most 50 bars.

Embodiment 219. The process of embodiment 213, wherein pressing is performed for at least 10 seconds, at least 30 seconds, at least 1 minute, at least 2 minutes, at least 5 minutes, or at least 10 minutes.

Embodiment 220. The process of embodiment 213, wherein pressing is performed for not greater than 30 minutes, not greater than 20 minutes, not greater than 15 minutes, not greater than 10 minutes, or not greater than 5 minutes.

Embodiment 221. The process of embodiment 198, wherein forming comprises disposing the electronic device over an exterior surface of the abrasive precursor body.

Embodiment 222. The process of embodiment 221, wherein applying the treatment comprises heat to co-cure the abrasive body precursor and the electronic assembly, wherein co-curing is performed at a temperature of at least 150° C., at least 155° C., at least 160° C., at least 165° C., at least 170° C., at least 175° C., at least 180° C., at least 190° C., at least 200° C., at least 210° C., at least 220° C., at least 230° C., at least 240, ° C., or at least 250° C.

Embodiment 223. The process of embodiment 222, wherein co-curing the abrasive body precursor and the electronic assembly is performed at a temperature of not greater than 250° C., not greater than 245° C., not greater than 240° C., not greater than 235° C., not greater than 230° C., not greater than 220° C., not greater than 215° C., not greater than 210° C., not greater than 200° C., not greater than 195° C., not greater than 180° C., or not greater than 170° C.

Embodiment 224. The process of embodiment 222, wherein co-curing the abrasive body precursor and the electronic assembly is performed for at least 10 hours, at least 12 hour, at least 15 hours, at least 18 hours, at least 20 hours, at least 30 hours, at least 26 hours, at least 28 hours, at least 30 hours, at least 32 hours, at least 35 hours, or at least 36 hours.

Embodiment 225. The process of embodiment 222, wherein co-curing the abrasive body precursor and the electronic assembly is performed for not greater than 38 hours, not greater than 36 hours, not greater than 32 hours, not greater than 30 hours, not greater than 28 hours, not greater than 25 hours, or not greater than 21 hours.

Embodiment 226. The process of embodiment 221, wherein forming further comprises disposing a non-abrasive portion over the electronic assembly.

Embodiment 227. A process of forming an abrasive article, comprising:

disposing an electronic assembly over an abrasive body of the abrasive article; and pressing the electronic assembly at a temperature of at least 100° C. to form the bonded abrasive article.

Embodiment 228. The process of embodiment 226, wherein the temperature is at least 110° C., at least 120° C., at least 125° C., at least 130° C., at least 150° C., at least 150° C., or at least 160° C.

Embodiment 229. The process of embodiment 226, wherein the temperature is not greater than 180° C., not greater than 175° C., not greater than 170° C., not greater than 165° C., not greater than 160° C., not greater than 155° C., not greater than 150° C., not greater than 145° C., not greater than 140° C., not greater than 130° C., or not greater than 125° C.

Embodiment 230. The process of embodiment 226, wherein pressing is performed for at least 15 minutes, at least 20 minutes, at least 25 minutes, or at least 30 minutes.

Embodiment 231. The process of embodiment 226, wherein pressing is performed for not greater than 35 minutes, not greater than 30 minutes, not greater than 25 minutes, or not greater than 20 minutes.

Embodiment 232. The process of embodiment 226, wherein pressing is performed at a force of at least 0.3 bars, at least 1 bar, at least 3 bars, at least 10 bars, at least 15 bars, at least 20 bars, at least 25 bars, at least 30 bars, at least 35 bars, at least 40 bars, at least 45 bars or at least 50 bars, at least 60 bars, at least 65 bars, at least 70 bars, at least 75 bars, at least 80 bars, at least 85 bars, at least 90 bars, at least 100 bars, at least 120 bars, at least 130 bars, at least 135 bars, at least 140 bars, at least 150 bars, at least 160 bars, at least 170 bars, or at least 180 bars.

Embodiment 233. The process of embodiment 226, wherein pressing is performed at a pressure of at most 200 bars, at most 190 bars, at most 180 bars, at most 170 bars, at most 160 bars, at most 150 bars, at most 140 bars, at most 130 bars, at most 120 bars, at most 110 bars, at most 100 bars, at most 90 bars, at most 80 bars, at most 70 bars, at most 60 bars, or at most 50 bars.

Embodiment 234. A process of forming an abrasive article, comprising coupling an electronic assembly to a surface of an inner circumferential wall of an abrasive body.

Embodiment 235. The process of embodiment 234, wherein coupling comprises applying a bonding material over at least a portion of an electronic assembly and at least a portion of the surface of the inner circumferential wall.

Embodiment 236. The process of embodiment 234, wherein coupling comprises bonding the electronic assembly to the surface of the inner circumferential wall.

Embodiment 237. The process of embodiment 236, wherein the bonding material comprises a cement material, a polymer material, or a combination thereof.

Embodiment 238. The process of embodiment 236, wherein bonding comprises curing the cement material at a temperature not greater than 40° C., such as not greater than 35° C. or not greater than 30° C. or not greater than 25° C.

Embodiment 239. The process of embodiment 236, wherein the bonding material comprises an adhesive including the polymer.

Embodiment 240. The process of embodiment 236, wherein the polymer comprises a resin, epoxy, phenolic resin, cement, or any combination thereof.

Embodiment 241. A process of forming an abrasive article, comprising:

disposing an electronic assembly over a abrasive body precursor;

disposing a bond material including a bond material precursor over at least a portion of the electronic assembly and at least a portion of the abrasive body precursor; and applying a treatment to the bond material precursor and the electronic assembly.

Embodiment 242. The process of embodiment 241, wherein the electronic assembly is disposed over an inner abrasive portion of the bonded abrasive body precursor, wherein the inner abrasive portion has a first thickness less than a second thickness of an outer abrasive portion of the bonded abrasive body precursor.

Embodiment 243. The process of embodiment 242, wherein the first thickness of the inner abrasive portion is not greater than 90% of the second thickness of the outer abrasive portion, not greater than 80%, not greater than 70%, not greater than 60%, or not greater than 50% of the second thickness of the outer abrasive portion.

Embodiment 244. The process of embodiment 242, wherein the first thickness of the inner abrasive portion is at least 10% of the second thickness of the outer abrasive portion, at least 15%, at least 20%, at least 25%, at least 30%, at least 40%, at least 45%, or at least 50% of the second thickness of the outer abrasive portion.

Embodiment 245. The process of embodiment 242, wherein the outer abrasive portion of the bonded abrasive body precursor comprises a bond material including a vitreous material.

Embodiment 246. The process of embodiment 242, wherein the inner abrasive portion of the bonded abrasive body precursor comprises a same bond material as the outer abrasive portion.

Embodiment 247. The process of embodiment 242, wherein applying the treatment comprises heating to co-cure the bonded abrasive body precursor and the electronic assembly.

Embodiment 248. The process of embodiment 247, wherein co-curing is performed at a temperature of 90° C., at least 95° C., at least 100° C., at least 105° C., at least 108° C., at least 110° C., at least 115° C., or at least 120° C.

Embodiment 249. The process of embodiment 247, wherein co-curing is performed at a temperature of not greater than 185° C., not greater than 180° C., not greater than 175° C., not greater than 170° C., not greater than 165° C., not greater than 160° C., not greater than 155° C., not greater than 150° C., not greater than 145° C., not greater than 140° C., not greater than 135° C., not greater than 130° C., not greater than 125° C., or not greater than 120° C.

Embodiment 250. The process of embodiment 247, wherein co-curing is performed for at least 0.5 hours, at least 1 hour, at least 2 hours, at least 3 hours, at least 4 hours, at least 5 hours, at least 6 hours, at least 7 hours, or at least 8 hours.

Embodiment 251. The process of embodiment 247, wherein co-curing is performed for not greater than 8 hours, not greater than 7 hours, not greater than 6 hours, not greater than 5 hours, not greater than 4 hours, not greater than 3 hours, or not greater than 2 hours.

Embodiment 252. The process of embodiment 241, wherein the abrasive article comprises the abrasive body including an inner abrasive portion and an outer abrasive portion, wherein the inner abrasive portion and an outer abrasive portion have substantially a same thickness.

Embodiment 253. The process of embodiment 241, wherein the bonded abrasive article comprises the bonded abrasive body including an inner abrasive portion and an outer abrasive portion, wherein the inner abrasive portion and an outer abrasive portion comprise a different bond material.

Embodiment 254. An abrasive article, comprising an abrasive portion and an electronic assembly coupled to the abrasive portion, wherein the electronic assembly comprises a flexible electronic device.

Embodiment 255. The abrasive article of embodiment 254, wherein the flexible electronic device comprises a substrate consisting essentially of a flexible material.

Embodiment 256. The abrasive article of embodiment 254, wherein the flexible electronic device comprises a substrate consisting essentially of an organic material.

Embodiment 257. The abrasive article of embodiment 254, wherein the flexible electronic device comprises a substrate consisting essentially of a plastic material.

Embodiment 258. The abrasive article of embodiment 158, wherein the flexible electronic device comprises a substrate consisting essentially of polymers.

Embodiment 259. The abrasive article of embodiment 254, wherein the flexible electronic device comprises a substrate consisting essentially of at least one material selected from the group consisting of polyester, PET, PEN, polyimide, polyimide-fluoropolymer, PEEK, and conductive polyester.

Embodiment 260. The abrasive article of embodiment 254, wherein the abrasive article comprises a coated abrasive article, a non-woven abrasive article, or a combination thereof.

Embodiment 261. The abrasive article of embodiment 254, wherein the flexible electronic device comprises a radius bend of at most 13 times a thickness of the electronic device.

Embodiment 262. The abrasive article of embodiment 254, wherein the flexible electronic device comprises a radius bend of at most 5 times a thickness of the electronic device.

Embodiment 263. The abrasive article of embodiment 254, wherein the flexible electronic device is encapsulated in a package.

Embodiment 264. An abrasive article, comprising an abrasive portion and an electronic assembly coupled to the abrasive portion, wherein the electronic assembly comprises an electronic device encapsulated in a package.

EXAMPLES

Example 1

Representative cut-off wheels S1 were formed as disclosed in embodiments herein. Briefly, a mixture including abrasive particles and a bond material was disposed in a mold and pressed to form a green body. Electronic assemblies 1 to 3 or 4 to 6 as disclosed in Table 1 were placed on the surface in the interior circumferential region of the green body. A set of wheel Samples S1 were formed using electronic assemblies 1 to 3, and another set formed with electronic assemblies 4 to 6. RFID and NFC tags were encapsulated in the protection layers made of polyimide or PEN. The protection layer surrounding the temperature sensor had an opening for the sensing element to detect the temperature of the surface of the body. The temperature sensor was otherwise covered by the protection layer. Green bodies with the electronic assemblies were stacked, and allowed to cure at a temperature up to 180° C. for 16 hours to form finally formed cut-off wheels. The electronic assemblies were bonded to the surface of each wheel.

TABLE 1

| | Component | |
|---|---|---|
| Electronic assembly | Electronic device | Protection layer |
| 1 | RFID tag | Polyimide |
| 2 | NFC tag | Polyimide |
| 3 | Temperature sensor | Polyimide |
| 4 | RFID tag | Polyethylene naphthalate (PEN) |
| 5 | NFC tag | Polyethylene naphthalate (PEN) |
| 6 | Temperature sensor | Polyethylene naphthalate (PEN) |

Additional cut-off wheels S2 were formed according to embodiments noted herein. Briefly, green bodies were formed in the same manner as those of wheels S1. The green bodies were stacked and allowed to cure at the same conditions noted for wheels S1. An RFID tag, NFC tag, and a temperature sensor were placed on a surface in the interior circumferential region of the finally formed wheel bodies. Blotter paper was placed to cover the interior circumferential region, and pressure of 0.2 to 3 bars was applied to the blotter paper, the tags, and the bodies at the temperature of about 150° C. for 20 to 30 minutes to form the finally formed wheels S2.

Wheel Samples S1 and S2 were tested on readability of the tags and sensors. Compared to those that were not subjected to the forming process, readability of the tags and sensors was not affected by the forming process.

Example 2

Further cut-off wheel Samples were formed in the same manner as Samples S1 except that different electronic assemblies were used. Wheel Samples S3 were formed using electronic assemblies included the same electronic devices and protection layer as noted for Samples S1, and included a hydrophobic layer in addition to the protection layer. Wheel Samples S4 were formed using electronic assemblies where each of the RFID, NFC, and temperature sensors were encapsulated in a hydrophobic layer. The hydrophobic layer for all the samples was made of fluorinated silane.

Samples S3 and S4 were soaked in water-based coolant having a pH of 8.5 to 9.5 for 8 days, and readability of the tags and sensors were tested by using a reader. Another set of wheel Samples S1 and S2 were sprayed on with the similar coolant under normal operating conditions for 20 to 30 minutes. The coolant flow rate was 0.2 to 5 $m^3$/hr. The readability of the tags and sensors after each test was not affected compared to that prior to the test. Further wheel Samples S3 and S4 were sprayed with slurries including the coolant and abrasive particles using a nozzle in the vertical direction for 20 to 30 minutes. The flow rate of the slurry was 0.2 to 1 $m^3$/hr. The readability of the tags and sensors was not affected by the test conditions compared to that prior to the test.

Example 3

Grinding wheel samples S5 and S6 were formed according to embodiments herein. For forming Sample S5, half of a mixture including abrasive particles and organic bond materials was disposed in a mold and pressed to form a first green body. An electronic assembly including a RFID tag was placed on the first green body and covered by the remaining mixture. The RFID tag was contained in a package including a layer of a thermal barrier and a layer of a pressure barrier. Each layer had a thickness of approximately 80 microns and was made of polyimide. The mixture was pressed to form the green body having the full thickness with the electronic assembly embedded at the depth of 50% of the full thickness. The green body was then heated to cure at the temperature of 160° C. for 24 hours to form the grinding wheel. Sample S6 was formed in the same manner as S5, except that an electronic assembly including a NFC tag and a temperature sensor was embedded at the depth of 20%.

The wheels were operated on a grinder and run at the speed of 2800 rpm for 20 to 30 minutes. Readability of the tags were tested at the end of the grinding operation, and the tags were found fully functional.

Example 4

Grinding wheel sample S7 was formed according to embodiments noted herein. Briefly, a RFID tag was disposed on the inner circumferential wall of a vitrified wheel. A cement material including calcium-based silicate was applied over the electronic assembly and the entire exposed surface of the inner circumferential wall and allowed to cure at room temperature for 30 minutes to form Sample S7. Readability of the RFID tag was tested and no difference was observed compared to readability of the RFID tag prior to the attachment to the vitrified wheel.

The terms "comprises," "comprising," "includes," "including," "has," "having" or any other variation thereof, are intended to cover a non-exclusive inclusion. For example, a method, article, or apparatus that comprises a list of features is not necessarily limited only to those features but may include other features not expressly listed or inherent to such method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

Also, the use of "a" or "an" is employed to describe elements and components described herein. This is done merely for convenience and to give a general sense of the scope of the invention. This description should be read to include one, at least one, or the singular as also including the plural, or vice versa, unless it is clear that it is meant otherwise. For example, when a single item is described herein, more than one item may be used in place of a single item. Similarly, where more than one item is described herein, a single item may be substituted for that more than one item.

What is claimed is:

1. An abrasive article, comprising:

a substrate;

an abrasive coating overlying the substrate; and an electronic assembly coupled to the abrasive coating, wherein at least a portion of the electronic assembly is in direct contact with a portion of the abrasive coating, wherein the electronic assembly comprises at least one electronic device in a package, wherein the at least one electronic device comprises a flexible substrate;

wherein the at least one electronic device comprises a tag and an antenna; and wherein the abrasive coating comprises a bond material and abrasive particles contained in the bond material, wherein at least a portion of the electronic assembly is in direct contact with the bond material of the abrasive coating.

2. The abrasive article of claim 1, wherein the electronic assembly is at least partially embedded in the abrasive coating.

3. The abrasive article of claim 1, wherein the entire electronic assembly is beneath a grinding surface of the abrasive coating.

4. The abrasive article of claim 1, wherein the abrasive coating comprises a thickness of not greater than 55% of an average thickness of the abrasive article.

5. The abrasive article of claim 1, wherein the electronic assembly is disposed between the substrate and the abrasive coating.

6. The abrasive article of claim 1, wherein the package comprises at least one of the following:

a water vapor transmission rate within a range of not greater than 2.0 g/$m^2$-day;

a thermal conductivity of at least 0.33 W/m/K to not greater than 200 W/m/K;

an autoclavable material;

a hydrophobic material including manganese oxide polystyrene ($MnO_2$/PS) nano-composite, zinc oxide polystyrene (ZnO/PS) nano-composite, calcium carbonate, carbon nano-tubes, silica nano coating, fluorinated silanes, fluoropolymer, or a combination thereof; or a protection layer comprises parylene, silicone, acrylic, epoxy based resin, ceramics, stainless steel, polycarbonate (PC), polyvinyl chloride (PVC), polyimide, PVB, poly vinyl butyral (PVB), Polyurethane (PU), Polytetrafluoroethylene (PTFE), polybutylene terephthalate (PBT), polyethylenevinylacetate (PET), polyethylene naphthalate (PEN), polyvinyl chloride (PVC), polyvinyl fluorides (PVF), polyacrylate (PA), polymethyl methacrylate (PMMA), polyurethane (PUR), or a combination thereof.

7. The abrasive article of claim 1, wherein the substrate comprises a backing or a fibrous web.

8. An abrasive article, comprising:

a bonded abrasive body comprising a bond material and abrasive particles contained within the bond material; and an electronic assembly coupled to the bonded abrasive body, wherein at least a portion of the electronic assembly is in direct contact with the bond material of the bonded abrasive body, wherein the electronic assembly comprises at least one electronic device comprising a tag and an antenna.

9. The abrasive article of claim 8, wherein at least a portion of the electronic assembly is exposed at an exterior surface of the bonded abrasive body.

10. The abrasive article of claim 8, wherein the electronic assembly is disposed on an exterior surface of the bonded abrasive body.

11. The abrasive article of claim 8, wherein the electronic assembly comprises at least one electronic device including a device selected from a group consisting of an electronic tag, electronic memory, a sensor, an analog to digital converter, a transmitter, a receiver, a transceiver, a modulator circuit, a multiplexer, an antenna, a near-field communication device, a power source, a display, an optical device, a global positioning system, or any combination thereof; and wherein the at least one electronic device is at least partially embedded in the abrasive coating.

12. The abrasive article of claim 8, wherein the bonded abrasive body comprises an inner abrasive portion and an outer abrasive portion, wherein the electronic assembly is at least partially embedded in the inner abrasive portion.

13. The abrasive article of claim 12, wherein the inner abrasive portion and the outer abrasive portion comprise a different bond material.

14. The abrasive article of claim 8, wherein the bonded abrasive body comprises a center opening, an inner circumferential wall, and an outer circumferential wall, wherein the electronic assembly is coupled to the inner circumferential wall of the bonded abrasive body.

15. The abrasive article of claim 14, wherein a cement material overlies at least a portion of the electronic assembly and at least a portion of a surface of the inner circumferential wall.

16. An abrasive article comprising:

a bonded abrasive body comprising:

an abrasive portion including a bond material and abrasive particles contained within the bond material;

a non-abrasive portion; and an electronic assembly coupled to the bonded abrasive body, wherein at least a portion of the electronic assembly is in direct contact with the bond material of the abrasive portion, wherein the electronic assembly comprises at least one electronic device comprising a tag and an antenna.

17. The abrasive article of claim 16, wherein the electronic assembly is directly bonded to a major surface of the body.

18. The abrasive article of claim 16, wherein the electronic assembly comprises a package, wherein at least one electronic device is contained within the package, wherein the package comprises at least one of the following:

a water vapor transmission rate within a range of not greater than 2.0 $g/m^2$-day;

a thermal barrier material including a thermal conductivity of at least 0.33 W/m/K to not greater than 200 W/m/K;

an autoclavable material;

a hydrophobic material including manganese oxide polystyrene ($MnO_2$/PS) nano-composite, zinc oxide polystyrene (ZnO/PS) nano-composite, calcium carbonate, carbon nano-tubes, silica nano coating, fluorinated silanes, fluoropolymer, or a combination thereof;

a protection layer comprises parylene, silicone, acrylic, epoxy based resin, ceramics, stainless steel, polycarbonate (PC), polyvinyl chloride (PVC), polyimide, PVB, poly vinyl butyral (PVB), Polyurethane (PU), Polytetrafluoroethylene (PTFE), polybutylene terephthalate (PBT), polyethylenevinylacetate (PET), polyethylene naphthalate (PEN), polyvinyl chloride (PVC), polyvinyl fluorides (PVF), polyacrylate (PA), polymethyl methacrylate (PMMA), polyurethane (PUR), or a combination thereof; or any combination thereof.

19. The abrasive article of claim 16, wherein at least a portion of the electronic assembly is exposed at an exterior surface of the bonded abrasive body.

20. The abrasive article of claim 16, wherein a portion of the electronic assembly extends into the bonded abrasive body including the bond material and abrasive particles.

* * * * *